US009326608B1

(12) United States Patent
Hoy et al.

(10) Patent No.: US 9,326,608 B1
(45) Date of Patent: May 3, 2016

(54) MULTI-CONFIGURABLE SEATING DEVICE

(71) Applicant: Goldilocks Associates, LLC, High Point, NC (US)

(72) Inventors: David E. Hoy, Suffolk, VA (US); Brian H. Edmunds, Virginia Beach, VA (US); Vernon C. Martell, Jr., High Point, NC (US)

(73) Assignee: Goldilocks Associates, LLC, High Point, NC (US)

( * ) Notice: Subject to any disclaimer, the term of this patent is extended or adjusted under 35 U.S.C. 154(b) by 0 days.

(21) Appl. No.: 14/294,499

(22) Filed: Jun. 3, 2014

Related U.S. Application Data

(63) Continuation-in-part of application No. 13/041,944, filed on Mar. 7, 2011, now abandoned, which is a continuation-in-part of application No. 11/971,850, filed on Jan. 9, 2008, now abandoned.

(51) Int. Cl.

| | |
|---|---|
| ***A47C 1/032*** | (2006.01) |
| ***A47C 7/50*** | (2006.01) |
| ***A47C 3/20*** | (2006.01) |
| ***A47C 3/00*** | (2006.01) |

(52) U.S. Cl.
CPC ..... *A47C 1/03211* (2013.01); *A47C 3/00* (2013.01); *A47C 3/20* (2013.01); *A47C 7/506* (2013.01)

(58) Field of Classification Search
CPC .. A47C 1/03211; A47C 1/0342; A47C 1/035; A47C 3/00; A47C 3/20
USPC ..... 297/94–96, 284.3, 284.7, 284.8, 313, 297/353, 383, 344.15, 344.17, 361.1, 297/362.11

See application file for complete search history.

(56) References Cited

U.S. PATENT DOCUMENTS

| | | | |
|---|---|---|---|
| 1,271,636 | A | 7/1918 | Walton |
| 1,486,813 | A | 3/1924 | Tallman |
| 1,685,770 | A | 10/1928 | Bowen |
| 1,734,179 | A | 11/1929 | Olsen |
| 1,734,180 | A | 11/1929 | Olsen |
| 1,835,048 | A | 12/1931 | Hottel |
| 3,288,525 | A | 11/1966 | Cerf |
| 4,647,066 | A | 3/1987 | Walton |
| 4,944,554 | A | 7/1990 | Gross et al. |
| 4,981,325 | A | 1/1991 | Zacharkow |
| 5,062,676 | A | 11/1991 | Mars |
| 5,067,187 | A | 11/1991 | Messina |

(Continued)

FOREIGN PATENT DOCUMENTS

| | | |
|---|---|---|
| EP | 2172136 | 4/2010 |

*Primary Examiner* — Peter Brown
(74) *Attorney, Agent, or Firm* — Womble Carlyle Sandridge & Rice, LLP

(57) ABSTRACT

A seating device such as a chair or sofa. The seating device includes a frame, a seat platform supported by the frame, and a backrest attached to the seat platform. The seat platform has opposite front and rear ends. The backrest has a first backrest portion extending upwardly from proximate the rear end of the seat platform. A lower end of the first backrest portion is positioned adjacent to an upper surface of the seat platform. The first backrest portion is capable of being moved forwardly and rearwardly along the upper surface of the seat platform while the lower end remains proximate the upper surface of the seat platform. A backrest-adjustment powered actuator operates the backrest for moving at least the first backrest portion forwardly and rearwardly partially along the upper surface of the seat platform to adjust an effective depth of the seat platform.

14 Claims, 44 Drawing Sheets

(56) References Cited

U.S. PATENT DOCUMENTS

| | | | |
|---|---|---|---|
| 5,228,747 | A | 7/1993 | Greene |
| 5,593,211 | A | 1/1997 | Jay et al. |
| 5,812,399 | A | 9/1998 | Judic et al. |
| 5,836,647 | A | 11/1998 | Turman |
| 6,257,664 | B1 | 7/2001 | Chew et al. |
| 6,695,378 | B2 | 2/2004 | Hanagan |
| 6,969,117 | B2 | 11/2005 | King et al. |
| 7,090,297 | B2 | 8/2006 | Mohn et al. |
| 7,147,282 | B2 | 12/2006 | Hatcher et al. |
| 7,290,834 | B2 | 11/2007 | Christopher |
| 7,387,338 | B2 | 6/2008 | Beranek et al. |
| 7,735,895 | B2 | 6/2010 | Brown et al. |
| 2001/0054836 | A1 | 12/2001 | Vik |
| 2004/0256899 | A1 | 12/2004 | Moore et al. |
| 2005/0151404 | A1 | 7/2005 | Dowty et al. |
| 2011/0193383 | A1 | 8/2011 | Guissin et al. |

MULTI-CONFIGURABLE SEATING DEVICE

CROSS-REFERENCE TO RELATED APPLICATION

The present application is a continuation-in-part of U.S. patent application Ser. No. 13/041,944, which was filed Mar. 7, 2011, which is a continuation-in-part of U.S. patent application Ser. No. 11/971,850, which was filed Jan. 9, 2008.

INCORPORATION BY REFERENCE

The entire disclosure of U.S. patent application Ser. No. 11/971,850, which was filed Jan. 9, 2008, is incorporated herein by reference. The entire disclosure of U.S. patent application Ser. No. 13/041,944, which was filed Mar. 7, 2011, is incorporated herein by reference.

FIELD OF THE DISCLOSURE

This disclosure relates to seating devices and, more particularly, to seating devices that may be adjusted between different configurations.

BACKGROUND OF THE DISCLOSURE

It is conventional for seating devices to be adjustable between different configurations. However, it is believed that conventional adjustable seating devices are lacking in some regards. Accordingly, there is a desire for adjustable seating devices that provide a new balance of properties.

BRIEF SUMMARY OF THE DISCLOSURE

The following presents a simplified summary of this disclosure in order to provide a basic understanding of some aspects of this disclosure. This summary is not an extensive overview of the disclosure and is not intended to identify key or critical elements of the invention or to delineate the scope of the invention. The purpose of this section is to present some concepts of the disclosure in a simplified form as a prelude to the more detailed description that is presented later.

In accordance with one aspect of this disclosure, a seating device includes a frame, a seat platform supported by the frame, and a backrest extending upwardly from proximate the rear end of the seat platform. The lower end of the backrest is proximate an upper surface of the seat platform, and the backrest may be moved forwardly and rearwardly along the upper surface of the seat platform, so that the lower end of the backrest moves forwardly and rearwardly along the upper surface of the seat platform while the lower end of the backrest remains proximate the upper surface of the seat platform. At least one powered adjustment mechanism may be operatively associated with the backrest for moving it as described above, and/or for carrying out other adjustments.

One or more powered adjustment mechanisms may be operatively associated with the seat platform for adjusting an inclination of the seat platform relative to the frame, moving the seat platform upwardly and downwardly relative to the frame, and/or making other adjustments. The upper surface of the seat platform may push the lower end of the backrest upwardly and thereby move the backrest upwardly in response to an adjustment mechanism moving the seat platform upwardly relative to the frame.

Regarding the movability of the backrest and the seat platform, each of these components of the seating device may include multiple portions, frames and/or sub-frames, and powered adjustment mechanisms may be respectively associated with the portions, frames and/or sub-frames to provide a variety of adjustments to the configuration of the seating device. Similarly, portions, frames and/or subframes of armrests and/or a footrest may be respectively associated with powered adjustment mechanisms to provide a variety of other adjustments to the configuration of the seating device. The adjustments may be utilized in a wide variety of combinations and subcombinations to readily accommodate the seating device to the different needs of a variety of different users. For example, a predetermined number of the adjustments may be carried out substantially simultaneously in a manner that helps someone stand up from, or get into, the seating device. The adjustments may be initiated by using a controller, and the controller may automatically coordinate the adjustments with one another.

Other aspects of this disclosure will become apparent from the following.

BRIEF DESCRIPTION OF THE DRAWINGS

Having described some aspects of this disclosure in general terms, reference will now be made to the accompanying drawings, which are not necessarily drawn to scale and are, to at least some extent, schematic.

FIG. 1 is a front perspective view of the couch showing, for example, seat platforms of the couch at different heights; and backrests of the couch at different inclinations, and at a different depths in relation to the front of the respective seat platform.

FIG. 2 is an isolated, front perspective view of the frame of the couch.

FIG. 3 is an exploded view of a powered backrest adjustment mechanism, the portion of the frame to which the backrest adjustment mechanism is attached, and a backrest cushion support to which the backrest adjustment mechanism is attached, for a representative one of the backrests.

FIG. 4 is a cutaway side view of the couch showing a representative one of the seat platforms in its retracted position, and showing the corresponding backrest at various distances and angles in relation to the seat platform.

FIG. 5 is a partially exploded view of a powered seat adjustment mechanism, the portion of the frame to which the seat adjustment mechanism is attached, and a seat cushion support to which the seat adjustment mechanism is attached, for a representative one of the seat platforms.

FIG. 6 is a cutaway side view of the couch showing the representative one of the seat platforms at various heights and angles in relation to the frame, and showing the corresponding backrest in positions partially extended from the frame to narrow the distance from the front of the seat platform to the base of the backrest. FIG. 6 also shows the backrest riding up with the seat platform in response to the seat platform being elevated.

FIG. 7 is a front view of the couch showing the seat platforms in three different extended positions to create different seat platform heights, and showing the armrests in different positions partially extended from the top and sides to change the angle of the sides of the armrests and change the height of the armrests.

FIG. 8 is a side view of an expandable guard for restricting access to moving parts, wherein the expendable guard is shown exploded away from the backrest cushion support and the rear subframe to which the expandable guard is normally attached.

FIG. 9 is an isolated top view of the expandable guard.

FIG. 10 is a perspective view of the chair, with a multi-positional backrest of the chair in a substantially exploded configuration.

FIG. 11 is a perspective view of the chair.

FIG. 12 is a side view of the chair, with its backrest in a lower position.

FIG. 13 is a side view of the chair, showing an optional and/or alternative configuration of the backrest.

FIG. 14 is a side view of the chair with the backrest in a raised position.

FIG. 15 is a side view of the chair with the backrest in a reclined position.

FIG. 16 is a side view of the chair with independently movable portions of the backrest in various positions.

FIG. 17 is a front view of the chair.

FIG. 18 is a perspective view of the chair, with a multi-positional seat platform of the chair in a substantially exploded configuration.

FIG. 19 is a perspective view of the chair.

FIG. 20 is side view of the chair.

FIG. 21 is side view of the chair with the front of the seat platform elevated.

FIG. 22 is a side view of the chair with the rear of the seat platform elevated.

FIG. 23 is a side view of the chair with both the front and rear of the seat platform elevated.

FIG. 24 is a front view of the chair with the seat platform tilted to the left.

FIG. 25 is a front view of the chair with the seat platform tilted to the right.

FIG. 26 is a perspective view of the chair, with portions of the chair exploded away and omitted to show features of a multi-positional armrest of the chair.

FIG. 27 a front view of the chair with portions of the chair omitted to show features of the armrests of the chair, wherein the armrests are in a lowered position.

FIG. 28 is a partially cut away, partially exploded side view of the chair with the armrests in the lowered position.

FIG. 29 is a partially cut away, partially exploded side view of the chair with the armrests in a raised position.

FIG. 30 is a partially cut away, partially exploded side view of the chair with the armrests raised in the rear and, thereby, tilted forward.

FIG. 31 is a partially cut away, partially exploded side view of the chair with the armrests raised in the front and, thereby, tilted rearward.

FIG. 32 a front view of the chair with portions of the chair omitted, wherein the armrests are in a raised position.

FIG. 33 is a perspective view of the chair, with a self-extending footrest of the chair in its retracted, lowered configuration.

FIG. 34 is a perspective view of the chair, with the footrest in its extended, upper configuration.

FIG. 35 is a side view of the chair, with the footrest in its retracted, lowered configuration.

FIG. 36 is a side view of the chair, with the footrest in its intermediate configuration.

FIG. 37 is a side view of the chair, with the footrest in its extended, upper configuration.

FIG. 38 is a front perspective view of the chair in a deep upright position.

FIG. 39 is a side view of the chair in a first short-depth upright position.

FIG. 40 is a side view of the chair in a second short-depth upright position.

FIG. 41 is a side view of the chair with a reclined backrest.

FIG. 42 is a side view of the chair with a reclined backrest and extended footrest.

FIG. 43 is a side view of the chair near a zero gravity position.

FIG. 44 is a side view of the chair in a lift seat position.

DETAILED DESCRIPTION

Figure 1:
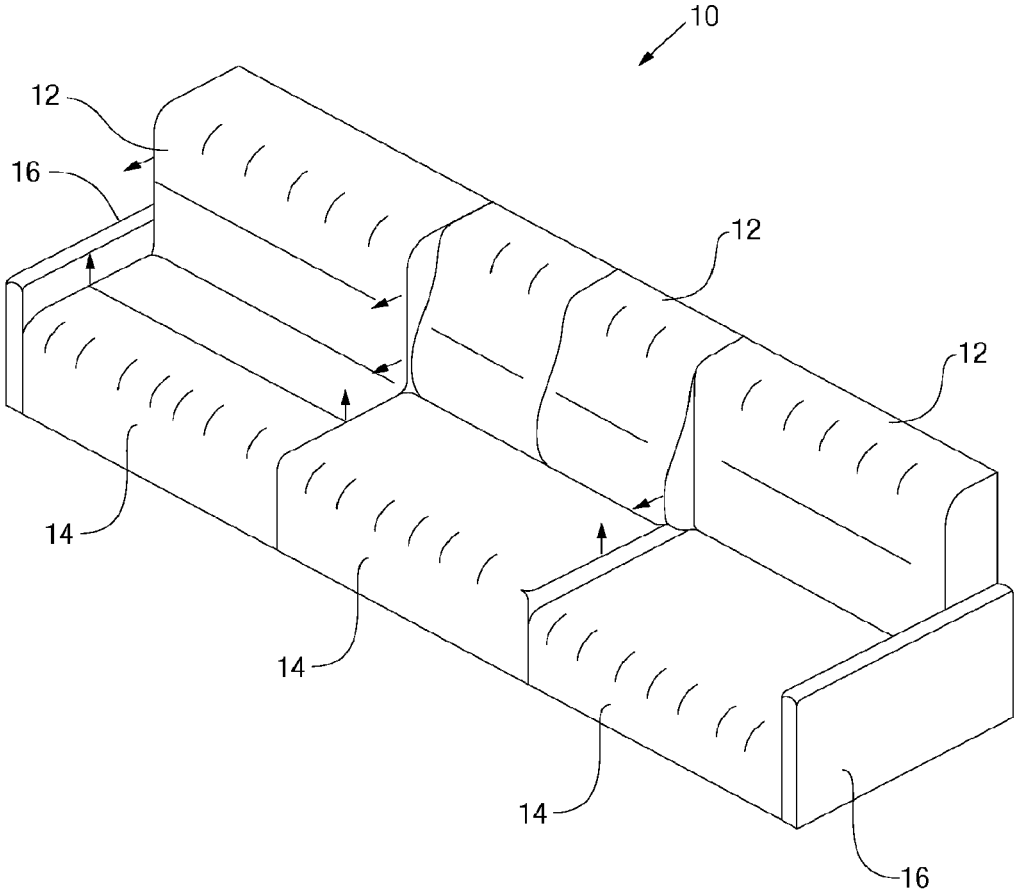
FIGS. 1-9 illustrate a first embodiment of this disclosure, and arrows therein that are not associated with reference numerals are schematically illustrative of movement of respective features of a couch of the first embodiment.

Exemplary embodiments of this disclosure are described below and illustrated in the accompanying figures, in which like reference numerals may refer to like parts throughout the several views. The embodiments described provide examples and should not be interpreted as limiting the scope of the invention, which, of course, is limited only by the claims below. Other embodiments, and modifications and improvements of the described embodiments, will occur to those skilled in the art and all such other embodiments, modifications and improvements are within the scope of the present invention.

Referring now in greater detail to the drawings, a first embodiment of this disclosure is described in the following, with reference to FIGS. 1-9. In accordance with the first embodiment, a seating device in the form of a couch 10 is shown in FIG. 1. The couch 10 includes backrests 12 respectively extending upwardly from proximate rear edges of seat platforms 14, and armrests 16 at opposite ends of the couch.

FIG. 1 schematically illustrates the couch 10 with at least some of its upholstery installed. More specifically, the couch 10 is shown in FIG. 1 with all of, or at least a substantial portion of, its upholstery installed. Accordingly, the couch 10 may be characterized as being fully upholstered.

The upholstery of the couch 10 may include one or more coverings that cover cushions or other cushioning features of the upholstery. The coverings may be in the form of or include elastic fabric, elastic fabric sewn in an accordion style, as well as other coverings structures that are currently available for covering any opening created when adjustment mechanisms of the couch are retracted or extended, as will be discussed in greater detail below. Suitable fabrics for the coverings can include, but are not limited to, leather, cloth, and synthetic coverings. The cushions or other cushioning features may be of any suitable type that is conventionally used in seating devices. Notwithstanding, this disclosure is not limited to fully or partially upholstered seating devices (e.g., the upholstery is optional and may be omitted), and at least some of the upholstery of the couch 10 is omitted from FIGS. 2-9.

The backrests 12, seat platforms 14 and armrests 16 may be characterized as including and/or not including the upholstery that is optionally associated therewith, such as by being mounted thereto. Accordingly, in this detailed description section of this disclosure and its associated drawings, the same reference numerals may be used to identify backrests 12, seat platforms 14 and armrests 16 both with and without their upholstery.

Figure 2:
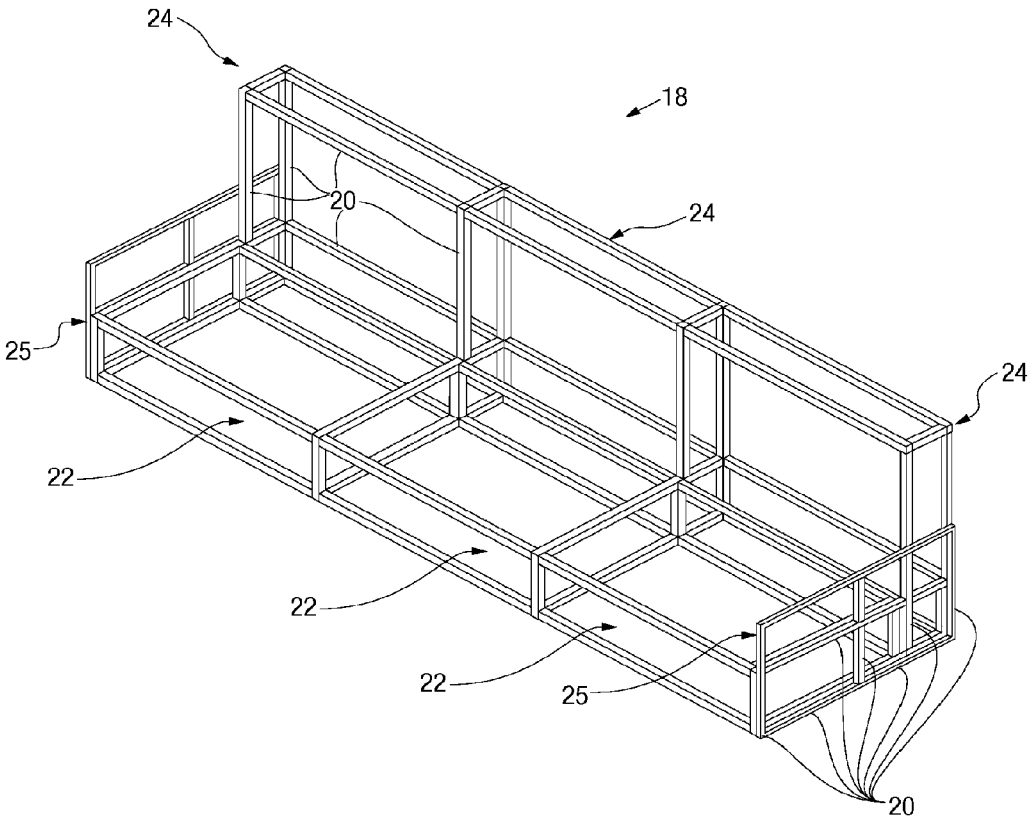

As shown in FIG. 2, the couch 10 includes an overall frame 18 consisting essentially of frame members 20 that are respectively fixedly connected to one another. The overall frame 18 includes a series of lower, rear and armrest subframes 22, 24, 25 that each included respective ones of the frame members 20 that are respectively fixedly connected to one another. The lower and rear subframes 22, 24 may be referred to as seat and backrest frames or subframes.

The overall frame 18 may be in any suitable configuration. In one example, the overall frame 18 may be a conventional frame. The overall frame 18, like many other parts of the couch 10, may be constructed of steel, aluminum, wood, plastic, alloy materials and/or any other suitable materials selected to achieve the desired strength, weight, costs, rigidity and/or range of movement.

Referring to FIGS. 1 and 2, the overall frame 18 supports, for example, the seat platforms 14 and the backrests 12. More specifically, the seat platforms 14 are respectively movably mounted to the lower subframes 22 so that the seat platforms may be at the same or different heights, and at the same or different inclinations (relative to horizontal), in relation to the overall frame 18, as will be discussed in greater detail below. Similarly, the backrests 12 are respectively movably mounted to the rear subframes 24 so that the backrests may be at the same or different inclinations (relative to vertical) in relation to the overall frame 18, and the backrests may be at the same or different depths in relation to the fronts of the seat platforms 14.

Figure 3:
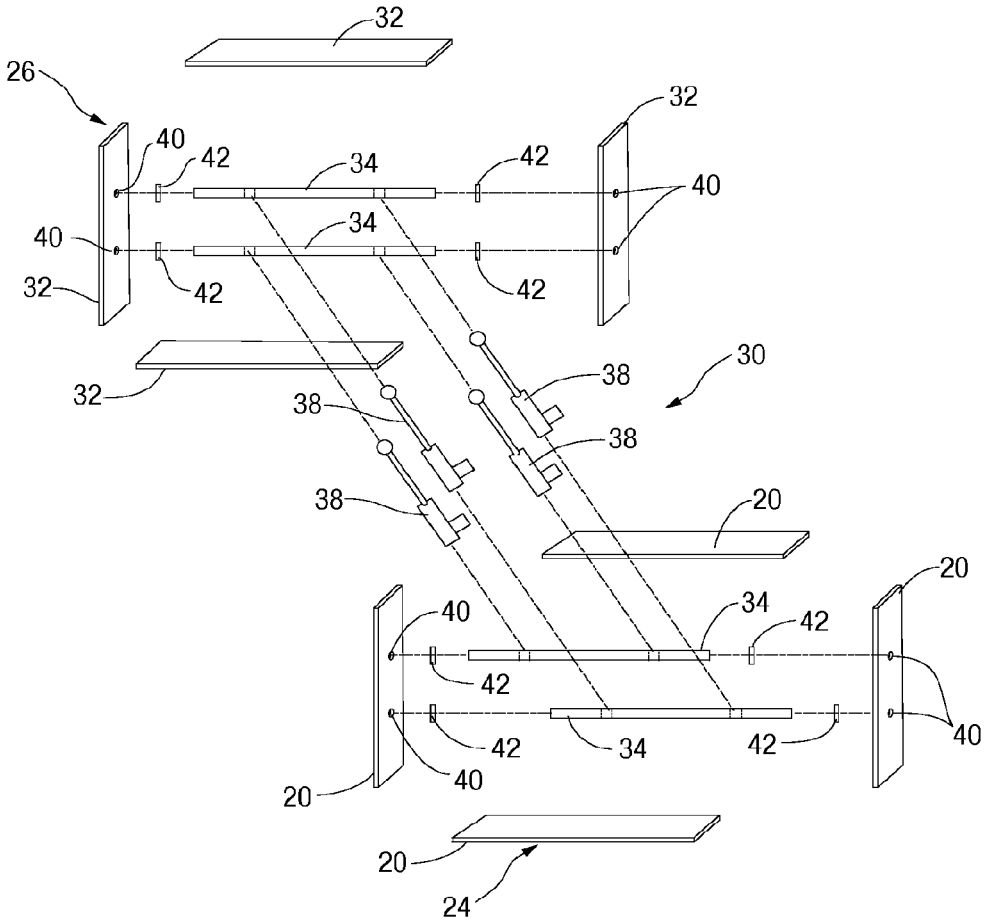
Figure 4:
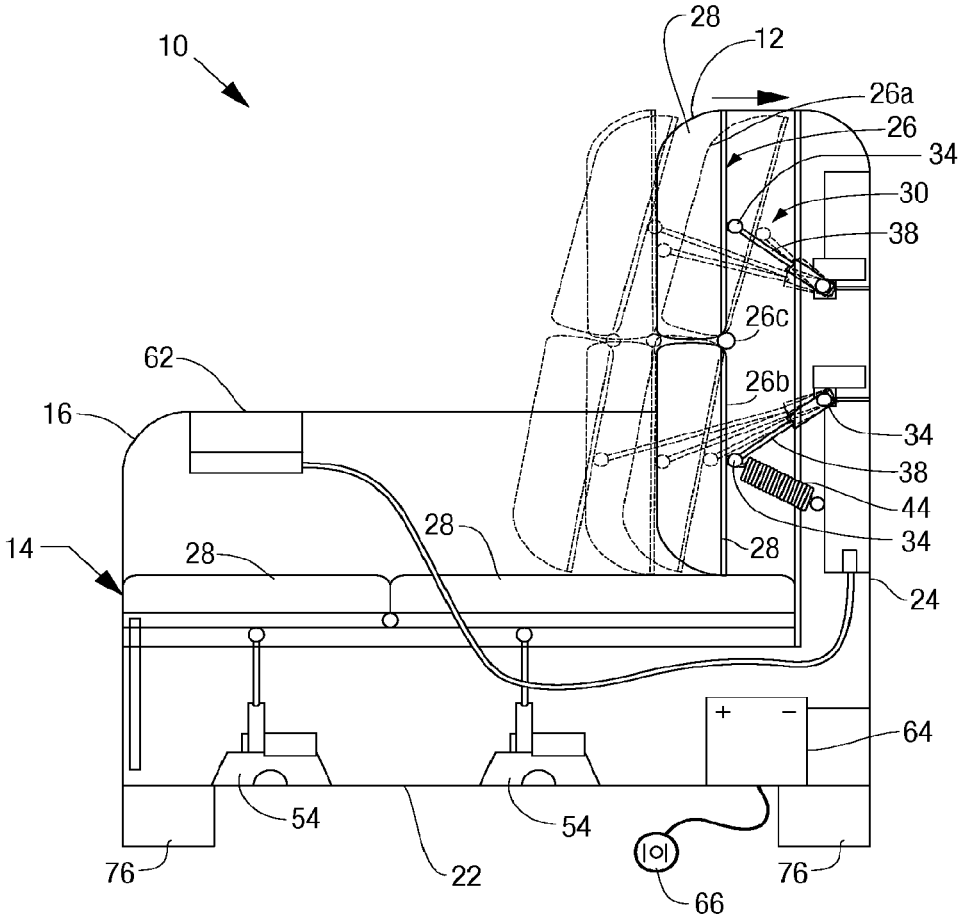

Referring primarily to FIG. 3, and also to FIG. 4, each of the backrests 12 includes a movably mounted backrest cushion support 26 having one or more cushions 28 of the upholstery mounted thereto for moving therewith, and each of the backrests is movably connected to a dedicated, powered backrest adjustment mechanism 30 that is capable of independently adjusting the position of the backrest. The backrest cushion support 26 may be more generally referred to as a portion of the backrest, or a backrest frame or subframe, and the backrest cushion support may alternatively be in the form of a backrest shell, which may or may not be upholstered.

Each of the backrests 12 is similar to one another. Accordingly, in the following, a representative one of the backrest cushion supports 26, and a respective backrest adjustment mechanism 30 by which the backrest cushion support is movably mounted to the respective rear subframe 24, are discussed. In FIG. 3, the backrest cushion support 26, backrest adjustment mechanism 30 and rear subframe 24 are exploded.

The rear subframe 24 may include a group of the frame members 20 that are respectively connected to one another so that the rear subframe is or includes a rectangular frame. Similarly, the backrest cushion support 26 may include frame members 32 that are respectively connected to one another so that the backrest cushion support is or includes a rectangular frame.

The backrest adjustment mechanism 30 includes a pair of cross members, namely backrest shafts 34, having opposite ends respectively mounted at the opposite sides of the backrest cushion support 26; and a pair of cross members, namely backrest shafts 34, having opposite ends respectively mounted at the opposite sides of the rear subframe 24. The backrest shafts 34 mounted to the backrest cushion support 26 may be referred to as the backrest shafts of the backrest cushion support. Similarly, the backrest shafts 34 mounted to the rear subframe 24 may be referred to as the backrest shafts of the rear subframe.

The backrest adjustment mechanism 30 further includes a pair of laterally spaced apart upper backrest actuators 38, each having opposite ends respectively mounted to the upper backrest shaft 34 of the backrest cushion support 26 and the upper backrest shaft of the rear subframe 24. Similarly, the backrest adjustment mechanism 30 further includes a pair of laterally spaced apart lower backrest actuators 38, each having opposite ends respectively mounted to the lower backrest shaft 34 of the backrest cushion support 26 and the lower backrest shaft of the rear subframe 24.

The components of the backrest adjustment mechanism 30 are mounted for facilitating at least the herein described movements of the backrest 12/backrest cushion support 26. For example, the backrest adjustment mechanism 30 is configured for allowing the backrest cushion support 26 to travel against the upper surface of the seat platform 14 at a plurality of angles and heights. As a more specific example of the mounting of components of the backrest adjustment mechanism 30, for each of the backrest shafts 34, its opposite ends may be mounted for rotating about the elongate axis of the backrest shaft.

The backrest shafts 34 may be respectively mounted to the rear subframe 24 and backrest cushion support 26 in any suitable manner, such as with mounting brackets, bearings, or the like. As more specific examples, the ends of the backrest shafts 34 may respectively pass through, or otherwise be associated with, holes 40 in the sides of the rear subframe 24 and holes 40 in the sides of the backrest cushion support 26. The holes 40 may be countersunk, and any suitable fasteners, flanges or the like may be associated with the backrest shafts 34 so that they do not fall out of their respective holes. For example, any suitable stopping or arresting devices may be used for each backrest shaft 34, such as clamps, or permanent attachment or fastening devices such as nails, screws, welding or glue, that may be attached directly to the backrest shaft 34, to keep the backrest shaft from slipping out of its respective hole 40. The diameters of the holes 40 may be large enough to allow for relative rotation between the backrest shafts 34 and the rear subframe 24 and backrest cushion support 26, respectively. The holes 40 would typically not be oversized in a manner that may allow excess side to side movement thereby reducing the stability of the overall backrest cushion support 26, or other mechanisms may be provided for restricting any undesired side to side movement.

For each of the backrest actuators 38, each of its opposite ends may be mounted for rotating about the elongate axis of the backrest shaft 34 to which it is mounted. In accordance with the first embodiment, the backrest actuators 38 are at least schematically shown in the drawings as being electric, motor-operated, linear actuators, although they may be replaced with any other suitable actuators, as discussed in greater detail below. More specifically described, each backrest actuator 38 is attached to the backrest cushion support 26 and rear subframe 24, by way of the respective backrest shafts 34, so that the backrest actuator may swivel at each of its opposite ends. Any suitable devices may be used for facilitating this swiveling, such as, but not limited to, a ball and socket type of swiveling device. The backrest actuators 38 may be retracted or extended to change the angle between the backrest 12/backrest cushion support 26 and the rear subframe 24 and/or to change the depth of the backrest 12/backrest cushion support 26 with respect to the front of the seat platform 14.

The positions of the backrest shafts 34 and/or backrest actuators 38 may be varied to accommodate the desired travel, stability and strength of the backrest adjustment mechanism 30. Optionally, washers, bushings and/or bearings 42 may be included at the points where the backrest actuators 38 are attached to the backrest shafts 34 and/or where the backrest shafts are attached to the rear subframe 24 and backrest cushion support 26.

In accordance with the first embodiment, the backrest shafts 34 and backrest actuators 38 are configured for supporting the backrest 12/backrest cushion support 26 in a manner that seeks to avoid any undesired twisting or slipping. This may comprise the opposite ends of the backrest actuators 38 being sufficiently wide to add stability, and the diameter of each backrest shaft 34 varying along its length. For example, at the location where each backrest actuator 38 is connected to a backrest shaft 34, the backrest shaft may have a first section with a first diameter, and the first section may be positioned between second and third sections of the backrest shaft that each have a second diameter that is larger than the first diameter, in order to restrict side-to-side movement. Alternatively, this variation in diameter may be provided in any suitable manner. For example, any suitable stopping or arresting devices may be used for each backrest shaft 34, such as flanges, clamps, or permanent attachment or fastening devices such as nails, screws, welding or glue, that may be attached directly to the backrest shaft 34, to restrict the backrest actuators 38 from sliding along the length of the backrest shafts.

Referring to FIG. 4 and in accordance with the first embodiment, the backrest adjustment mechanism 30 may include at least one spring 44, or other biasing mechanisms, configured for seeking to keep the bottom end of the backrest 12 in contact with the upper surface of the seat platform 14. As shown in FIG. 4, one end of the spring 44 is attached to a lower portion of the rear subframe 24, and the opposite end of the 44 is attached to the lowest backrest shaft 34 of the backrest cushion support 26 at a position between where the lower backrest actuators 38 are attached to the lowest backrest shaft 34 of the backrest cushion support. Other spring arrangements may be used. Alternatively, in some situations the spring 44 may be omitted, such as when the weight of the backrest 12 alone would be sufficient for reasonably keeping the bottom end of the backrest in contact with the upper surface of the seat platform 14.

In FIG. 4, the seat platform 14 is shown in its retracted, horizontal position. In addition, the backrest 12 is shown, in solid lines, as being in its retracted, vertical position. FIG. 4 is schematic because, for example, it includes dashed lines illustrating the backrest 12 in a few examples of its other positions that may be achieved by operating the backrest adjustment mechanism 30 by way of respective backrest actuators 38. FIG. 4 at least partially shows a possible range of movement made available by operating the backrest actuators 38.

As shown in FIG. 4, the backrest cushion support 26 may optionally include upper and lower sections 26*a*, 26*b* that are pivotably connected to one another by at least one hinge 26*c* that is interposed between the sections 26*a*, 26*b* of the backrest cushion support 26. For example, the hinge 26*c* may include upper and lower wings that are pivotably connected to one another by way of a hinge pin positioned in a barrel assembly, the upper wing may be mounted to the lower edge of the upper section 26*a* of the backrest cushion support 26, and the lower wing may be mounted to the upper edge of the lower section 26*b* of the backrest cushion support 26. Accordingly, the backrest adjustment mechanism 30 may be operated by way of one or more respective backrest actuators 38 to change the angle defined between the sections 26*a*, 26*b* of the backrest cushion support 26. In one example, any allowed changes in the angle defined between the sections 26*a*, 26*b* may be restricted in a manner that seeks to prevent the backrest cushion support 26 from being placed in any potentially dangerous, or otherwise undesired, configurations. The hinges 26*c* may be replaced with any other suitable pivotable connections and/or any upholstery of the couch 10 may serve to serve to partially or substantially pivotably connect adjacent sections of the backrest cushion support 26.

Figure 5:
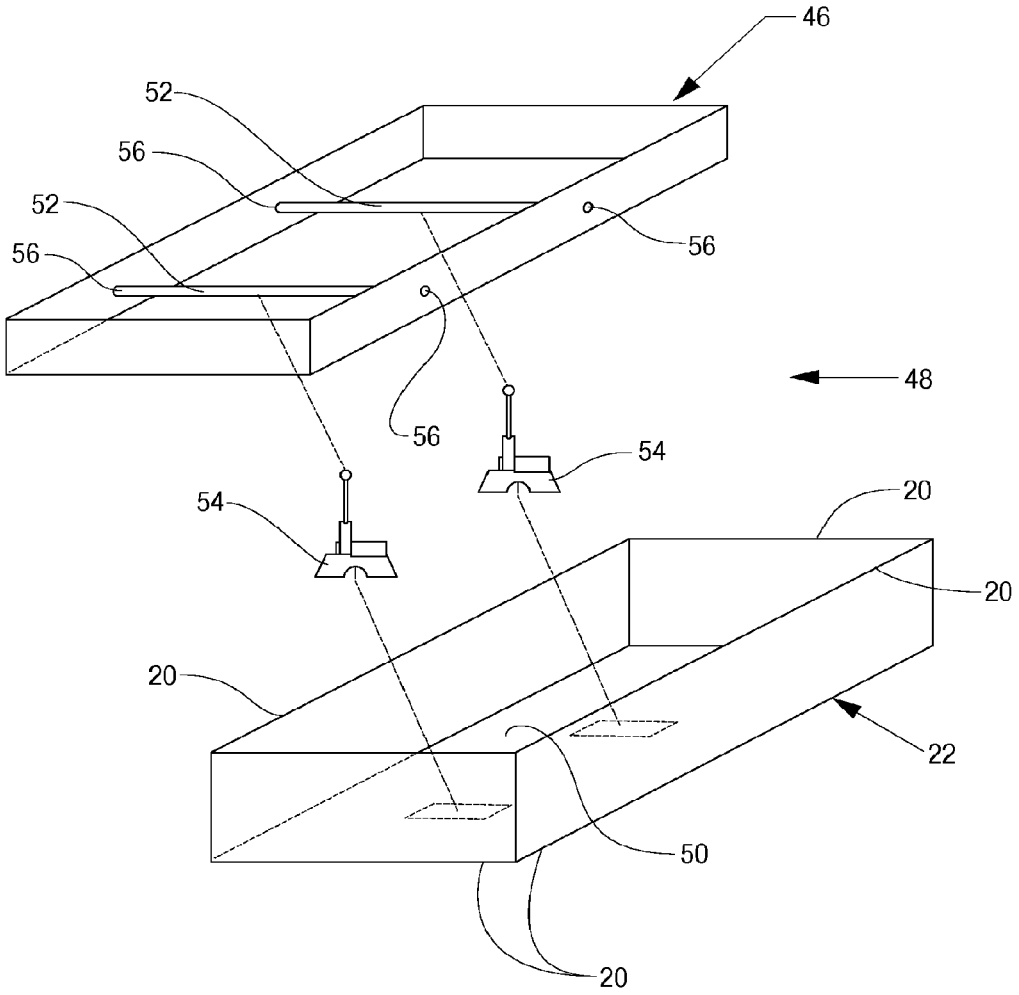
Figure 6:
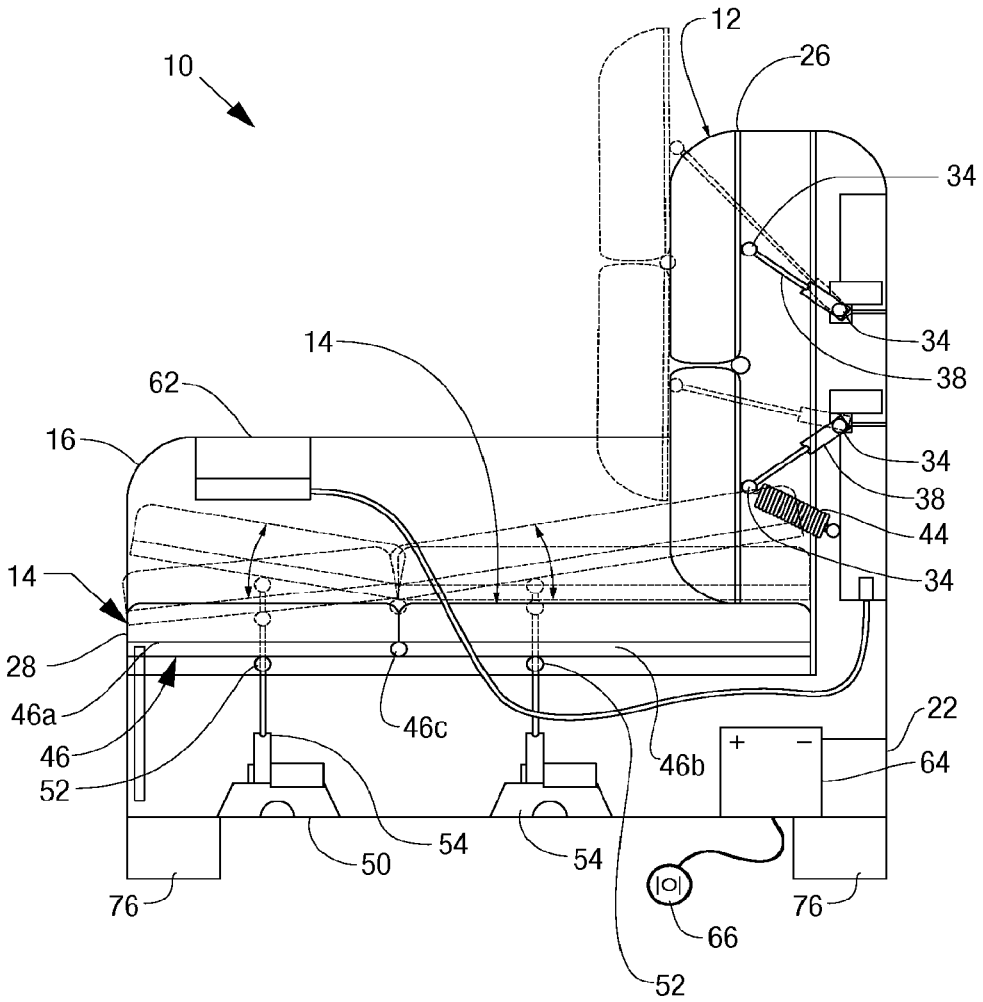

Referring primarily to FIG. 5, and also to FIG. 6, each of the seat platforms 14 includes a movably mounted seat cushion support 46. One or more cushions 28 of the upholstery are mounted to and move with the seat cushion support 46. Each of the seat cushion supports 46 is movably connected to a dedicated, powered seat adjustment mechanism 48 that is capable of independent adjusting the position of the seat cushion support. The seat cushion support 46 may be more generally referred to as a portion of the seat platform 14, or a seat frame or subframe, and the seat cushion support may alternatively be in the form of a seat shell, which may or may not be upholstered.

In the following, a representative one of the seat cushion supports 46, and a respective seat adjustment mechanism 48 by which the seat cushion support is movably mounted to the respective lower subframe 22, are discussed. In FIG. 5, the seat cushion support 46, seat adjustment mechanism 48 and lower subframe 22 are partially exploded away from one another.

The lower subframe 22 may include frame members 20 that are respectively connected to one another so that the rear subframe is in the form of a box with a base structure 50 that may be in the form of a lower wall, or so that the lower subframe includes a rectangular frame and lateral extending frame members that extend across the lower end or opening of the rectangular frame to form the base structure. Similarly, the seat cushion support 46 may include frame members that are respectively connected to one another so that the seat cushion support is or includes a rectangular frame.

The seat adjustment mechanism 48 includes a pair of cross members, namely seat shafts 52, having opposite ends respectively mounted at the opposite sides of the seat cushion support 46. The seat shafts 52 mounted to the seat cushion support 46 may be referred to as the seat shafts of the seat cushion support. The seat adjustment mechanism 48 further includes a pair of spaced apart seat actuators 54, each having opposite ends respectively mounted to the base structure 50 and a respective one of the seat shafts 52.

The components of the seat adjustment mechanism 48 are mounted for facilitating at least the herein described movements of the seat platform 14/seat cushion support 46. For example, for each of the seat shafts 52, its opposite ends may be mounted for rotating about the elongate axis of the seat shaft. The seat shafts 52 may be mounted to the seat cushion support 46 in any suitable manner, such as with mounting brackets, bearings, or the like. As more specific examples, the ends of the seat shafts 52 may respectively pass through, or otherwise be associated with, holes 56 in the sides of the seat cushion support 46. As more specific examples, the above disclosure about the holes 40 (FIG. 3) and the mounting of the backrest shafts 34 (FIGS. 3 and 4) may apply to the holes 56 and the mounting of the seat shafts 52, except for variations noted and variations that will be apparent to one of ordinary skill in the art.

In accordance with the first embodiment, the seat actuators 54 are at least schematically shown in the drawings as being electric, motor-operated, linear actuators, although they may be replaced with any other suitable actuators, as discussed in greater detail below. For each of the seat actuators 54, its upper end may be mounted for rotating about the elongate axis of the seat shaft 52 to which it is mounted. As more specific examples, the above disclosure about the mounting of the backrest actuators 38 (FIGS. 3 and 4) to the backrest shafts 34 (FIGS. 3 and 4) may apply to the seat actuators 54 and the seat shafts 52, except for variations noted and variations that will be apparent to one of ordinary skill in the art. At least somewhat similarly and according to one version of the first embodiment, for each of the seat actuators 54, its lower end may be mounted to the base structure 50, or otherwise configured, for pivoting about an axis that extends parallel to, or substantially parallel to, the elongate axes of the seat shafts 52. For example, the base structure 50 may alternatively be in the form of a pair of shafts like, or similar to, the seat shafts 52.

In accordance with another version of the first embodiment, for each of the seat actuators 54, its lower end may be fixedly mounted to the base structure 50, such as by way of a permanent, stable platform that is for increasing strength and stability. In this version, the lower end of the seat actuators 54 may not need to swivel, or may only swivel to a limited extent, because the seat platform 14 does not need to adjust in relation to the backrest cushion support 26. In contrast, the backrest cushion support 26 is configured for adjusting in relation to the angle and height of the seat platform 14.

The seat actuators 54 may be retracted or extended to change the angle between the seat platform 14/seat cushion support 46 and the lower subframe 22 and/or to change the height of the seat platform 14/seat cushion support 46. The positions of the seat shafts 52 and/or seat actuators 54 may be varied to accommodate the desired travel, stability and strength of the seat adjustment mechanism 48. In accordance with the first embodiment, the seat shafts 52 and seat actuators 54 are configured for supporting the seat platform 14/seat cushion support 46 in a manner that seeks to avoid any undesired twisting or slipping. In this regard, the above disclosure about the backrest actuators 38 (FIGS. 3 and 4) and backrest shafts 34 (FIGS. 3 and 4) being configured for seeking to avoid any undesired twisting or slipping may apply to the seat actuators 54 and the seat shafts 52, except for variations noted and variations that will be apparent to one of ordinary skill in the art.

Figure 7:
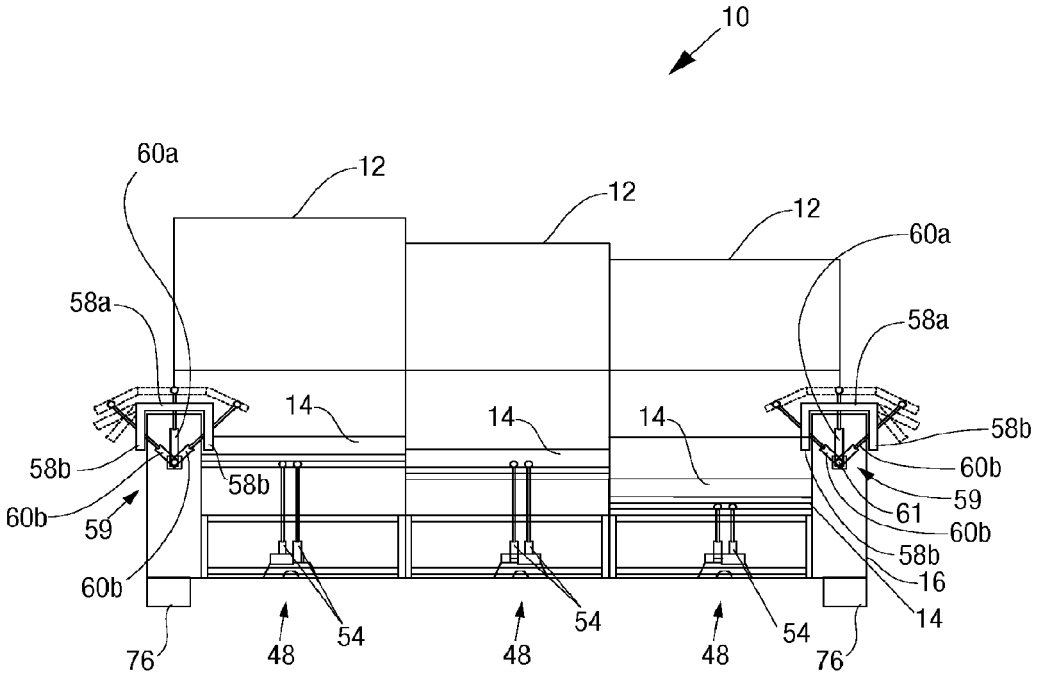

In FIG. 6, the seat platform 14 is shown, in solid lines, in its retracted, horizontal position. In addition, the backrest 12 is shown, in solid lines, as being in its retracted, vertical position. FIG. 6 is schematic because, for example, it includes dashed lines illustrating the seat platform 14 in examples of its other positions that may be achieved by operating the seat adjustment mechanism 48 by way of respective seat actuators 54; and it includes dashed lines illustrating the backrest 12 riding up with the seat platform 14 in response to the seat platform being elevated. FIG. 6 at least partially shows a possible range of movement made available by operating the seat actuators 54. FIG. 7 shows each of the seat platforms 14 positioned at different heights in response to respective operation of the seat adjustment mechanisms 48 by way of their actuators 54, and that each of the backrests 12 have respectively, responsively ridden up with/been pushed upwardly by the upper surface of the seat platform 14 in response to the seat platform being elevated, and that the springs 44 (FIGS. 4 and 6) have kept the bottom ends of the backrests 12 in contact with the upper surfaces of the respective seat platforms 14.

As shown in FIG. 6, the seat cushion support 46 may include front and rear sections 46*a*, 46*b* that are pivotably connected to one another by at least one hinge 46*c* that is interposed between the sections 46*a*, 46*b* of the seat cushion support 46. For example, the hinge 46*c* may include front and rear wings that are pivotably connected to one another by way of a hinge pin positioned in a barrel assembly, the front wing may be mounted to the rear edge of the front section 46*a* of the seat cushion support 46, and the rear wing may be mounted to the front edge of the rear section 46*b* of the seat cushion support 46. Accordingly, the seat adjustment mechanism 48 may be operated by way of respective seat actuators 54 to change the angle defined between the sections 46*a*, 46*b* of the seat cushion support 46. In one example, any allowed changes in the angle defined between the sections 46*a*, 46*b* may be restricted in a manner that seeks to prevent the seat cushion support 46 from being placed in any potentially dangerous, or otherwise undesired, configurations. The hinges 46*c* may be replaced with any other suitable pivotable connections and/or any upholstery of the couch 10 may serve to serve to partially or substantially pivotably connect adjacent sections of the seat cushion support 46.

Referring to FIG. 7 and in accordance with the first embodiment, the armrests 16, include intermediate and side armrest cushion supports 58*a*, 58*b* that are supported by the armrest subframes 25 (FIG. 2). The armrest cushion supports 58*a*, 58*b* may be more generally referred to as armrest portions or frames, and the armrest cushion supports may alternatively be in the form of shells, which may or may not be upholstered.

For each armrest 16, the side armrest cushion supports 58*b* have inner edges that are respectively pivotably connected to the opposite sides of the intermediate armrest cushion support 58*a* by way of hinges, or in any other suitable manner. For example, any upholstery of the couch 10 may optionally serve to partially or substantially pivotably connect adjacent armrest cushion supports. Intermediate and side armrest actuators 60*a*, 60*b* are respectively connected between the armrest subframes 25 and the intermediate and side armrest cushion supports 58*a*, 58*b* to adjust the height and/or inclination of the armrest cushion supports, as schematically shown with dashed lines in FIG. 7.

For each armrest 16, the armrest actuators 60*a*, 60*b* connected between the armrest subframe 25 and the armrest cushion supports 58*a*, 50*b* may be electric, motor-operated, linear actuators, although they may be replaced with any other suitable actuators, as discussed in greater detail below. In accordance with the first embodiment, the opposite ends of each armrest actuator 60*a* may be fixedly (e.g., nonpivotably) attached to the respective armrest subframe 25 and armrest cushion support 58*a*, such as by way of permanent, stable platforms. In contrast, the opposite ends of each armrest actuator 60*b* may be pivotably attached to the respective armrest subframe 25 and armrest cushion support 58*b*, such as by way of shafts, in a manner similar to that in which the backrest actuators 38 (FIGS. 3 and 4) are mounted by way of the backrest shafts 34 (FIGS. 3 and 4). More specifically and for each armrest 16, a powered armrest adjustment mechanism 59 may include the armrest actuators 60*a*, 60*b* respectively connected between an armrest shaft 61 having opposite ends fixedly mounted to the armrest subframe 25, and armrest shafts respectively mounted to the armrest cushion supports 58*a*, 50*b*.

In the foregoing, it has been disclosed that each of the actuators 38, 54, 60*a*, 60*b* may be linear actuators, and more specifically they may be electrically operated linear actuators, but such linear actuators have been identified for the purpose of providing an example, and not for the purpose of limiting the scope of this disclosure, because other types of actuators may be used. For example, suitable actuators may be selected based on factors such as strength, desired travel, cleanliness, cost, ease of assembly, stability, durability as well as other factors. Other suitable actuators may be hydraulic, gear driven or pneumatic, or they may include pulleys, cams, worm gears, levers, scissor-like action levers such as those used on attached footrests, notched bars, springs, or they may work using magnetic force, or they may be in the form of any other suitable mechanical or electronic devices which may be used to move the seat platforms 14, backrests 12, or armrest cushion supports 58*a*, 58*b*. The actuators 38, 54, 60*a*, 60*b* are primarily used to adjust the distance and angular relationships of the armrest cushion support 58*a*, 58*b*, backrest cushion supports 26, and seat cushion supports 46 in relation to the overall frame 18.

In accordance with one aspect of this disclosure and generally described, the powered adjustment mechanisms 30, 48, 59 include features for pushing and pulling the backrest cushion support 26, seat cushion supports 46 and armrest cushion support 58*a*, 50*b*, respectively. However, this disclosure is not limited to the above-disclosed adjustment mechanisms 30, 48, 59. For example, any suitable adjustment mechanism and/or actuator may be used to obtain the desired positioning. For example, one or more of the backrest cushion supports 26, seat cushion supports 46 and armrest cushion support 58*a*, 50*b* may alternatively be configured for sliding upon rails, or the like. Each of the actuators 38, 54, 60*a*, 60*b* in isolate may be a conventional electronic actuator configured for locking in place when not being operated. Throughout this disclosure, any suitable actuators may be used, and they will typically be of the type that locks in place when not being operated.

Inclusion of one or more of the above-discussed features for allowing pivoting of one or more of the actuators 38, 54, 60*a*, 60*b* may allow the actuators to move the armrest cushion support 58*a*, 58*b*, backrest cushion supports 26 and/or seat cushion supports 46 in harmony with one another and may be particularly desirable when the seat cushion supports adjusts in height or angle. As another example of features operating in harmony, the armrest cushion support 58*a*, 58*b* may be adjusted in relation or response, for example, to the seat platform 14 height and angle, so that the armrest cushion supports do not impede travel of the seat platform 14 or the backrest 12.

Whereas harmonious operation of respective components may be controlled by a user manually operating one or more controllers, such as by way of buttons, dials, toggles or any other suitable user interface devices, for controlling operation of the actuators 38, 54, 60*a*, 60*b*, the harmonious operations may be automated by way of a suitable controller, as discussed in greater detail below.

In accordance with the first embodiment, the couch 10 includes at least one controller 62 (FIGS. 4 and 6) that is for controlling operation of each of the actuators 38, 54, 60*a*, 60*b*, such as by way of the controller being in wired or wireless communication with each of the actuators. The controller 62 includes a user interface for allowing a user of the couch 10 to interact with the controller in a manner that allows the user to at least partially control the operation of the actuators 38, 54, 60*a*, 60*b* by way of the controller. As at least schematically shown in FIGS. 4 and 6, the controller 62 may be mounted to the armrest 16 or to one of the armrest cushion supports 58*a*, 58*b* (FIG. 7) so as to be readily accessible to the user of the couch 10. Alternatively, the controller 62 may be mounted in any other suitable location, or it may be unmounted or mounted remotely from the couch 10 so that it functions as a remote controller.

In one example, the controller 62 may include electronic switches which respectively control the actuators 38, 54, 60*a*, 60*b*. The wiring and control switches of the controller 62 can include, but are not limited to, toggle or rocker type switches, or can be more involved such as programmable computer circuits to accommodate desired features. Additional features which may be programmed into the controller 62 are, but are not limited to, stops, range of movement, limit switches, personal memory settings, default settings, remote control operations, and/or timed cycles for making automatic adjustments. For example, the controller may include programming for automatically controlling and/or coordinating operation of one or more of the actuators 38, 54, 60*a*, 60*b*, such as for causing one or more of the armrest cushion supports 58*a*, 58*b* to be adjust in relation to the seat platform 14 and/or backrest 12 so that the armrest cushion supports do not impede desired movement of the seat platform 14 and/or backrest 12.

As a more specific example, features of the controller 62 may be embodied in any suitable manner, such as in software, firmware and/or hardware modules. For example, the controller may be in the form of one or more computers (which may include appropriate input and output devices, a processor, memory, software modules, etc.) or any other suitable device (s) for controlling operations of the actuators 38, 54, 60*a*, 60*b* by virtue of receiving data from and providing data (e.g., instructions from the execution of software modules stored in memory) to respective actuators. As another specific example, the user interface of the controller 62 may be in the form of a touch-screen user interface. The touch-screen user interface may be associated with one or more software modules that are operative for causing the touch-screen user interface to display icons, and to be responsive to touches by a user, so that the user may control operation of the actuators 38, 54, 60*a*, 60*b* in a suitable manner.

In one example, the controller 62 may be programmed to provide a range of functionalities. As one example and as at least alluded to above, the springs 44 are configured for automatically keeping the bottom ends of the backrests 12 in contact with the upper surfaces of the respective seat platforms 14 in response to up or down movement of the seat platforms 14 caused by operation of the seat adjustment mechanisms 48 by way of their actuators 54. Alternatively, backrest adjustment mechanisms 30 and the controller 62 may be cooperatively configured for automatically keeping the bottom ends of the backrests 12 in contact with the upper surfaces of the respective seat platforms 14 in response to up or down movement of the seat platforms 14 without requiring the springs 44.

Electrical power may be provided to the controller 62 and the actuators 38, 54, 60*a*, 60*b* in any suitable manner. For example, alternating or direct current may be provided to the controller 62 and the actuators 38, 54, 60*a*, 60*b* by way of wires that extend from a power source 64 that includes a plug 66 to be connected to a commonly used household electrical wall socket or from a charging system included in a vehicle. The power source 64 may optionally incorporate one or more batteries that may be charged and may provide the electrical current. The battery power feature may be desirable in a case where the seating device (e.g., couch 10) is located away from a wall socket such as would be the case if the seating device were located in the middle of a large room. The power source 64 may also be or otherwise incorporate a manually actuatable system for allowing the user to control the actuators 38, 54, 60*a*, 60*b*. For example and generally described, at least in theory some of the features of the power source 64 and the controller 62 may be combined into a single unit. For example, the controller 62 may be in the form of a user-interface for receiving instructions from a user, with the user-interface being in wired or wireless communication with one or more computers (which may include appropriate input and output devices, a processor, memory, software modules, etc.) or any other suitable device(s) that are located with the power source 64, or in any other suitable location, for controlling operations of the actuators 38, 54, 60*a*, 60*b* by virtue of receiving data from and providing data (e.g., instructions from the execution of software modules stored in memory) to respective actuators.

Figure 8:
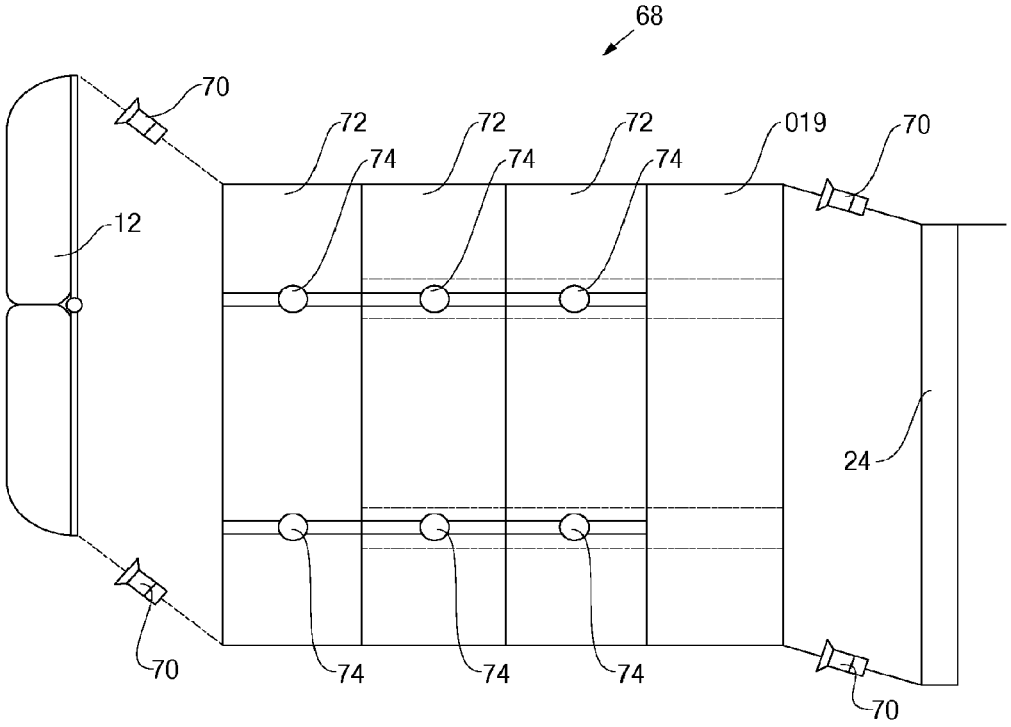
Figure 9:
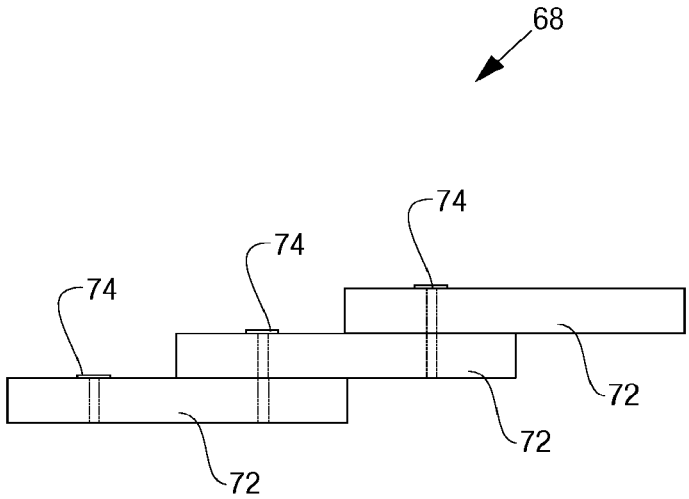
Figure 10:
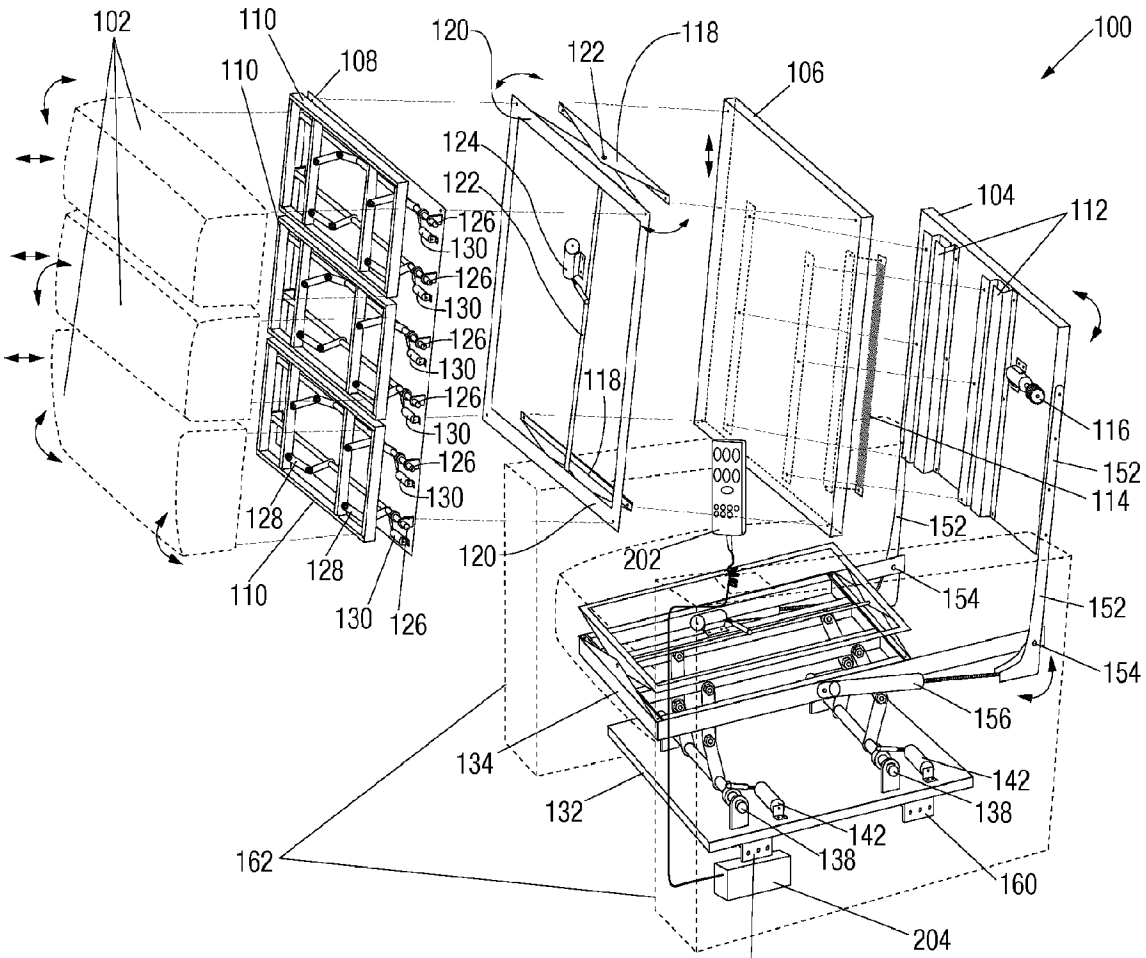
FIGS. 10-37 illustrate a second embodiment of this disclosure, and arrows therein that are not associated with reference numerals are schematically illustrative of movement of respective features of a chair of the second embodiment.
Figure 11:
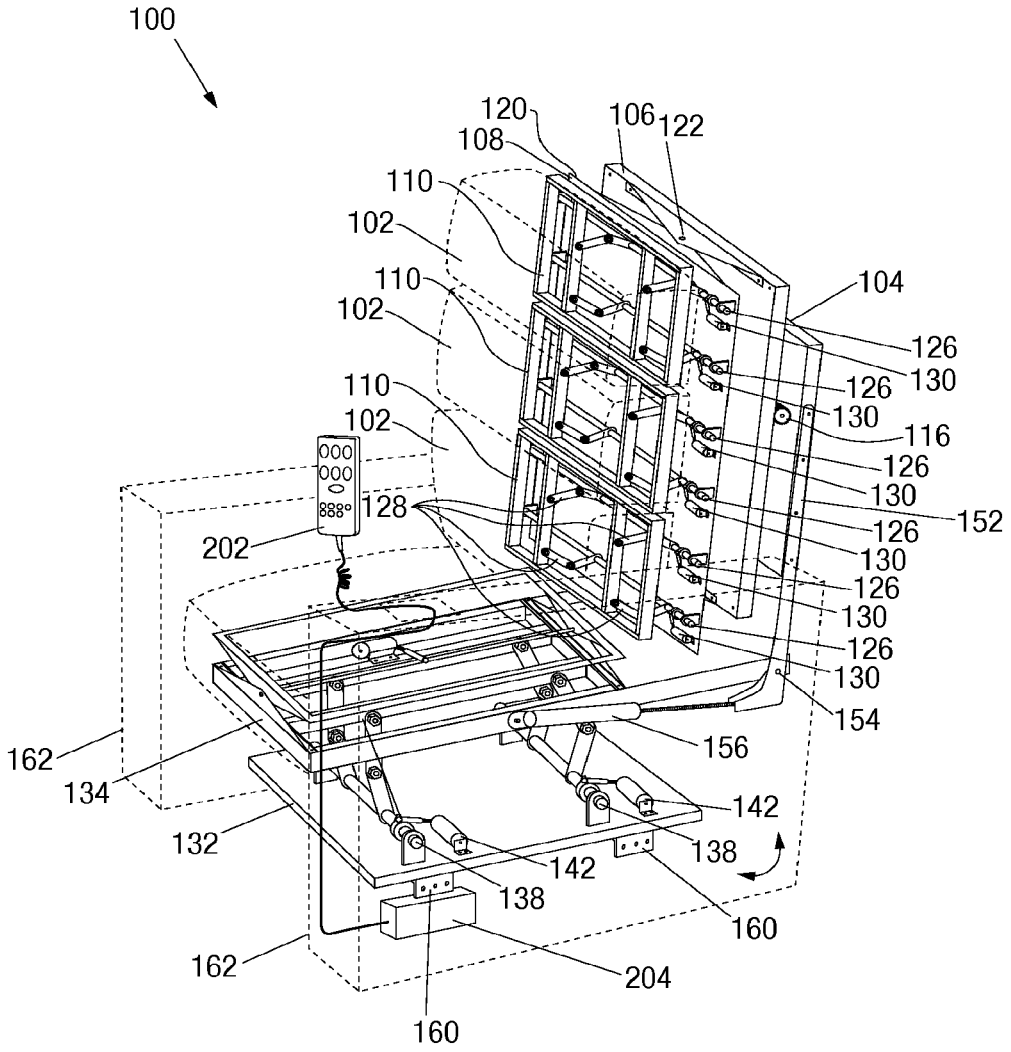
Figure 12:
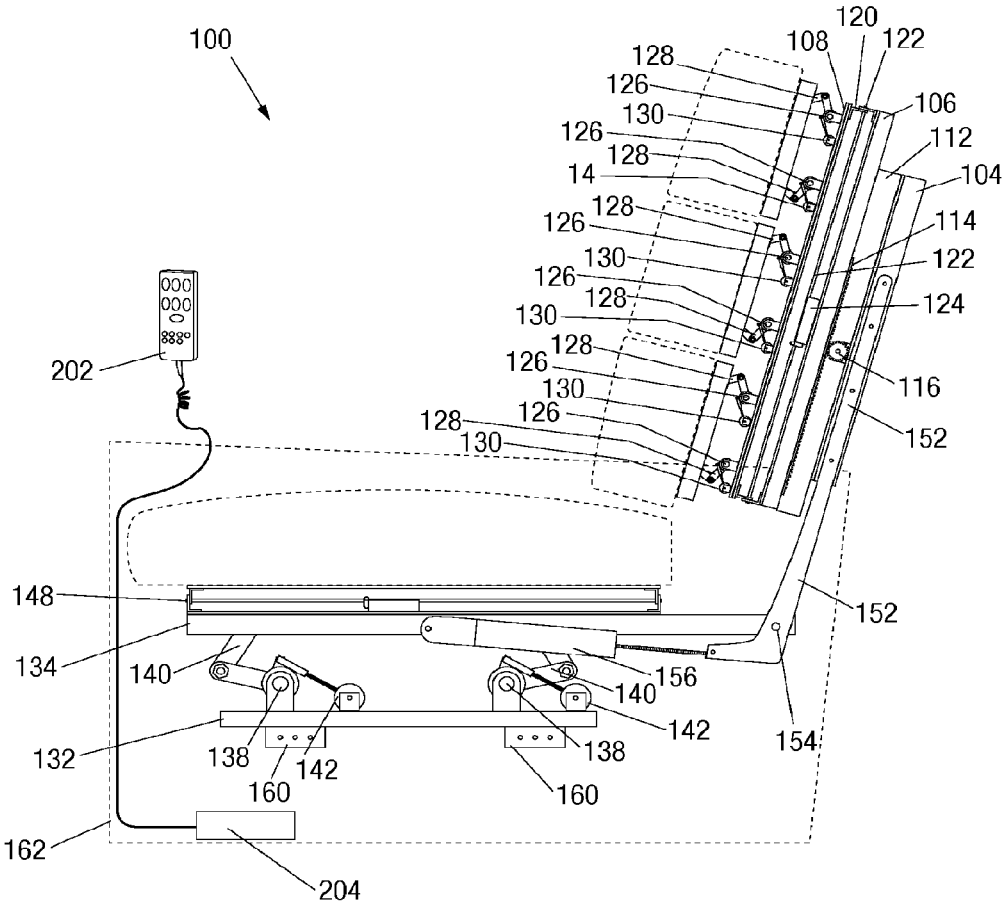

In accordance with the first embodiment, the couch 10 may include one or more expandable guards, and/or other suitable safety features, for restricting access to moving parts in a manner that seeks to prevent injury. For example, it is conventional to include expandable guards on items with moving parts, and a variety of different types of conventional expandable guards may be incorporated into the couch 10. As one example of a suitable expandable guard for incorporating in to the couch 10, FIG. 8 shows an expandable guard 68 for restricting access to moving parts, wherein the expendable guard is shown exploded away from the backrest cushion support 26 and the rear subframe 24 to which the expandable guard is attached. The expandable guard 68 includes fasteners 70 for attaching opposite ends of the expandable guard 68 to the rear subframe 24 and the backrest cushion support 26.

The expandable guard 68 further includes plates 72 and fasteners 74. The fasteners 74 respectively slidingly attach the plates 72 to one another so that there can be back and forth relative sliding between the plates. In this regard, each of the fasteners 74 may pass through a hole in at least one plate 72, and the holes in the plates may be positioned so as to not allow the plates to pass beyond the edge of the other plates. The fasteners 74 may be of size and shape to allow the plates 72 to slide easily with respect to one another, and so that the fasteners 77 do not pull through the holes in the plates. The couch 10 can include expandable guards respectively attached between the lower subframes 22 and the seat platforms 14, expandable guards respectively attached between the rear subframes 24 and the backrest cushion supports 26, and expandable guards respectively attached between the armrest subframes 25 and the armrest cushion supports 58*a*, 58*b*, so that these expandable guards restrict access to the moving parts.

The expandable guards 68 are typically made of a material which is ridged enough to prevent penetration into, or contact with, the movable parts of the couch 10. The material from which the plates 72 are formed can be, but is not limited to, metal, plastic, wood, composite materials, or other suitable materials, and may be selected based on factors of safety, strength, cost, and operability.

The couch 10 may incorporate any suitable, desirable features that are conventionally included in seating devices. For example, legs, feet 76 (FIGS. 4, 6 and 7) or any other suitable bases may extend downwardly from the overall frame 18 for supporting the couch on a floor or other suitable surfaces.

Those of ordinary skill in the art will understand numerous operational aspects of the couch 10 in view of the foregoing. Notwithstanding, in the following, some additional examples of operational aspects of the couch 10 are disclosed for example and not for the purpose of limiting the scope of this disclosure, in accordance with the first embodiment.

In one aspect, the couch 10 may be operated by a user by way of the controller 62, either while the user is sitting upon the couch or not sitting upon the couch. Preferably (e.g., optionally) the individual or individuals (e.g., occupant or occupants) sitting upon the couch 10 will have access to the controller 62, such as for extending or retracting the seat platforms 14 to their desired height and angle so, depending on the range of movement provided, small children could sit with their backs against the backrests 12 and their feet planted firmly on the floor, or very tall individuals could sit with their knees at right angles to the floor instead of sitting with their knees close to their chest. Then the occupant or occupants could adjust the backrests 12 to the desired depth and angle in relation to the seat platforms 14 to accommodate their individual posture and height, and they could even retract the backrests all the way back to make enough space for multiple persons to lie down at once. The armrests 16 can be adjusted to accommodate each users comfort for the body part using the armrest. The users could increase the angle of one or more of the armrest cushion supports 58*b* to make it more comfortable for their arm, rest their legs while lying down, or rest their head while lying down. Depending on the range of movement provided, the armrest cushion supports 58*a*, 58*b* could be raised to a level that would elevate an injured arm or leg. The occupant could also raise a seat platform 14 on one end of the couch 10 and lie on the other two seat platforms and raise their legs to a point which relieves back pain or reduces dizziness. These features can be particularly useful to individuals who are less mobile. For example, less mobile individuals could raise the respective seat platform 14 and extend the respective backrest 12 so that the couch 10 is easier to stand up from.

Whereas the first embodiment of this disclosure has often been described in the context of a couch, the couch 10 may be more generally referred to as a seating device, and this disclosure applies to seating devices generally. For example and in accordance with one aspect of this disclosure, a "seating device" may be a couch (e.g., a sofa, love seat, or the like) a sofa bed, a chair (e.g., an easy chairs, a recliners, a vehicle seat) or any other suitable type of seating device, or the like. Moreover, one or more features of this disclosure may be used in seats on airplanes; seats in automobiles, either front or back seat; seats in heavy equipment including, but not limited to, graders, bulldozers, tractors, tractor-trailer cabs, excavators, dump trucks, forklifts, cranes; seats in space craft; seats in amusement park rides; seats in theaters; swings; or hot tubs. It is also possible to use features of this disclosure in tractor-trailer trailers or box trucks to prevent shifting loads. Features of this disclosure may also be useful in chairs and examination tables (examination tables often are used in the same fashion as chairs) in the medical field, particularly in physical therapy, burn units, and dialysis units.

As another example of a seating device, a chair 100 of a second embodiment of this disclosure is discussed in the following, with reference to FIGS. 10-37. The first and second embodiments of this disclosure may be alike, except for variations noted and variations that will be apparent to one of ordinary skill in the art. For example, the chair 100 may be upholstered, so that it includes cushions 102. The chair 100 is described in the following, in accordance with the second embodiment.

Referring to FIGS. 10-17, the chair 100 includes a multi-positional backrest having several parts or portions. For example, the backrest includes a backrest frame having one or more cushions 102 of the upholstery mounted thereto for moving therewith, although the upholstery may be omitted, as discussed above. The backrest frame includes a rearward backrest subframe 104, an intermediate backrest subframe 106, a forward backrest subframe 108, and backrest cushion supports 110. The backrest subframes 104, 106, 108 and backrest cushion supports 110 are respectively movably mounted to one another by way of powered backrest adjustment mechanisms for providing a variety of relative movements. The backrest adjustment mechanisms may include a powered rearward backrest adjustment mechanism, a powered intermediate backrest adjustment mechanism and powered forward backrest adjustment mechanisms, as will be discussed in greater detail below.

Each of the backrest subframes 104, 106, 108 may be more generally referred to as a frame or a portion of the backrest, and each may more specifically be in the form of a panel or any other suitable structure. Each of the backrest cushion supports 110 may have one or more of the cushions 102 mounted thereto for moving therewith. Each of the backrest cushion supports 110 may be more generally referred to as a backrest frame or subframe, or a portion of the backrest, and these backrest cushion supports may alternatively be in the form of one or more backrest shells, which may or may not be upholstered.

The rearward backrest subframe 104 serves as a base of the backrest of the chair 100, and the rearward backrest subframe is supported by the seat platform of the chair 100. More specifically, the rearward backrest subframe 104 is pivotably mounted to the seat platform of the chair 100 for both moving with the seat platform and pivoting relative to the seat platform, as will be discussed in greater detail below.

The rearward backrest subframe 104 and the intermediate backrest subframe 106 are movably connected to one another by the rearward backrest adjustment mechanism. The rearward backrest adjustment mechanism is operative so that the intermediate backrest subframe 106 may be moved relative to the rearward backrest subframe 104, and more specifically so that the movement of the intermediate backrest subframe relative to the rearward backrest subframe 104 may be translational. For example, the intermediate backrest subframe 106 may be moved along the rearward backrest subframe 104 in response to operation of the rearward backrest adjustment mechanism.

The rearward backrest adjustment mechanism includes one or more longitudinal guides that may be, for example, a pair of laterally spaced apart ball bearing slides 112 extending along the length of the rearward backrest subframe 104. Each slide 112 includes ball bearings positioned between elongate first and second parts configured so that the first and second parts are movably mounted to one another for moving translationally relative to one another. For each of the slides 112, the first and second parts are respectively fixedly mounted to the front of the rearward backrest subframe 104 and the rear of the intermediate backrest subframe 106. The slides 112 may be replaced with any suitable type of guiding (e.g., sliding) device(s), or the like.

The rearward backrest adjustment mechanism further includes a gear drive track 114 that extends along the length of, and is mounted to, the rear surface of the intermediate backrest subframe 106; and an actuator, such as an electronic rotary actuator that may more specifically be in the form of a dual direction gear drive motor 116, mounted to the front surface of the rearward backrest subframe 104. The output gear of the gear drive motor 116 is aligned with and meshes with the gear drive track 114 so that the intermediate backrest subframe 106 moves back and forth along the rearward backrest subframe 104 in response to operation of the gear drive motor 116 in its opposite directions. The positions of the gear drive motor 116 and gear drive track 114 may be reverse. Alternatively, the rearward backrest adjustment mechanism may be in any other suitable form.

The intermediate backrest subframe 106 and the forward backrest subframe 108 are movably connected to one another by the intermediate backrest adjustment mechanism. The intermediate backrest adjustment mechanism is operative so that the forward backrest subframe 108 may be moved relative to the intermediate backrest subframe 106, and more specifically so that the movement of the intermediate backrest subframe relative to the rearward backrest subframe 104 may be rotational. For example, the forward backrest subframe 108 may be rotated about an axis that extends along the length of the intermediate backrest subframe 106, so that the forward backrest subframe may be tilted side to side relative to the intermediate backrest subframe.

The intermediate backrest adjustment mechanism includes one or more aligned hinges, or other suitable mechanisms, by which the forward backrest subframe 108 is pivotably connected to the intermediate backrest subframe 106 along the longitudinal centerline of the intermediate backrest subframe 106. More specifically, the intermediate backrest adjustment mechanism includes rearward and forward shaft mounting brackets 118, 120 respectively mounted to the front of the intermediate backrest subframe 106 and the rear of the forward backrest subframe 108. Optionally, ends of the rearward shaft mounting brackets 118 may be respectively connected by longitudinally extending members to form a rectangular frame, and/or ends of the forward shaft mounting brackets 120 may be respectively connected by longitudinally extending members to form a rectangular frame.

The intermediate backrest adjustment mechanism includes a tilt shaft 122 that extends substantially coaxially through substantially coaxially aligned holes in the rearward and forward shaft mounting brackets 118, 120, so that the tilt shaft is rotatably connected to the rearward shaft mounting brackets 118, and the tilt shaft is fixedly connected to the forward shaft mounting brackets 120. For example, the tilt shaft 122 may rotate freely in the holes in rearward shaft mounting brackets 118 attached to intermediate backrest subframe 106 without excess side to side movement of the tilt shaft in these holes. In contrast, the tilt shaft 122 may form an interference fit with the holes in forward shaft mounting brackets 120 attached to forward backrest subframe 108 and/or the tilt shaft may be otherwise fixedly connected to the shaft mounting brackets 120 attached to forward backrest subframe 108. That is, the tilt shaft 122 together with the forward shaft mounting brackets 120 may be rotated relative to the rearward shaft mounting brackets 118 about the elongate axis of the tilt shaft. Optionally bearings, bushings and or washers may be operatively associated with the holes in one or more of the shaft mounting brackets 118, 120. The tilt shaft 122 may include flanges or other suitable stops at each of its ends (e.g., on the outside of the shaft mounting brackets 118 mounted to intermediate backrest subframe 106) for preventing or otherwise sufficiently restricting the tilt shaft 122 from moving longitudinally relative to the shaft mounting brackets 118, 120.

The intermediate backrest adjustment mechanism further includes an actuator, such as an electronic rotary actuator that may more specifically be in the form of a dual direction screw drive motor 124 mounted to the front surface of the intermediate backrest subframe 106. The output gear of the screw drive motor 124 is meshed with a gear that extends around and is fixedly connected to the tilt shaft 122, so that the forward backrest subframe 108 rotates (about the elongate axis of the tilt shaft 122) both clockwise and counterclockwise relative to the intermediate backrest subframe 106 in response to operation of the screw drive motor 124 in its opposite directions. More specifically, the opposite edges of the forward backrest subframe 108 alternatively move both closer to and farther from the forward backrest subframe 108 in response to operation of the screw drive motor 124 in its opposite directions. The output gear of the screw drive motor 124 and the gear that extends around and is fixedly connected to the tilt shaft 122 may be together referred to as a worm gear set. Alternatively, the intermediate backrest adjustment mechanism may be in any other suitable form.

In accordance with the second embodiment, the forward backrest adjustment mechanism of the chair 100 includes upper, intermediate and lower backrest adjustment mechanisms respectively associated with the upper, intermediate and lower backrest cushion supports 110, so that the backrest cushion supports may be adjusted, to at least a limited extent, relative to and/or independently of one another. Alternatively, there may be less or more of the backrest adjustment mechanisms and/or backrest cushion supports 110, and the backrest adjustment mechanisms and/or backrest cushion supports may be sized and/or arranged differently.

Each of the forward backrest adjustment mechanisms (i.e., each of the upper, intermediate and lower backrest adjustment mechanisms) are similar to one another, and each of the backrest cushion supports 110 are similar to one another. Accordingly, in the following, a representative one of the backrest cushion supports 110, and a respective backrest adjustment mechanism by which the backrest cushion support is movably mounted to the forward backrest subframe 108, are discussed. The backrest cushion support 110 includes a group of the frame members that are respectively connected to one another so that the rear subframe is or includes a rectangular frame with cross members.

The forward backrest adjustment mechanism includes a pair of cross members, namely armed shafts 126, mounted for rotating relative to the forward backrest subframe 108. More specifically, each armed shaft 126 includes a pair of inner arms fixedly mounted to a rotatable shaft. For each armed shaft 126, its shaft has opposite ends respectively rotatably mounted to the front surface of the forward backrest subframe 108 by way of mounting brackets and/or bearings or any other suitable structures, and its inner arms are spaced apart along the length of the shaft and fixedly mounted to the shaft for rotating with the shaft. The armed shafts 126 are parallel to one another. The distance between the armed shafts 126 may be selected depending, for example, on the load that the armed shafts may be required to bear and the range of travel requirements.

For each armed shaft 126, an outer arm 128 is pivotably mounted to the outer end of each inner arm of the armed shaft, so that each outer arm pivots relative to the respective inner arm of the armed shaft. The outer end of each outer arm 128 is connected to a respective cross member of the backrest cushion support 110. As shown in the drawings, there are upper and lower pairs of outer arms 128 connected to the backrest cushion support 110. In accordance with the second embodiment, the lower pair of outer arms 128 may be pivotably mounted to the backrest cushion support 110, and the upper pair of outer arms may be fixedly mounted to the backrest cushion support so that there is no relative rotation between the upper pair of outer arms and the backrest cushion support; or the upper pair of outer arms may be pivotably mounted to the backrest cushions support, and the lower pair of outer arms may be fixedly mounted to the backrest cushion support so that there is no relative rotation between the lower pair of outer arms and the backrest cushion support. Alternatively, the lower pair of outer arms 128 may be pivotably mounted to the backrest cushion support 110, and the upper pair of outer arms may be pivotably mounted to the backrest cushion support, as discussed in greater detail below.

For each armed shaft 126, the forward backrest adjustment mechanism further includes an actuator, such as an electronic rotary actuator that may more specifically be in the form of a dual direction screw drive motor 130 mounted to the front surface of the forward backrest subframe 108. The output gear of the screw drive motor 130 is meshed with a gear that extends around and is fixedly connected to the shaft of the armed shaft 126, so that the armed shaft rotates about its elongate axis both clockwise and counterclockwise relative to the forward backrest subframe 108 in response to operation of the screw drive motor 130 in its opposite directions. The output gear of the screw drive motor 130 and the gear that extends around and is fixedly connected to the shaft of the armed shaft 126 may be together referred to as a worm gear set. Alternatively, the forward backrest adjustment mechanism may be in any other suitable form.

As mentioned above, for the second embodiment, the forward backrest adjustment mechanisms of the chair 100 include upper, intermediate and lower backrest adjustment mechanisms respectively associated with the upper, intermediate and lower backrest cushion supports 110, so that the backrest cushion supports may be adjusted, to at least a limited extent, relative to and/or independently of one another. As a further example in this regard, regarding the above-mentioned aspect/option about the outer arms 128 being pivotably and/or fixedly mounted to the backrest cushion support 110 (e.g., the lower pair of outer arms 128 being pivotably mounted to the backrest cushion support 110, and the upper pair of outer arms being fixedly mounted to the backrest cushion support; or the upper pair of outer arms being pivotably mounted to the backrest cushions support, and the lower pair of outer arms being fixedly mounted to the backrest cushion support), the manner in which the outer arms 128 are pivotably and/or fixedly mounted to the backrest cushion support 110 may or may not vary from one of the backrest cushion supports 110 to the next backrest cushion support 110.

As a specific example, in one possible version of the second embodiment: for the upper backrest cushion support 110 and the upper backrest adjustment mechanism, the lower pair of outer arms 128 are fixedly mounted to the backrest cushion support 110, and the upper pair of outer arms are pivotably mounted to the backrest cushion support; for the intermediate backrest cushion support 110 and the intermediate backrest adjustment mechanism, the lower pair of outer arms 128 are pivotably mounted to the backrest cushion support 110, and the upper pair of outer arms are pivotably mounted to the backrest cushion support; and for the lower backrest cushion support 110 and the lower backrest adjustment mechanism, the lower pair of outer arms 128 are pivotably mounted to the backrest cushion support 110, and the upper pair of outer arms are fixedly mounted to the backrest cushion support. In this regard, a variety of other arrangements are also within the scope of this disclosure.

The upper, intermediate and lower backrest cushion supports 110 and associated features may be referred to differently. For example, the upper backrest cushion support 110 and associated features may be referred to as a headrest, and the intermediate and/or lower backrest cushion supports 110 and associated features may be referred to as a lumber support.

Figure 13:
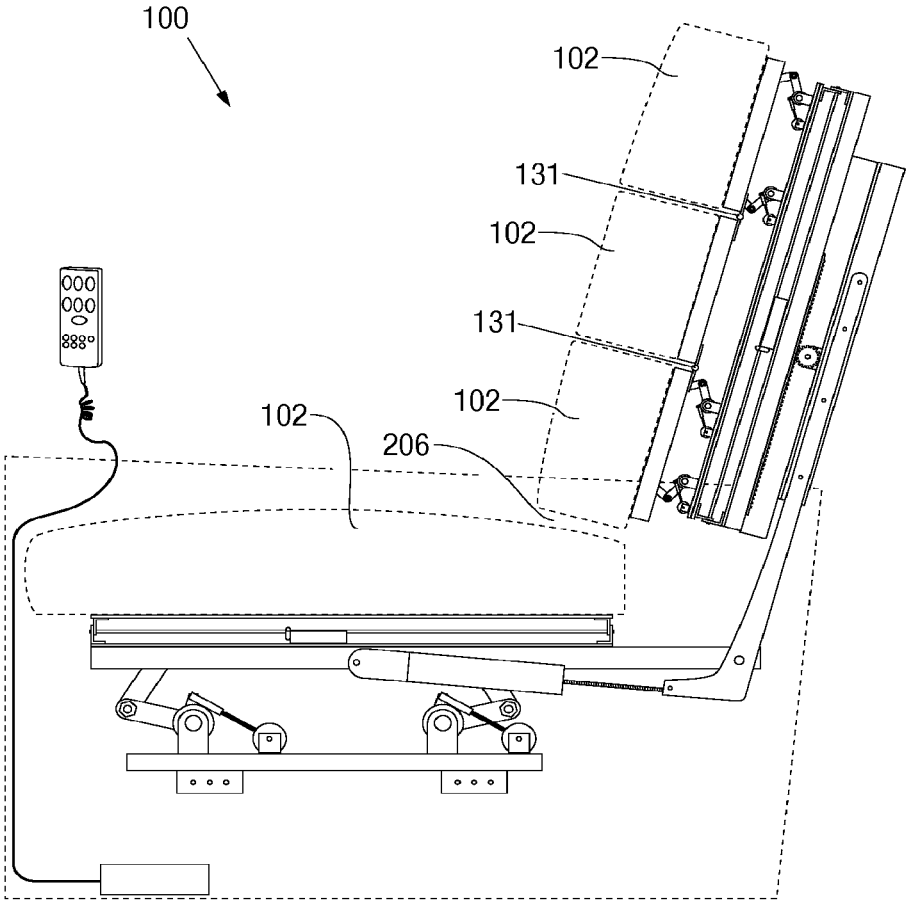
Figure 14:
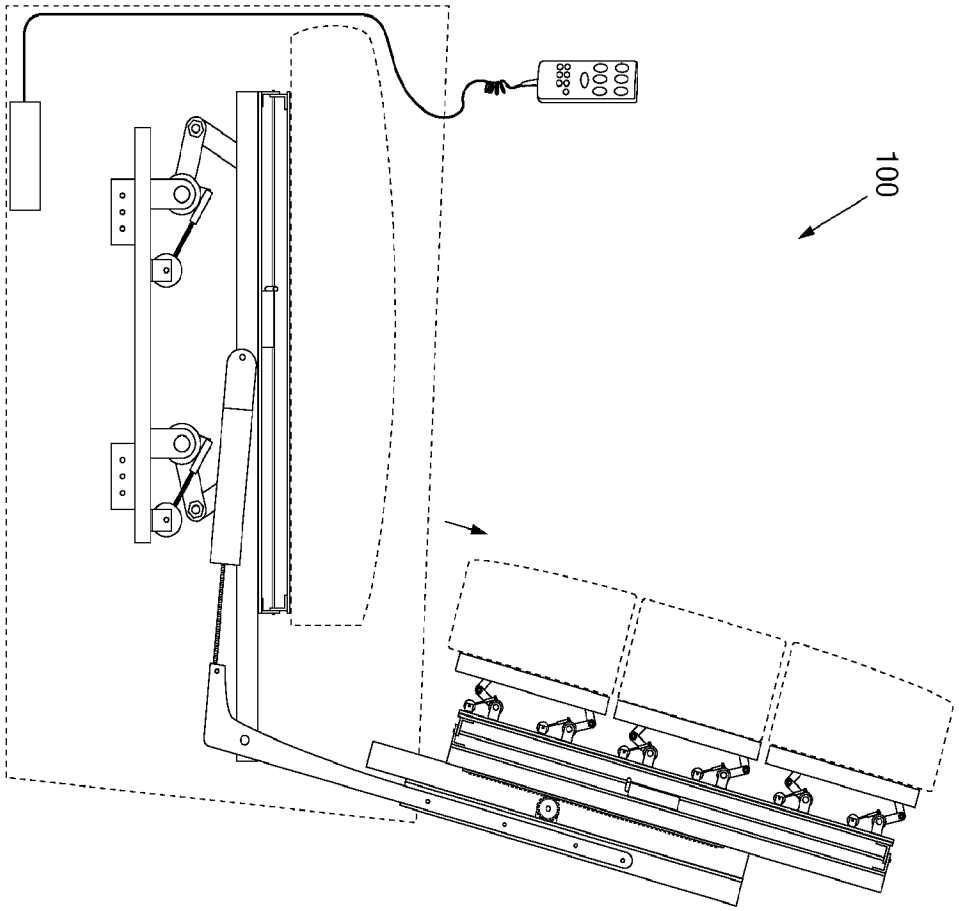
Figure 15:
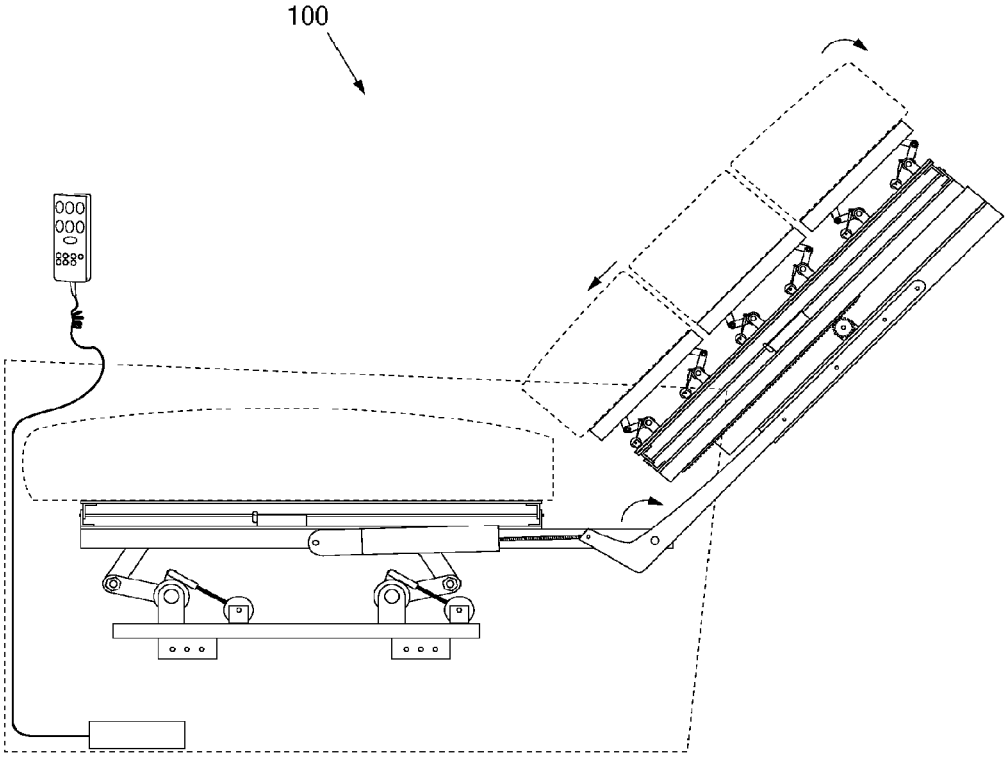
Figure 16:
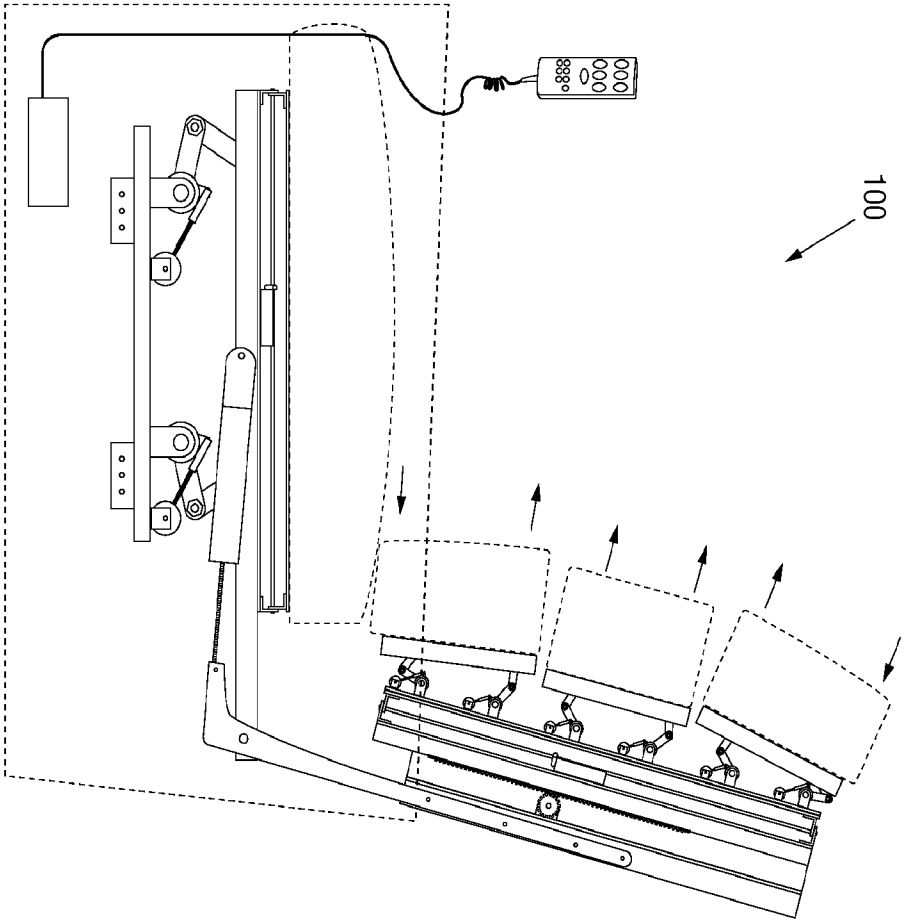
Figure 17:
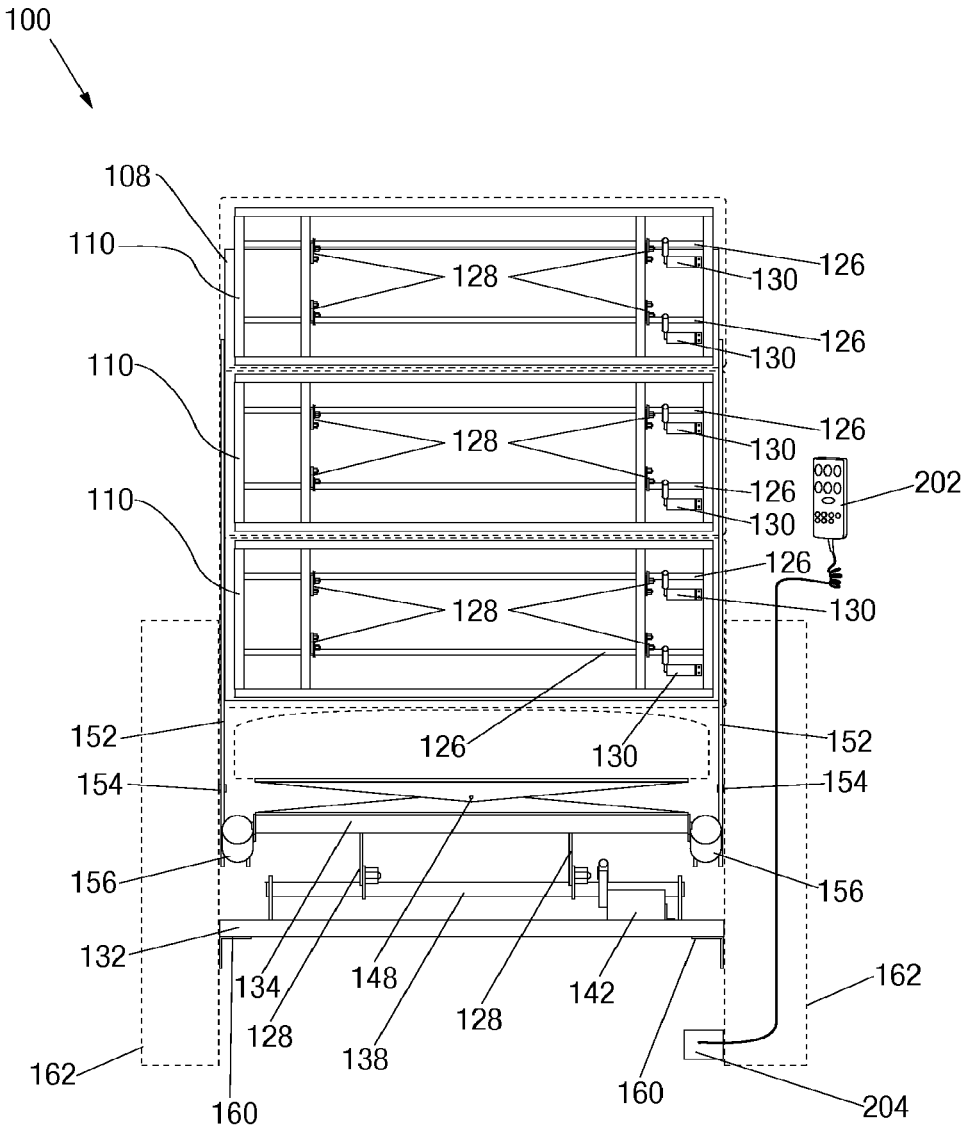
Figure 18:
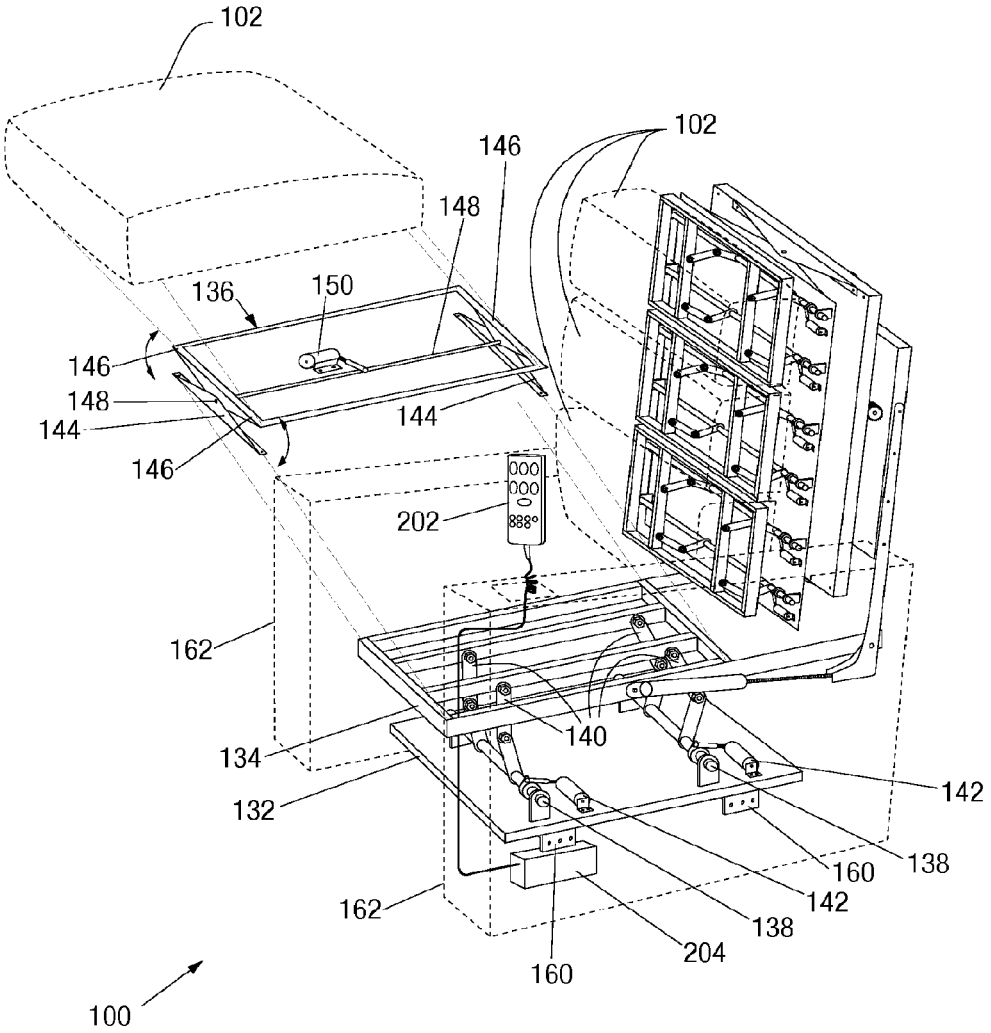
Figure 19:
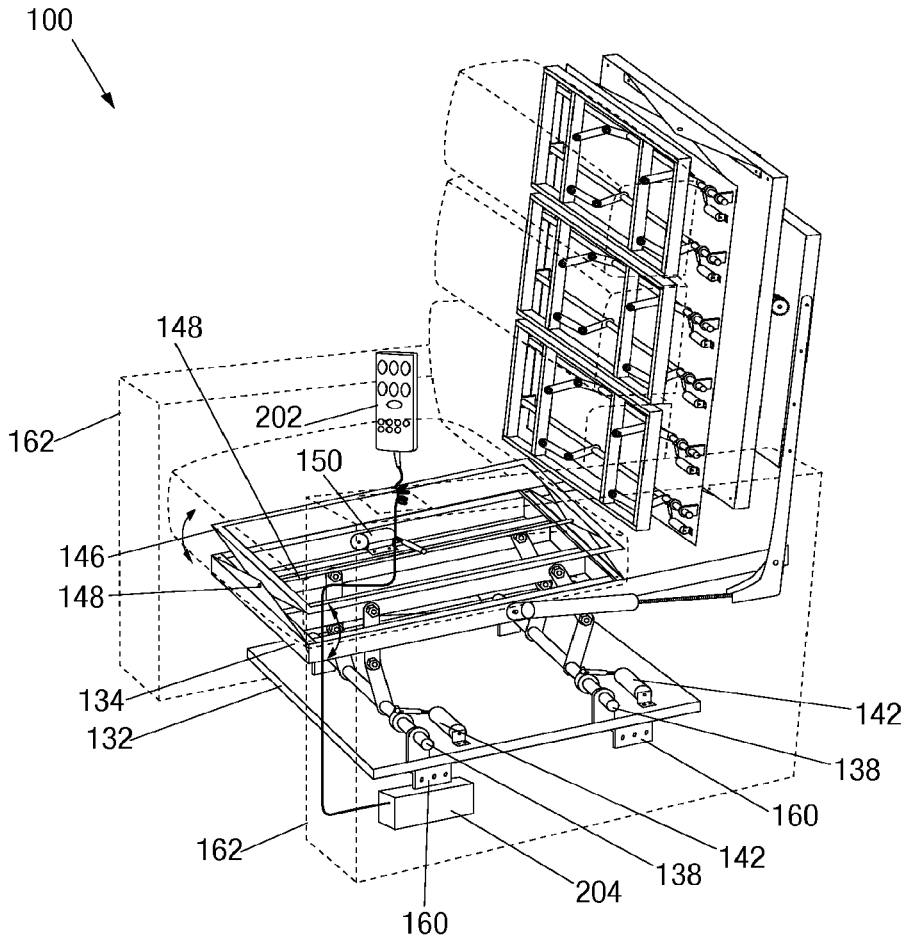
Figure 20:
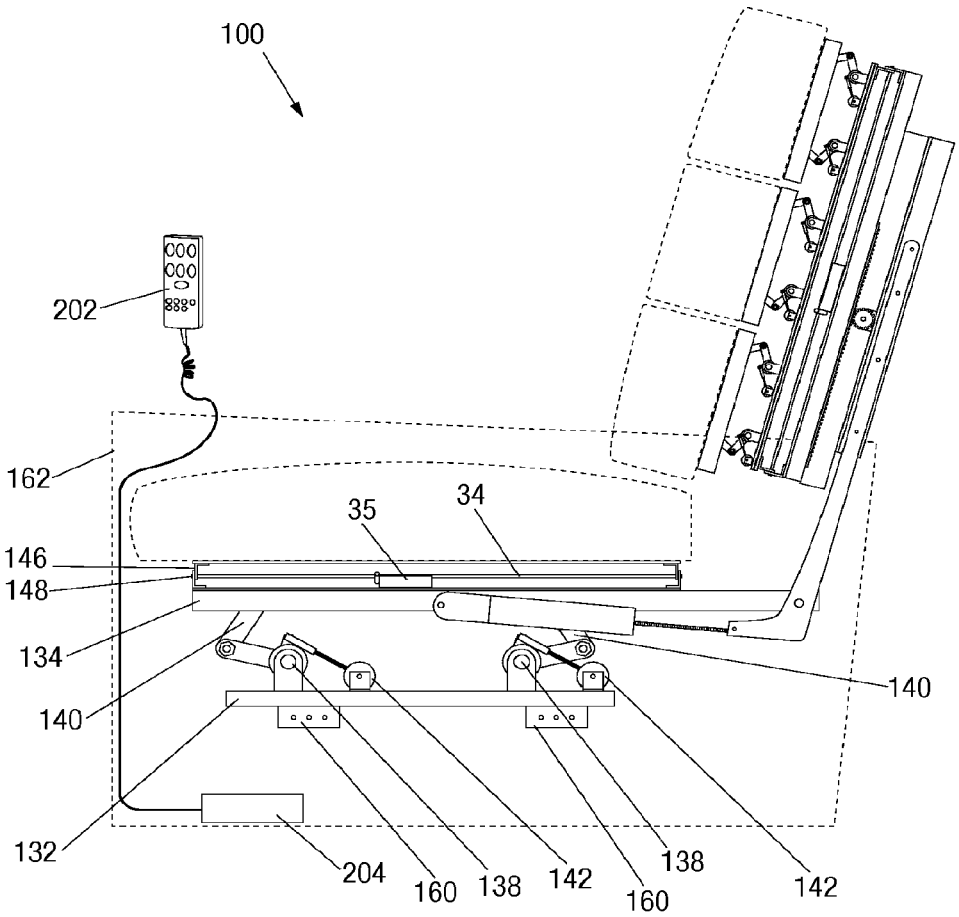
Figure 21:
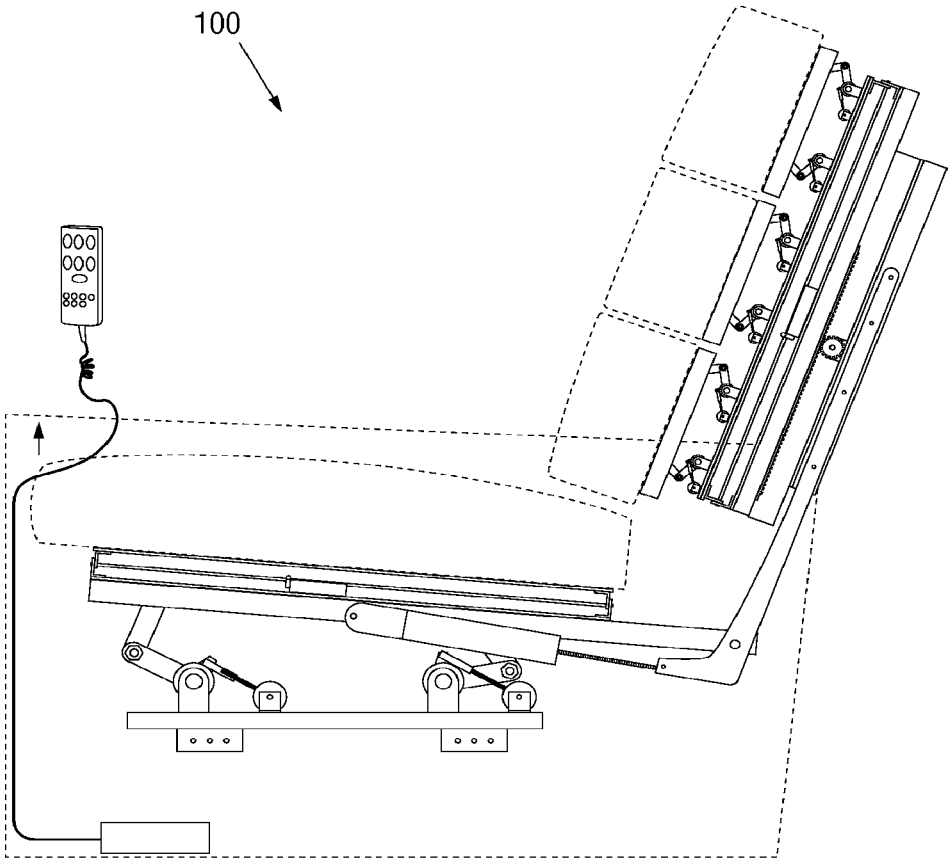
Figure 22:
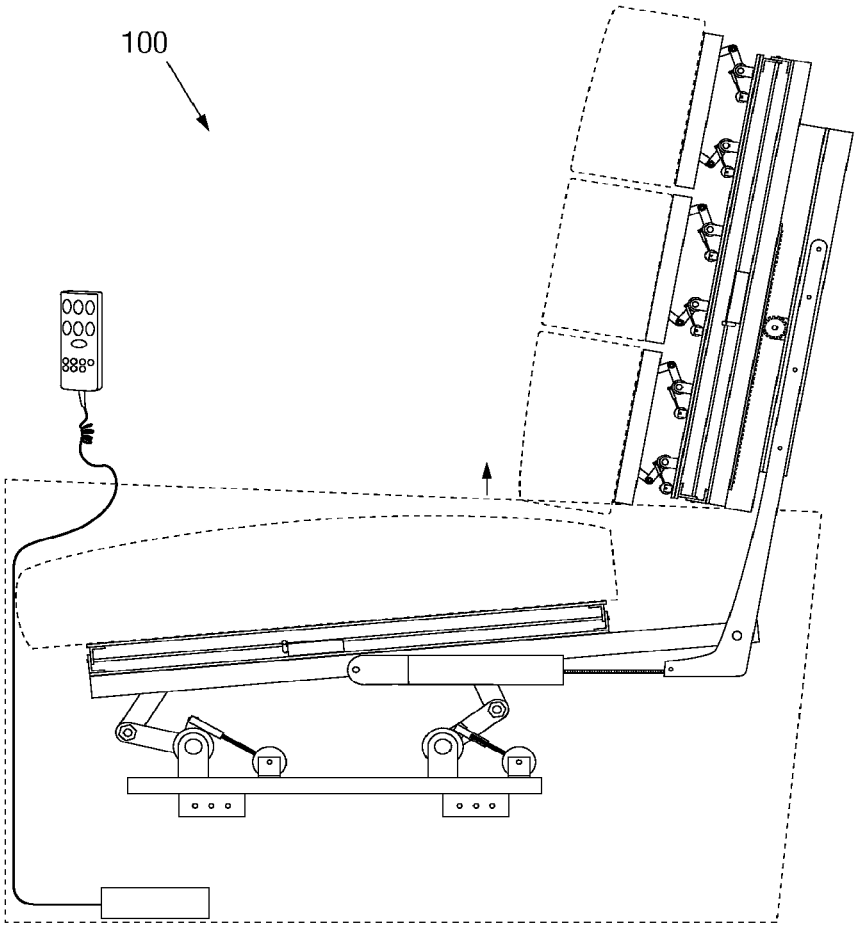
Figure 23:
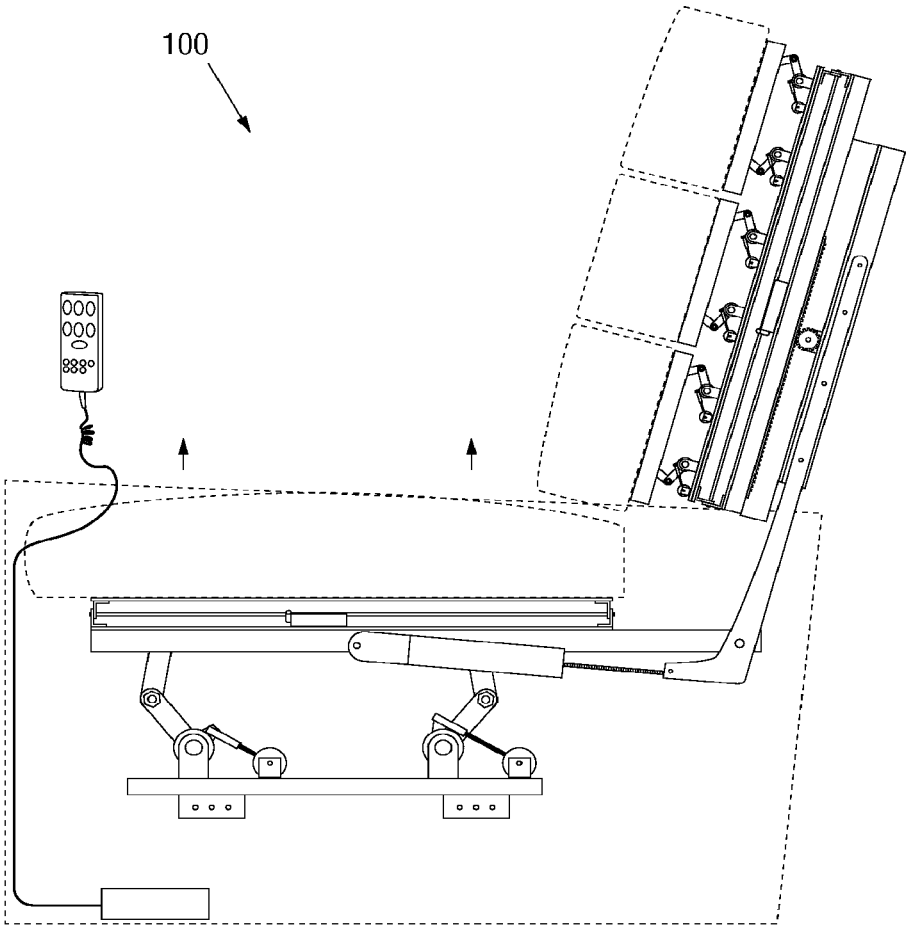
Figure 24:
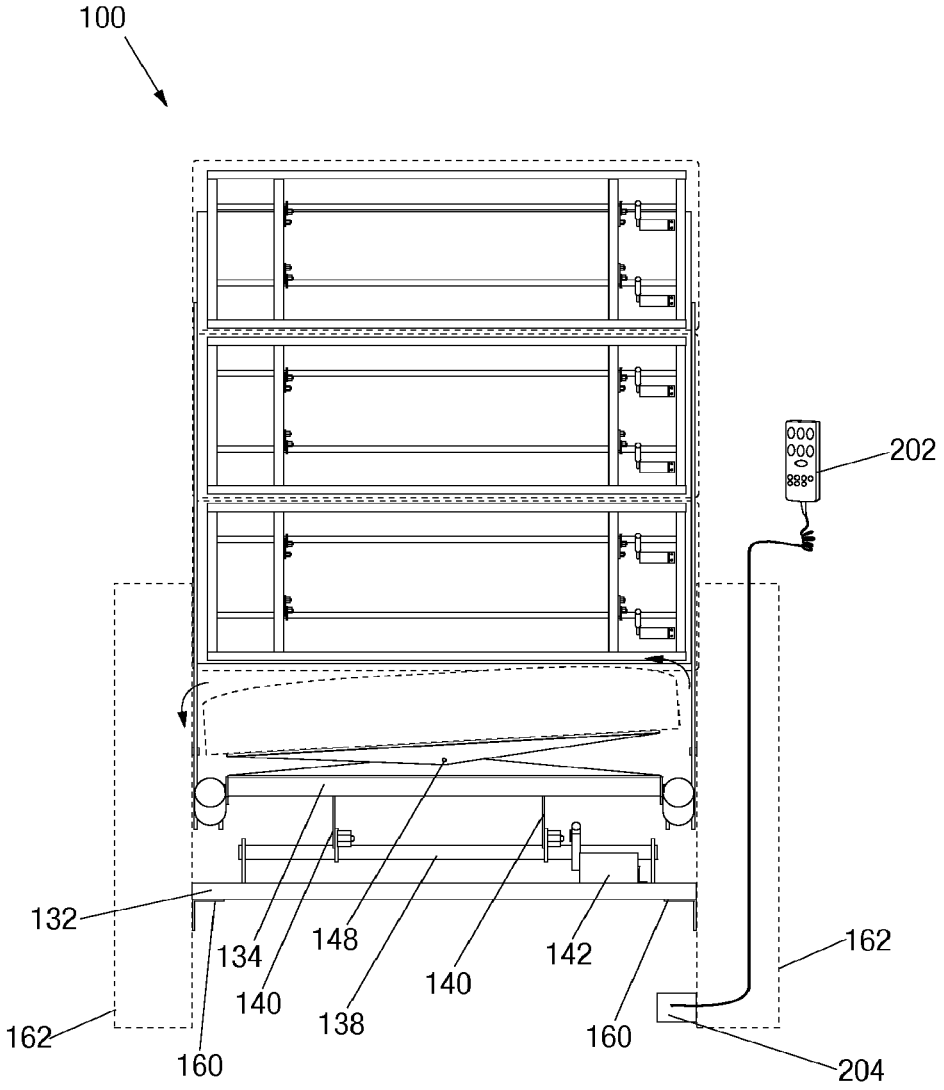
Figure 25:
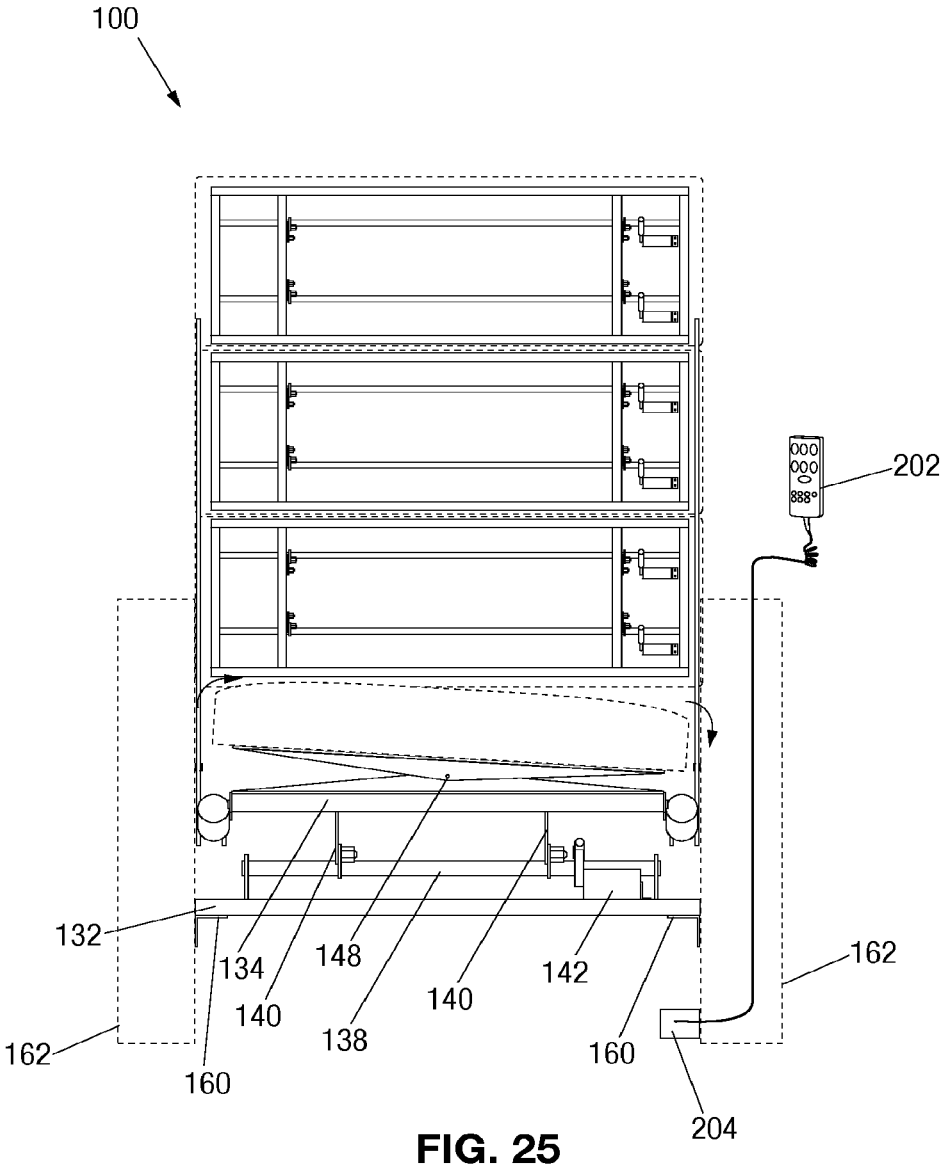

In accordance with the second embodiment and/or an alternative embodiment, optionally and as shown in FIG. 13, the upper, intermediate and lower backrest cushion supports 110 may be respectively pivotably connected to one another by hinges 131 respectively interposed between the backrest cushion supports. For example, each hinge 131 may include opposite wings that are pivotably connected to one another by way of a hinge pin positioned in a barrel assembly, and the wings may be respectively mounted to adjacent backrest cushion supports 110. Accordingly, the forward backrest adjustment mechanisms may be operated by way of one or more respective screw drive motors 130 to change the angle defined between two or more of the backrest cushion supports 110. In one example, changes in the angles defined between the backrest cushion supports 110 may be restricted in a manner that seeks to prevent the backrest cushion support from being placed in any potentially dangerous, or otherwise undesired, configurations. The hinges 131 may be replaced with any other suitable pivotable mechanisms and/or any upholstery of the seat 100 may serve to serve to partially or substantially pivotably connect adjacent backrest cushion supports 110.

Referring to FIGS. 18-25, the chair 100 includes a multi-positional seat platform including a seat frame having one or more cushions 102 of the upholstery mounted thereto for moving therewith, although the upholstery may be optional, as discussed above. The seat frame includes a lower seat subframe 132, an upper seat subframe 134 and a seat cushion support 136. The seat subframes 132, 134 and seat cushion support 136 are respectively movably mounted to one another by way of powered seat adjustment mechanisms for providing a variety of relative movements. The seat adjustment mechanisms may include a powered lower seat adjustment mechanism and a powered upper seat adjustment mechanism, as will be discussed in greater detail below.

Each of the seat subframes 132, 134 may be more generally referred to as portion of the seat platform or a frame, and each may more specifically be in the form of a panel or any other suitable structure. The seat cushion support 136 may have one or more of the cushions 102 mounted thereto for moving therewith. The seat cushion support 136 may be more generally referred to as a portion of the seat platform, or a seat frame or subframe, and the seat cushion support may alternatively be in the form of one or more seat shells, which may or may not be upholstered.

The lower seat subframe 132 serves as a base of the seat platform, and the lower seat subframe is mounted to and supported by bases 158 (FIGS. 26-32) of the chair 100, as will be discussed in greater detail below. The lower seat subframe 132 and the upper seat subframe 134 are movably connected to one another by the lower seat adjustment mechanism. The lower seat adjustment mechanism includes a pair of cross members, namely armed shafts 138, mounted for rotating relative to the lower seat subframe 132. More specifically, each armed shaft 138 includes a pair of inner arms fixedly mounted to a rotatable shaft. For each armed shaft 138, its shaft has opposite ends respectively rotatably mounted to the upper surface of the lower seat subframe 132 by way of mounting brackets and/or bearings or any other suitable structures, and its inner arms are spaced apart along the length of the shaft and fixedly mounted to the shaft for rotating with the shaft. The armed shafts 138 are parallel to one another. The distance between the armed shafts 138 may be selected depending, for example, on the load that the armed shafts may be required to bear and range of travel requirements.

For each armed shaft 138, an outer arm 140 is pivotably mounted to the outer end of each inner arm of the armed shaft, so that each outer arm pivots relative to the respective inner arm of the armed shaft. The upper seat subframe 134 includes a group of the frame members that are respectively connected to one another so that the upper seat subframe is or includes a rectangular frame with cross members. The outer end of each outer arm 140 is connected to a respective cross member of the upper seat subframe 134. As shown in the drawings, there are forward and rearward pairs of outer arms 140 connected to the upper seat subframe 134. In accordance with the second embodiment, the forward pair of outer arms 140 are pivotably mounted to the upper seat subframe 134, and the rearward pair of outer arms are fixedly mounted to the upper seat subframe so that there is no relative rotation between the rearward pair of outer arms and the upper seat subframe; or the rearward pair of outer arms are pivotably mounted to the upper seat subframe, and the forward pair of outer arms are fixedly mounted to the upper seat subframe so that there is no relative rotation between the forward pair of outer arms and the upper seat subframe.

For each armed shaft 138, the lower seat adjustment mechanism further includes an actuator, such as an electronic rotary actuator that may more specifically be in the form of a dual direction screw drive motor 142 mounted to the front surface of the lower seat subframe 132. The output gear of the screw drive motor 142 is meshed with a gear that extends around and is fixedly connected to the shaft of the armed shaft 138, so that the armed shaft rotates about its elongate axis both clockwise and counterclockwise relative to the lower seat subframe 132 in response to operation of the screw drive motors 142 in their opposite directions, respectively. More specifically, the upper seat subframe 134 moves both closer to and farther from the lower seat subframe 132 in response to operation of the screw drive motor 142 in its opposite directions, respectively. These movements of the armed shafts 138 provide for changes in height and pitch of the seat platform of the chair 100.

The upper seat subframe 134 and the seat cushion support 136 are movably connected to one another by the upper seat adjustment mechanism. The upper seat adjustment mechanism is operative so that the seat cushion support 136 may be moved relative to the upper seat subframe 134, and more specifically so that the movement of the seat cushion support relative to the upper seat subframe may be rotational. For example, the seat cushion support 136 may be rotated about an axis that extends along the length of the upper seat subframe 134, so that the seat cushion support may be tilted side to side relative to the upper seat subframe.

The upper seat adjustment mechanism includes one or more aligned hinges, or other suitable mechanisms, by which the seat cushion support 136 is pivotably connected to the upper seat subframe 134 along the longitudinal centerline of the upper seat subframe. More specifically, the upper seat adjustment mechanism includes lower and upper shaft mounting brackets 144, 146. The lower shaft mounting brackets are mounted to the upper surface of the upper seat subframe 134. In accordance with the second embodiment, ends of the upper shaft mounting brackets 146 are respectively connected by longitudinally extending members to form a rectangular frame that serves as the seat cushion support 136. Alternatively, the seat cushion support 136 may alternatively be in the form of a separate frame (e.g., a panel or any other suitable structure) interposed between the seat cushion 102 and the upper shaft mounting brackets 146 (e.g., the upper shaft mounting brackets 146 may be mounted to the lower surface of the seat cushion support).

The upper seat adjustment mechanism includes a tilt shaft 148 that extends substantially coaxially through substantially coaxially aligned holes in the lower and upper shaft mounting brackets 144, 146 in a manner so that the tilt shaft is rotatably connected to the lower shaft mounting brackets 144, and the tilt shaft is fixedly connected to the upper shaft mounting brackets 146. For example, the tilt shaft 148 may rotate freely in the holes in the lower shaft mounting brackets 144 attached to upper seat subframe 134 without excess side to side movement of the tilt shaft in these holes. In contrast, the tilt shaft 148 may form an interference fit with the holes in upper shaft mounting brackets 146 that form and/or are attached to seat cushion support 136. More generally, the tilt shaft 148 may be fixedly connected in any suitable manner to the upper shaft mounting brackets 146. That is, the tilt shaft 148 together with the upper shaft mounting brackets 146/seat cushion support 136 may be rotated relative to the lower shaft mounting brackets 146 about the elongate axis of the tilt shaft. Optionally bearings, bushings and or washers may be operatively associated with the holes in one or more of the shaft mounting brackets 144, 146. The tilt shaft 148 may include flanges or other suitable stops at each of its ends (e.g., on the outside of the shaft mounting brackets 144 mounted to upper seat subframe 134) for preventing or otherwise sufficiently restricting the tilt shaft 148 from moving longitudinally relative to the shaft mounting brackets 144, 146.

The upper seat adjustment mechanism further includes an actuator, such as an electronic rotary actuator that may more specifically be in the form of a dual direction screw drive motor 150 mounted to the upper surface of the upper seat subframe 134. The output gear of the screw drive motor 150 is meshed with a gear that extends around and is fixedly connected to the tilt shaft 148, so that the seat cushion support 136 rotates (about the elongate axis of the tilt shaft 148) both clockwise and counterclockwise relative to the upper seat subframe 134 in response to operation of the screw drive motor 150 in its opposite directions. More specifically, the side edges of the seat cushion support 136 alternately move both closer to and farther from the upper seat subframe 134 in response to operation of the screw drive motor 150 in its opposite directions. The output gear of the screw drive motor 150 and the gear that extends around and is fixedly connected to the tilt shaft 148 may be together referred to as a worm gear set. Alternatively, the upper seat adjustment mechanism may be in any other suitable form. As one example, and as may be the case with other of the adjustment mechanisms or other suitable apparatus of this disclosure, appropriate features of the upper seat adjustment mechanism may be interchanged with one another and/or other rearrangements may be made.

Referring back to FIG. 10 and as mentioned above, the rearward backrest subframe 104 is pivotably mounted to the seat platform of the chair 100 for both moving with the seat platform and pivoting relative to the seat platform. More specifically, each side of the rearward backrest subframe 104 may be fixedly connected to a recline bracket 152 that is pivotably connected by pivot joints 154 to rearwardly projecting frame parts of the upper seat subframe 134. The pivot joints 154 are respectively positioned at the opposite sides of the upper seat subframe 134. By attaching the recline brackets 152 to both the rearward backrest subframe 104 and the movable upper seat subframe 134, the entire backrest will ride up and down with the seat platform. By pivotably attaching the recline brackets 152 to the upper seat subframe 134, the entire backrest may be pivoted forwardly and rearwardly relative to the seat platform.

In accordance with the second embodiment, the pivot joints 154 at the opposite sides of the seat 100 typically remain substantially coaxially aligned in a manner that seeks to avoid any binding during adjustments to the inclination of the backrest. For example, the pivot joints 154 may be defined by opposite ends of a single shaft, and/or other provisions may be made for smooth pivoting about the pivot joints 154, such as by incorporating washers, bushings, bearings and/or any other suitable structures. As another example, there are numerous conventional fittings available for connecting between the backrest and seat platform of a seat, for use in smoothly adjusting the inclination of the backrest relative to the seat platform, and the pivot joints 154 may incorporate any suitable fittings.

The recline brackets 152 and pivot joints 154 may be characterized as being part of a powered recline adjustment mechanism of the seat 100. In accordance with the second embodiment, the recline adjustment mechanism further includes actuators, such as electronic rotary actuators that may more specifically be in the form of dual direction screw drive motors 156. The screw drive motors 156 are mounted for causing pivoting of the recline brackets 152 about the pivot joints 154, and thereby pivoting of the backrest about the pivot joints 154. More specifically, each of the screw drive motors 156 has opposite ends; and at each side of the seat, one end of the screw drive motor 156 is pivotably connected to the lower end of the recline bracket 152, and the other end of the screw drive motor 156 is pivotably connected to the upper seat subframe 134. For each screw drive motor 156, both of its opposite ends pivot for allowing the recliner screw drive motor 156 to pivot as the screw in the recliner screw drive motor 156 causes the recline bracket 152 to move back and forth. As the recliner screw drive motors' 156 screws withdraw into their motors, the recline brackets 152 pivot on the pivot joints 154 and cause the top of the recline bracket 152 to lean backwards. As the recliner screw drive motors' 156 screws are reversed, the recline brackets 152 pivot on the pivot joints 154 and cause the top of the recline brackets 152 to lean forward. The rearward backrest subframe 104 is attached to recline brackets 152 so that the entire backrest moves with the recline brackets 152.

Referring to FIGS. 26-32, the chair 100 includes right and left bases 158 that extend at least downwardly from the lower seat subframe 132 for supporting the chair on a floor or other suitable surfaces. The bases 158 may be characterized as being feet, legs, or the like of the chair 100; they may be part of or defined by the frame of the chair; or they may be or include subframes of the chair. In accordance with the second embodiment, the lower seat subframe 132 is positioned between the bases 158, and the right and left side edges of the lower seat subframe are respectively connected to the bases by mounting brackets 160, so that the bases support the lower seat subframe and all of the other components supported by the lower seat subframe are supported by the bases.

The bases 158 may further support multi-positional armrests 162 of the chair 100, and the bases may also be characterized as being parts of the armrests. In accordance with the second embodiment, the bases 158 may be at least partially in the form of boxes, and the armrests may at least partially be in the form of downwardly open boxes or casings that respectively at least partially fit over and move relative to the bases in a nested manner. In accordance with one aspect of this disclosure, these overlapping/nesting box-like arrangements of the bases 158 and armrests 162 allows the appearance of the chair 100 to remain relatively consistent in both lowered and raised configurations of the chair.

Figure 26:
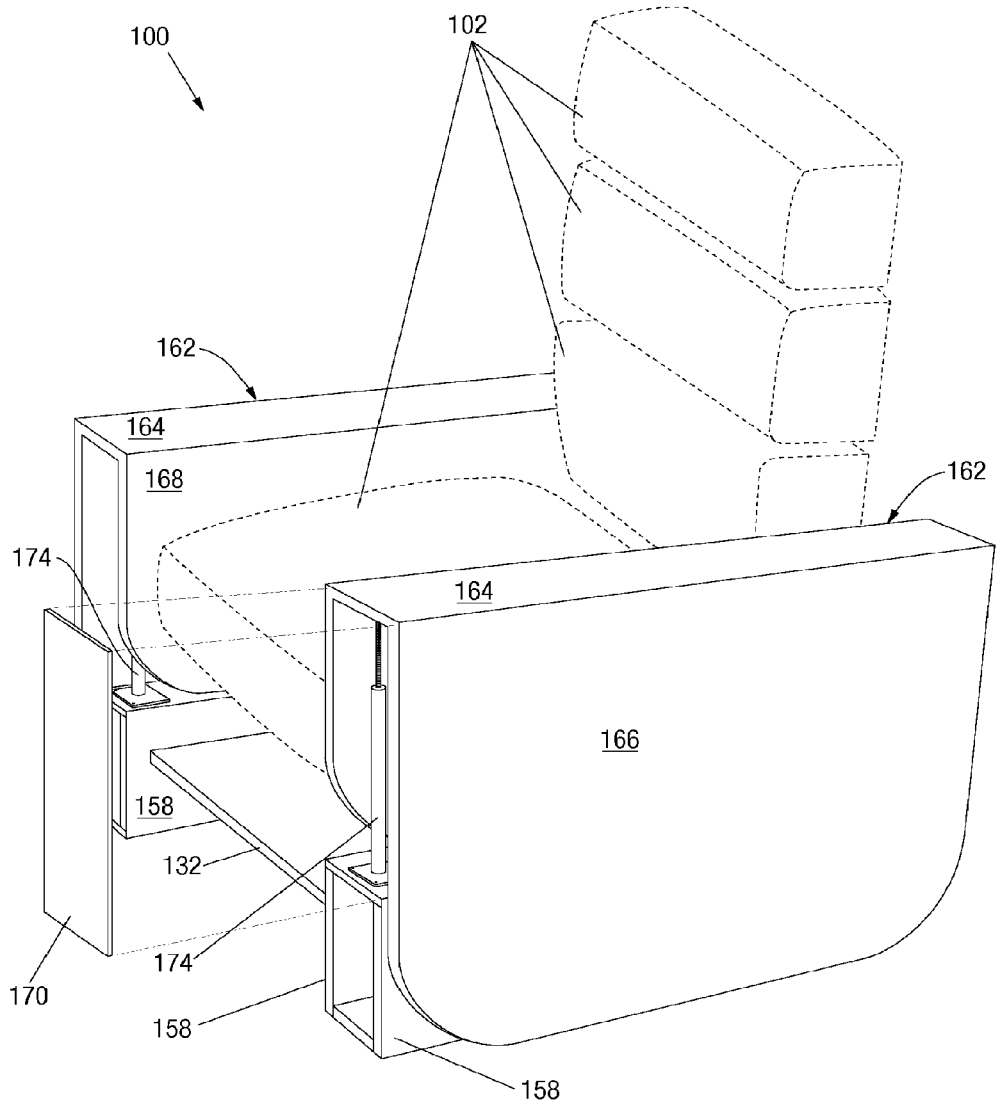
Figure 27:
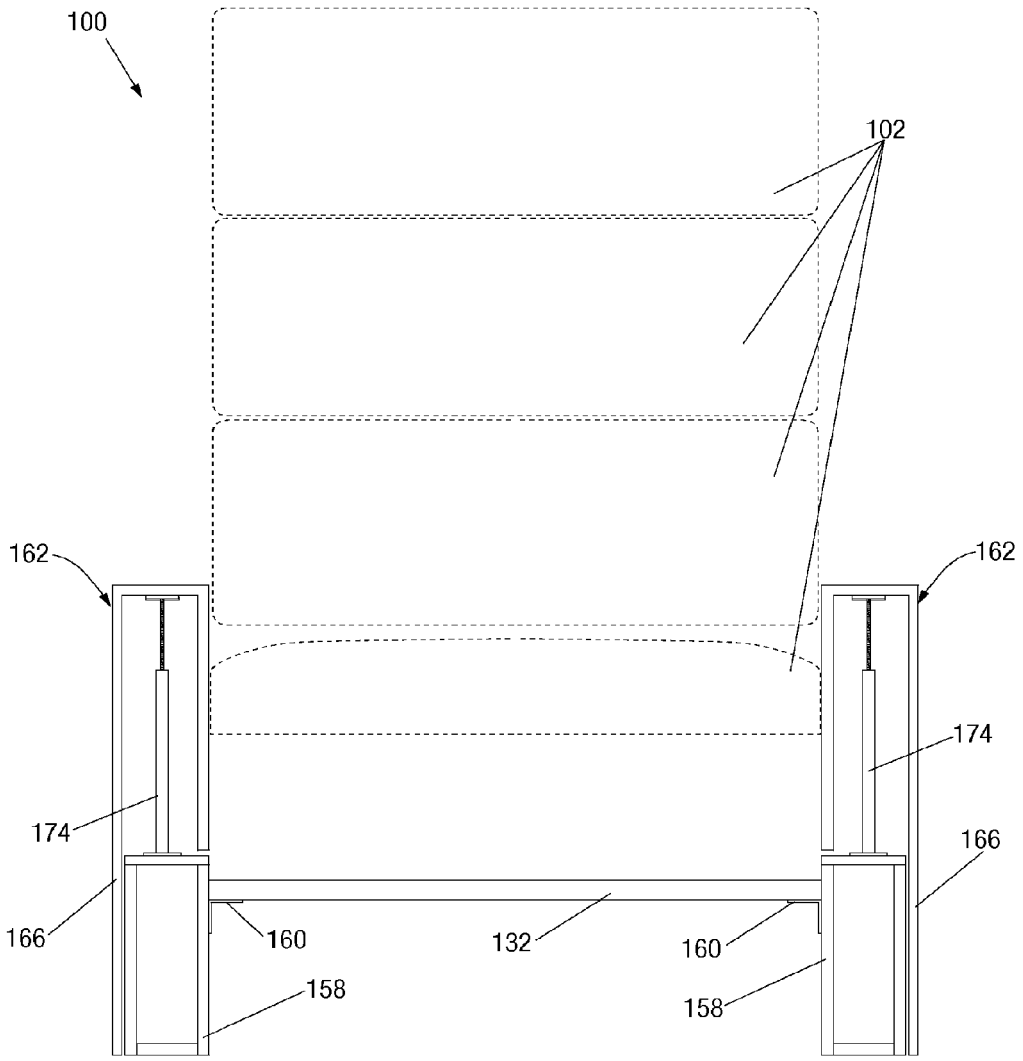
Figure 28:
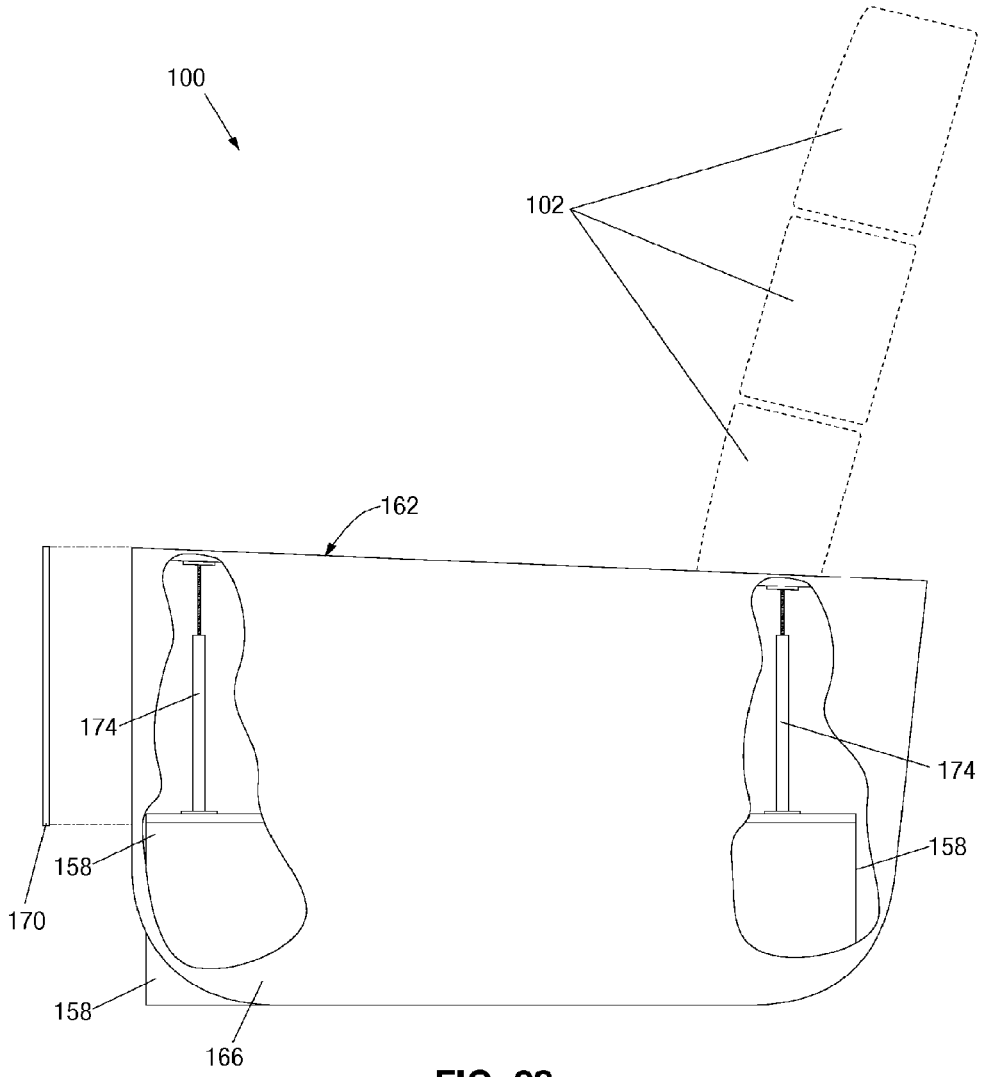
Figure 29:
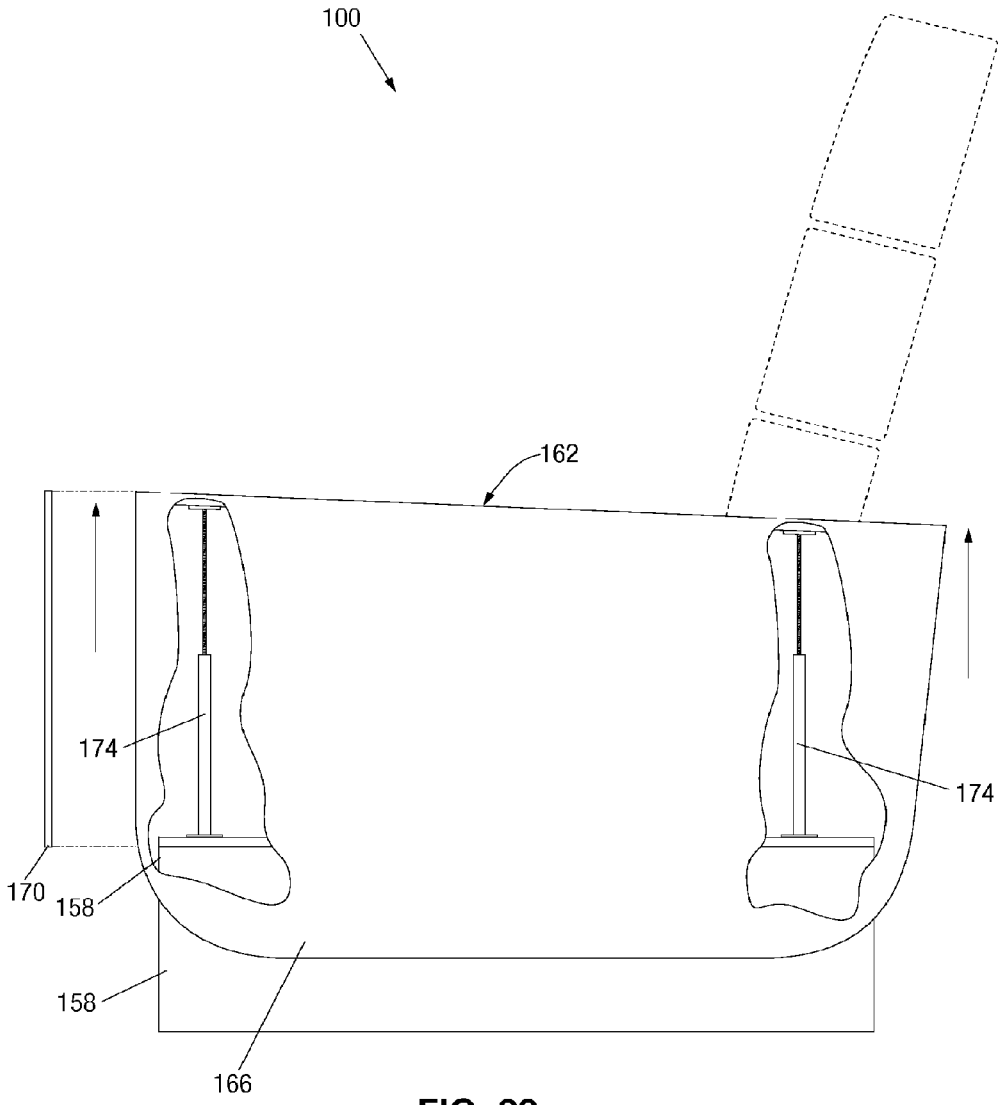
Figure 30:
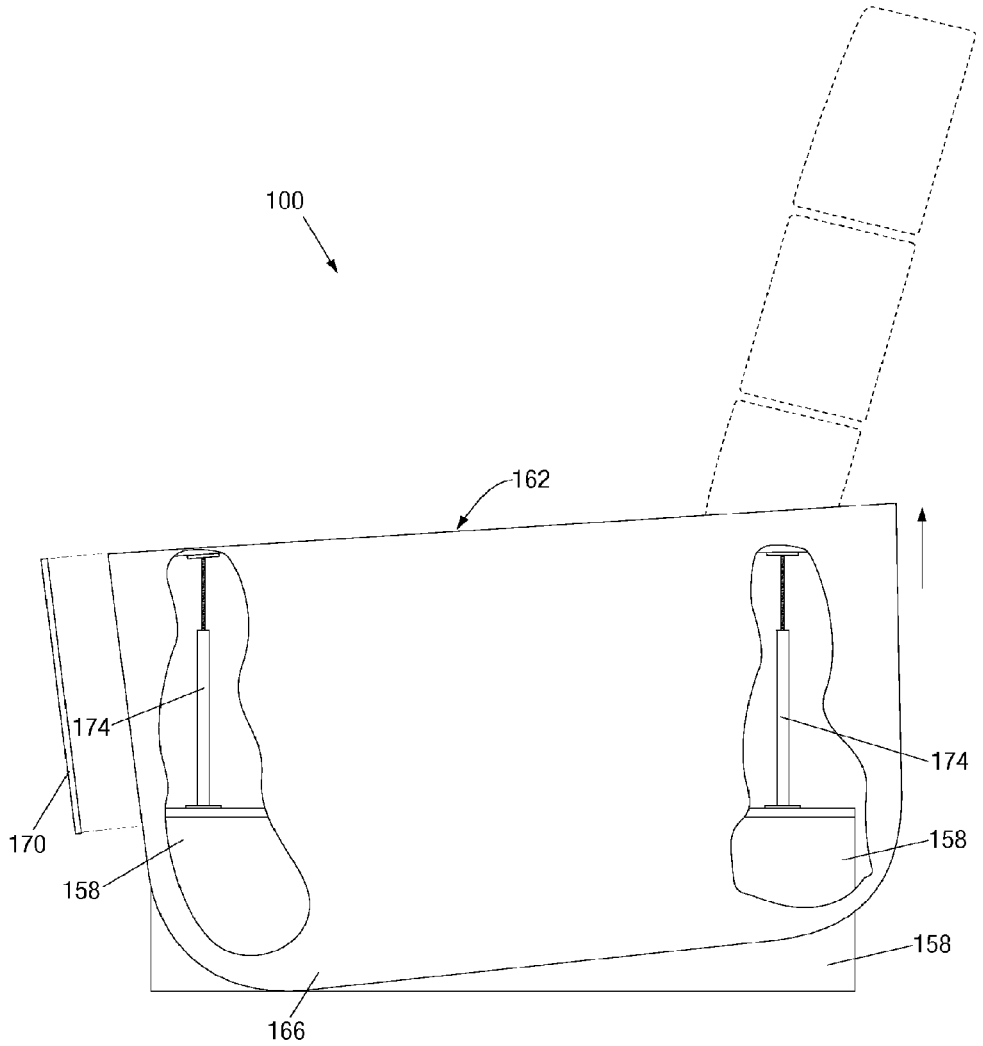
Figure 31:
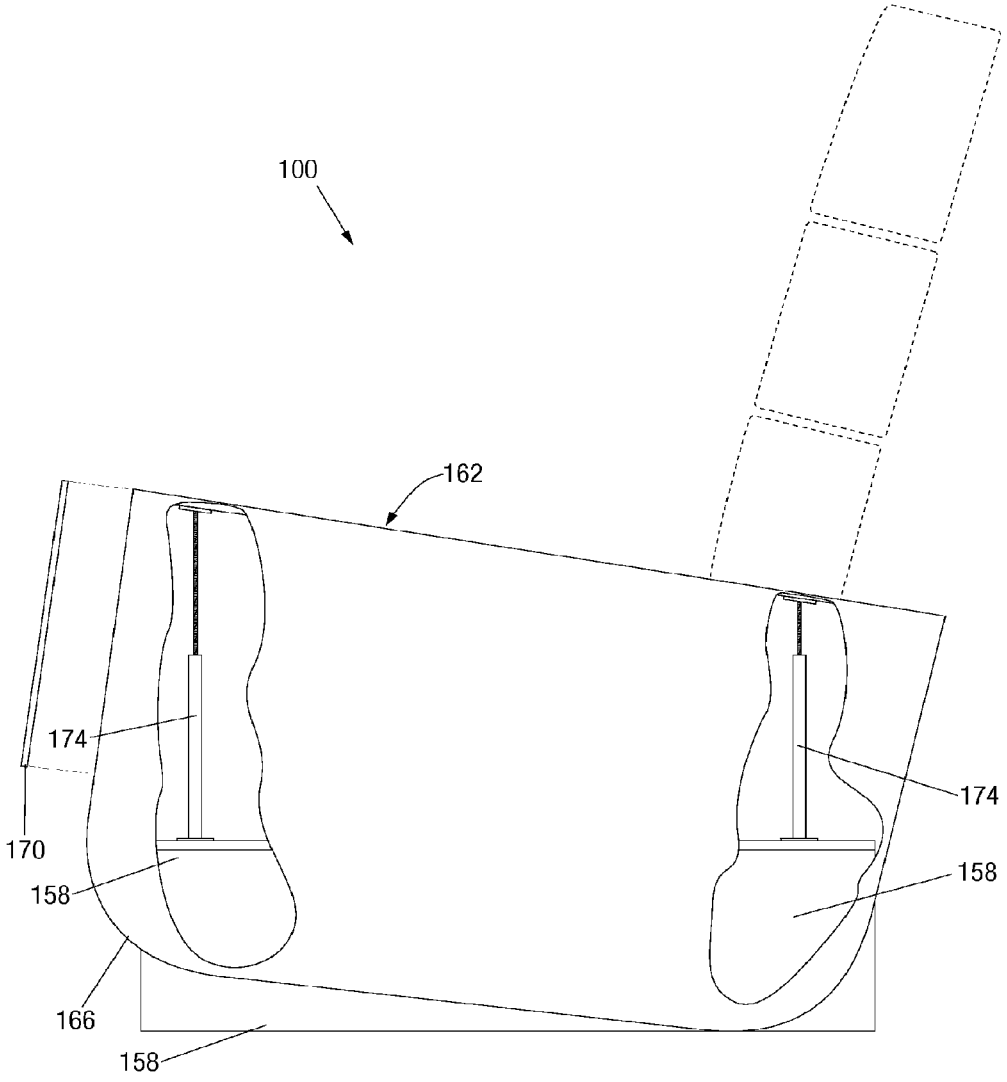
Figure 32:
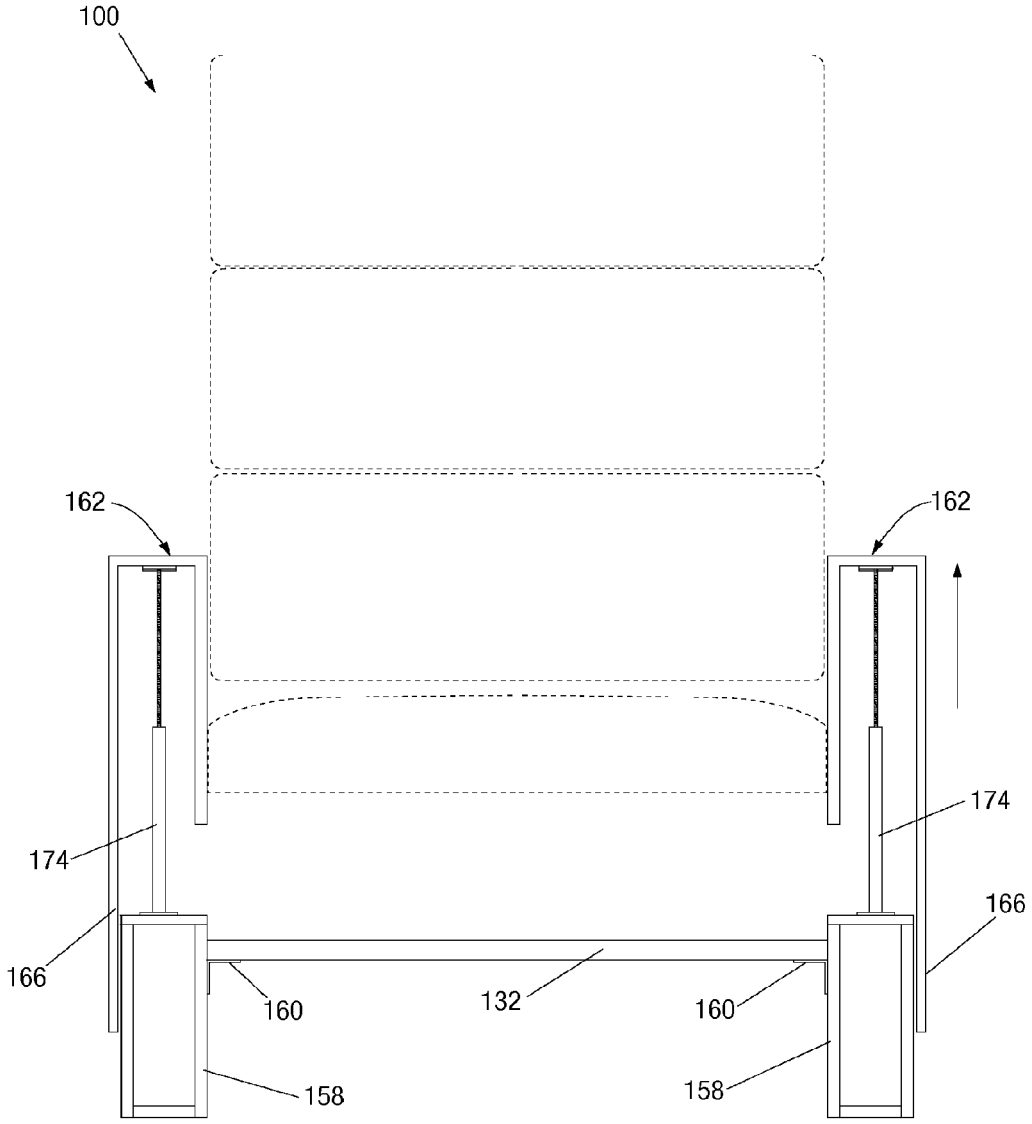
Figure 33:
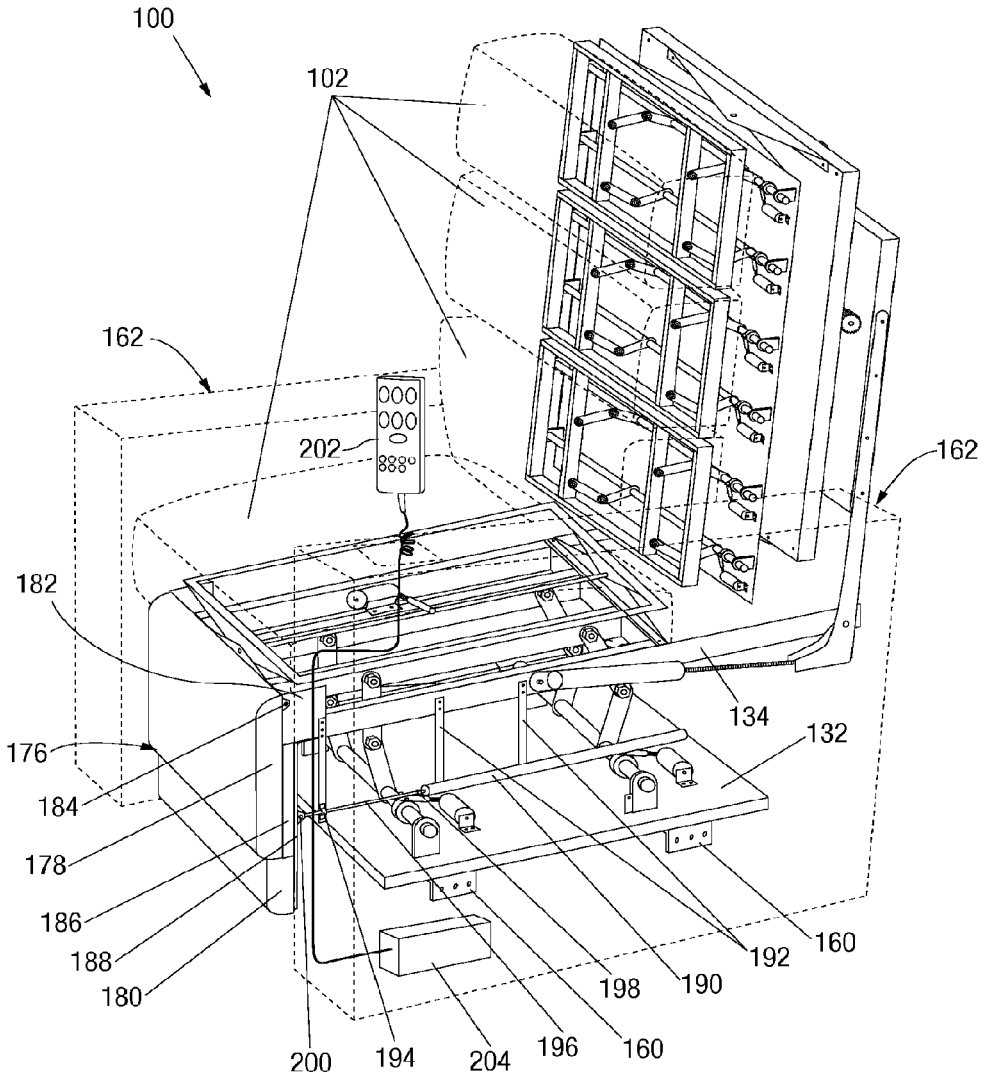
Figure 34:
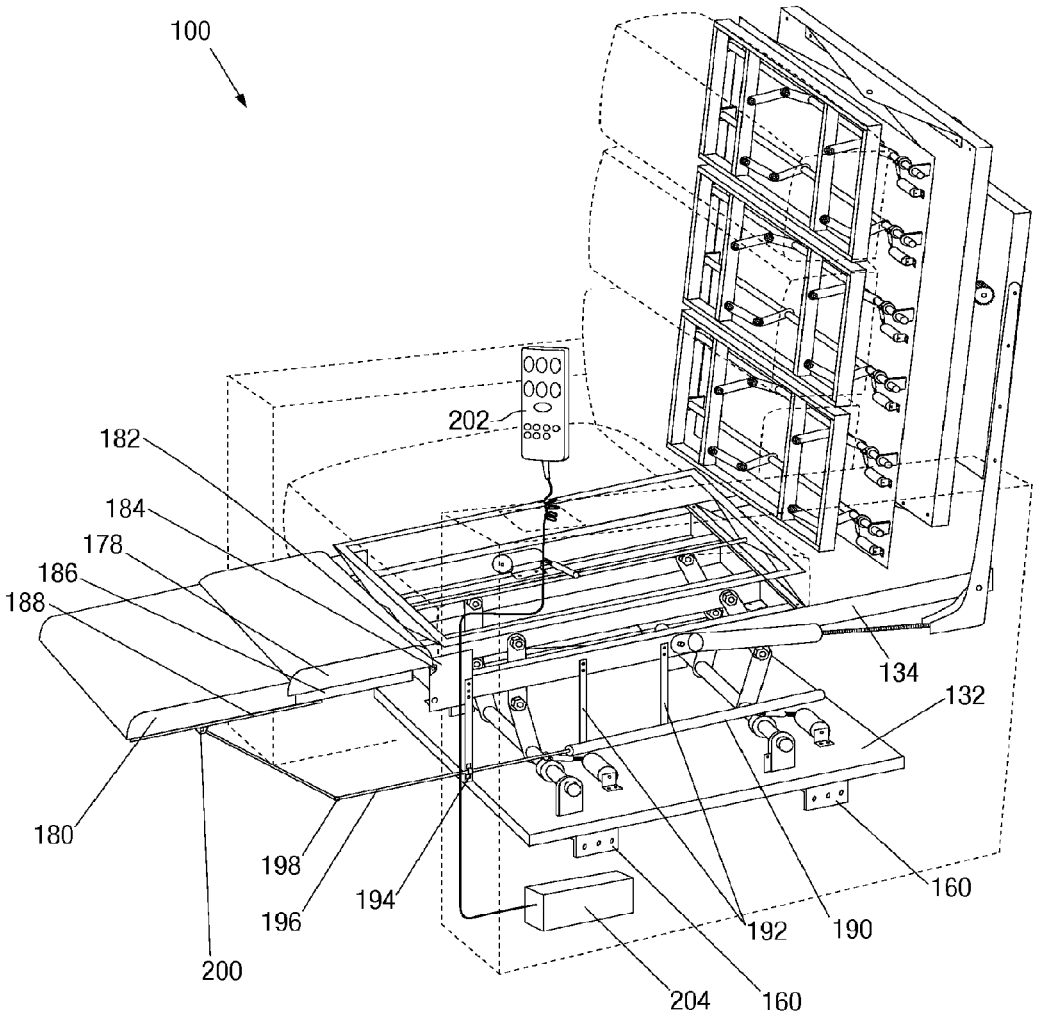
Figure 35:
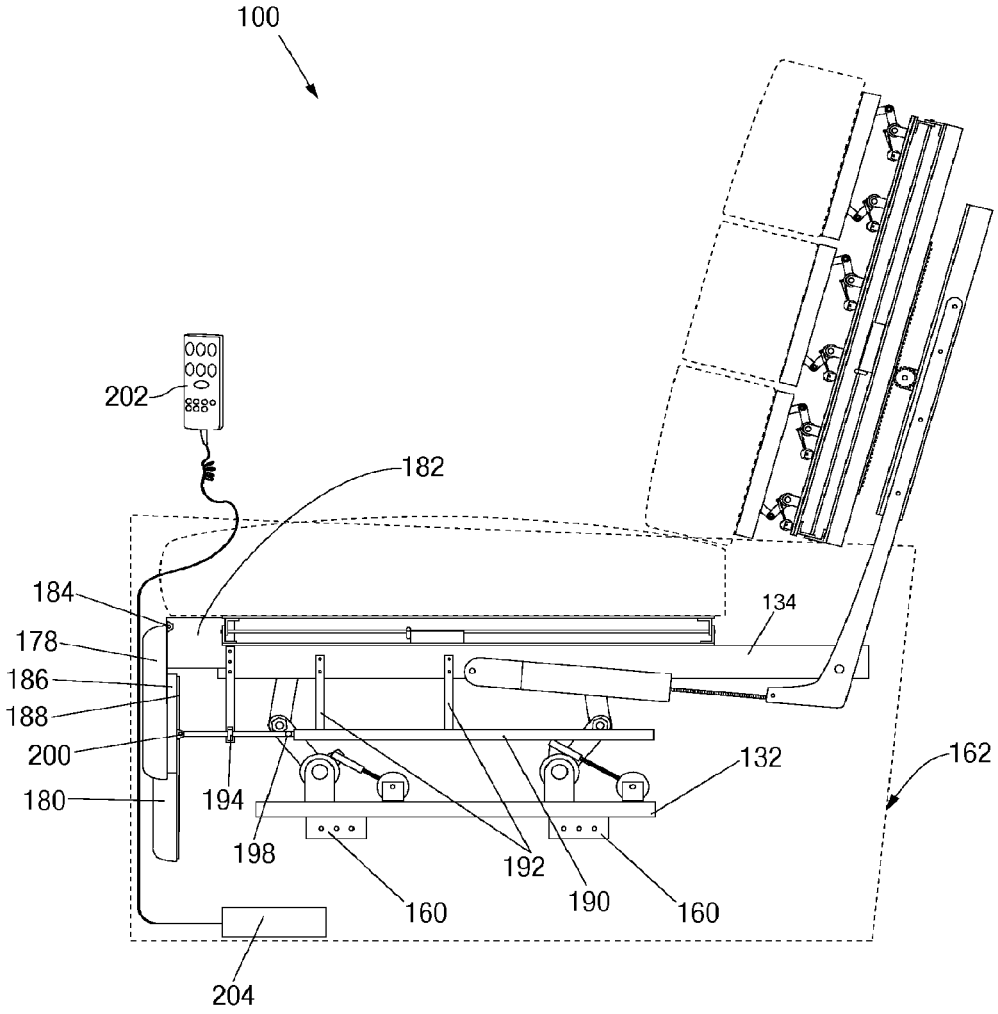
Figure 36:
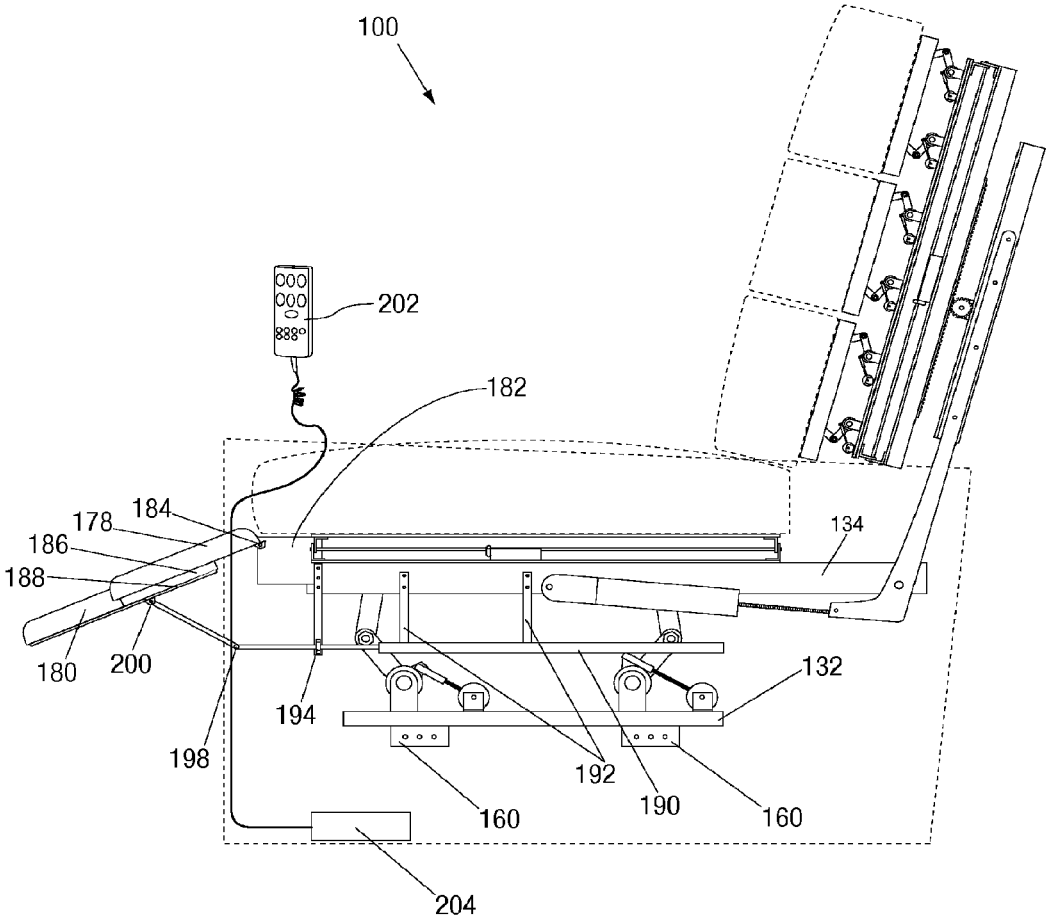
Figure 37:
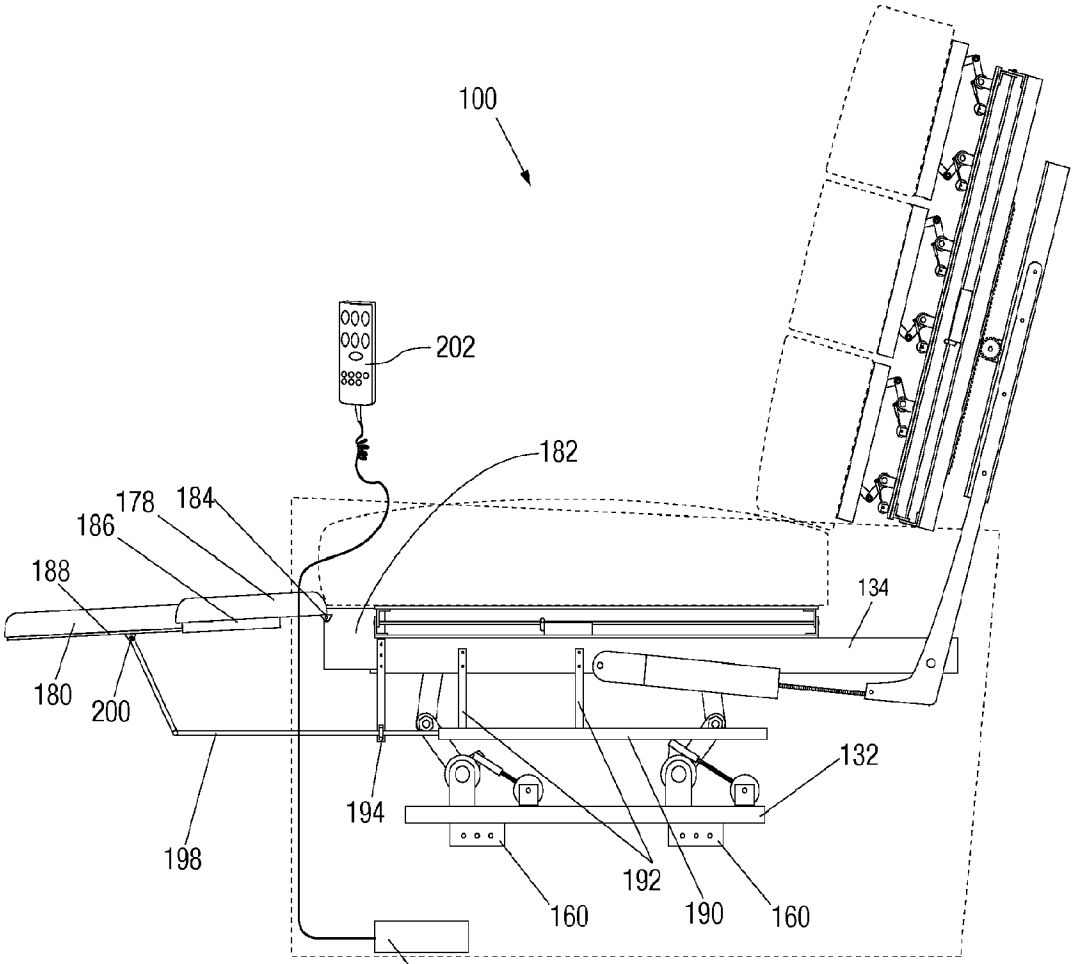

For each of the armrests 162, it includes an upper wall 164, opposite outer and inner side walls 166, 168 respectively extending downwardly from the outer and inner side edges of the upper wall, a front wall 170 and a rear wall respectively extending downwardly from the front and rear edges of the upper wall. For each armrest 162, the upper surface of the upper wall 164, or the upper surface of any upholstery thereon, serves as the surface where an occupant sitting in the chair 100 may rest their arm. The walls 164, 166, 168, 170 also conceal inner features of the chair 100. The front walls 164 are omitted or shown exploded away from the remainder of the armrests 162 in FIGS. 26-32. More specifically, the front wall 170 shown in FIG. 26 is exploded away from the front of the armrest 162 that is typically for supporting the occupant's left arm. In the second embodiment, for each of the armrests 162, its upright outer side wall 166 is in close proximity to, such as by being in sliding contact with, the upright outer side wall of the corresponding base 158, so that the chair 100 has a pleasing appearance at the overlap between these walls, substantially without showing any gaps as the armrest is raised and lowered. More generally and for each of the armrests 162, its upright outer side wall 166 and the upright outer side wall of the corresponding base 158 are preferably (e.g., optionally) cooperatively configured so that the chair 100 has a pleasing appearance at the overlap between these walls, substantially without showing any gaps as the armrest is raised and lowered.

Regarding the raising and lowering the armrests 162, for each of the armrests, it is movably connected to the respective base 158 by an armrest adjustment mechanism. Each armrest adjustment mechanism includes one or more actuators, such as electronic rotary actuators that may more specifically be in the form of dual direction screw drive motors 174. More specifically, for each armrest 162, two screw drive motors 174 are mounted on top of the base 158 and extend to the inner surface of the upper wall 164, for supporting and moving the armrest. One of the screw drive motors 174 is positioned toward the front of base 158, and the other screw drive motor 174 is positioned toward the rear of base 158.

For each of the armrests 162, the front and rear lower corners of the outer side wall 166 may be proximate the floor, or the like, supporting the chair 100, and these corners may be truncated, or more specifically rounded, for providing clearance between these corners and the floor while the armrest is pivoted close to the floor. The rounding or other truncating of these lower corners of the outer side walls 166 are for allowing, for example, the armrests 162 to be readily tilted forward and backward while close to the floor. The rounding or other truncating of these lower corners of the outer side walls 166 seek to allow clearance so that the armrests 162 do not rub against the floor as the armrests are tilted toward the back or front.

Whereas each armrest 162 is shown as being equipped with two of the screw drive motors 174, more or less of the screw drive motors 174 may be used. For example, in the case where only one screw drive motor 174 is used for an armrest 162, one or more channels or guides (e.g., ball bearing slides, or the like) may be mounted between the exterior of the base 158 and the interior of the armrest 162 to allow the two pieces to maintain their alignment as the armrest 162 is raised and lowered by the screw drive motor 174.

Referring to FIGS. 33-37 and in accordance with the second embodiment, the chair 100 includes an adjustable, low profile, compound footrest 176 that is connected to the seat platform for moving with at least a portion of the seat platform. More specifically, the compound footrest 176 includes an upper footrest portion 178 mounted for moving with, and pivoting relative to, the upper seat subframe 134; and a lower footrest portion 180 mounted for moving with, and reciprocating relative to, the upper footrest portion.

The upper footrest portion 178 may be connected to the upper seat subframe 134 by way of mounting brackets 182 respectively connected to the right and left sides of the upper seat subframe 134, with the mounting brackets extending forwardly of the upper seat subframe. The mounting brackets 182 may be parts of, or have mounted thereto, one or more hinges by which the upper footrest portion 178 is pivotably connected to the front end of the upper seat subframe 134 for pivoting about pivot pins 184 of the hinges. For example, each of these hinges may include rearward and forward wings that are pivotably connected to one another by way of the pivot pins 184 positioned in a barrel assembly, the rearward wing may be the mounting bracket 160 that is mounted to the upper seat subframe 134, and the forward wing may be mounted to the lower/rear surface of the upper footrest portion 178. Any other suitable pivotable connection between the upper footrest portion 178 and the upper seat subframe 134 may be used.

The hinges/pivot pins 184 that pivotably connect the upper footrest portion 178 to the upper seat subframe 134 may be characterized as being part of a powered footrest adjustment mechanism that is for both (e.g., simultaneously) pivoting the upper footrest portion relative to the upper seat subframe 134, and reciprocating the lower footrest portion 180 relative to the upper footrest portion. The footrest adjustment mechanism further includes one or more longitudinal guides that may be, for example, a pair of laterally spaced apart ball bearing slides by which the upper and lower footrest portions 178, 180 are movably connected to one another. The slides are positioned at the opposite right and left sides of the compound footrest 176, and each slide includes ball bearings positioned between elongate first and second slide parts 186, 188 configured so that the first and second slide parts are movably mounted to one another for relative movement in their lengthwise direction. For each slide, the first and second slide parts 186, 188 are respectively mounted to the upper and lower footrest portions 178, 180 so that the lower footrest portion 180 is mounted for moving with, and reciprocating relative to, the upper footrest portion 178. The slides (e.g., slide parts 186, 188) may be replaced with any suitable type of guiding (e.g., sliding) device(s), or the like. In the second embodiment, the upper and lower footrest portions 178, 180 remain substantially parallel to one another throughout the range of motion of the compound footrest 176, and the relative reciprocation between the upper and lower footrest portions 178, 180 is substantially translational, although the reciprocation occurs while the upper and lower footrest portions 178, 180 are together pivoting about the substantially coaxial axes of the pivot pins 184.

The footrest adjustment mechanism includes substantially similar right and left apparatus that operate concertedly for simultaneously pivoting the upper footrest portion 178 relative to the upper seat subframe 134, and reciprocating the lower footrest portion 180 relative to the upper footrest portion. In this regard, the foregoing and following discussion of the features of the footrest adjustment mechanism located at the right side of the chair 100 should be considered to be representative of the corresponding features of the footrest adjustment mechanism located at the left side of the chair.

The footrest adjustment mechanism includes a linear actuator, such as an electrically operated linear actuator 190, which may more specifically be in the form of a dual direction screw drive motor. The body of the linear actuator 190 is connected to support braces 192 that are attached to and extend downwardly from the side of the upper seat subframe 134, so that the linear actuator 190 is supported by the upper seat subframe. The output shaft of the linear actuator 190 is guidingly supported by a guide bracket 194 that is attached to and extends downwardly from the side of the upper seat subframe 134. A rear end of an extension shaft 196 is pivotably connected at a pivot 198 to the front end of the output shaft of the linear actuator 190, and the front end of the extension shaft 196 is pivotably connected at a pivot 200 to the rear/underside of the lower footrest portion 180. The pivots 198, 200 may be any suitable pivotable connections, such as, but not limited to, hinges, swivels, or the like.

As the output shaft of the linear actuator 190 is extended, the extension shaft 196 pushes the lower footrest portion 180 and cause the slide parts 186, 188 to allow the lower footrest portion to slide outwardly, away from the upper footrest portion 178, until the extension shaft 196 extends past guide bracket 194. Once the extension shaft 196 extends past guide bracket 194, the relative movement between the slide parts 186, 188 will have occurred and any further relative movement between the slide parts 186, 188 is prevented by way of interacting stops, or the like; and the extension shaft 196 pivots at the pivots 198, 200 so that the upper and lower footrest portions 178, 180 rise/pivot in unison about the pivot pin 184. The upper and lower footrest portions 178, 180 may continue to rise until they are even with (e.g., in substantially the same plane as) the upper seat subframe 134 (or until linear actuator 190 stops). A stop may be provided to prevent the upper and lower footrest portions 178, 180 from extending upwardly past the plane of the upper seat subframe 134, in an effort to avoid any unwanted relative movement between the slide parts 186, 188 that may cause the upper and lower footrest portions 178, 180 to begin closing back together.

As another example furniture piece, a chair 300 of a third embodiment of this disclosure is discussed in the following, with reference to FIGS. 38-44. The first, second and third embodiments of this disclosure may be alike, except for variations noted and variations that will be apparent to one of ordinary skill in the art. The figures should be considered schematic only. For example, elements may be added in one view and left out in another to assist clarity of illustration. Further, any of the individual features, particularly powered actuators, can be substituted in and among each of the three embodiments.

The chair 300 may be generally considered to combine many of the features and functions the first and second embodiments. One of ordinary skill in the art will be able to determine those one or more features of the first embodiment or the second embodiment, or both, which may be employed in the third embodiment discussed below. It should be appreciated that the preceding description of embodiments and individual elements of the invention are applicable to the embodiments and elements discussed below unless specifically described otherwise.

Generally, the chair 300, which is schematically drawn in FIGS. 38-44 to illustrate the mechanical and structural inner workings of the chair, can be seen from a side or a perspective view in several configurations. It should be understood that the configurations illustrated are not discrete positions, but that the chair 300 can be actuated into nearly any position intermediate to the states shown in the figures. The chair 300 includes an adjustable backrest and an adjustable seat platform analogous to those of the couch 10. The chair 300 then adds the ability to recline the backrest analogous to the motion of the chair 100 and adds an optional adjustable footrest analogous to that described above with respect to the second embodiment, chair 100.

Turning to FIGS. 38-44, the chair 300 includes a frame 302, a rearward backrest frame 304, an upper backrest frame 306, a lower backrest frame 308 and a seat platform 336. The rearward backrest frame 304 is supported by the seat platform 336 either directly or indirectly in such a way that the rearward backrest frame 304 is able to pivot (either forwardly or rearwardly) relative to a rear end of the seat platform 336, thereby providing a reclining function to the chair 300. The pivoting of the rearward backrest frame 304 relative to the seat platform 336 can be provided by a recline actuator 356 (see FIG. 40). In the illustrated embodiment, the recline actuator 356 includes a linear screw motor for providing a torque to the rearward backrest frame 304 about recline pivot 357. Any suitable mechanical, hydraulic, electronic, or pneumatic actuator capable of angularly adjusting the rearward backrest frame 304 relative to the seat platform 336 is within the scope of this disclosure.

The upper backrest frame 306 and the lower backrest frame 308 may be collectively considered as a forward backrest frame. Movement of the forward backrest frame relative to the rearward backrest frame 304 provides for adjustment of an effective seat deep of a seat cushion 337 (as shown in FIGS. 39-43) supported by the seat platform 336. In the illustrated embodiment the upper backrest frame 306 is pivotably attached to a top portion of the rearward backrest frame 304 by a hinge 310. The lower backrest frame 308 is slidably mounted to the outside of the upper backrest frame 306 by a pair of slide joints 312 such as drawer slides as known in the art.

Figure 39:
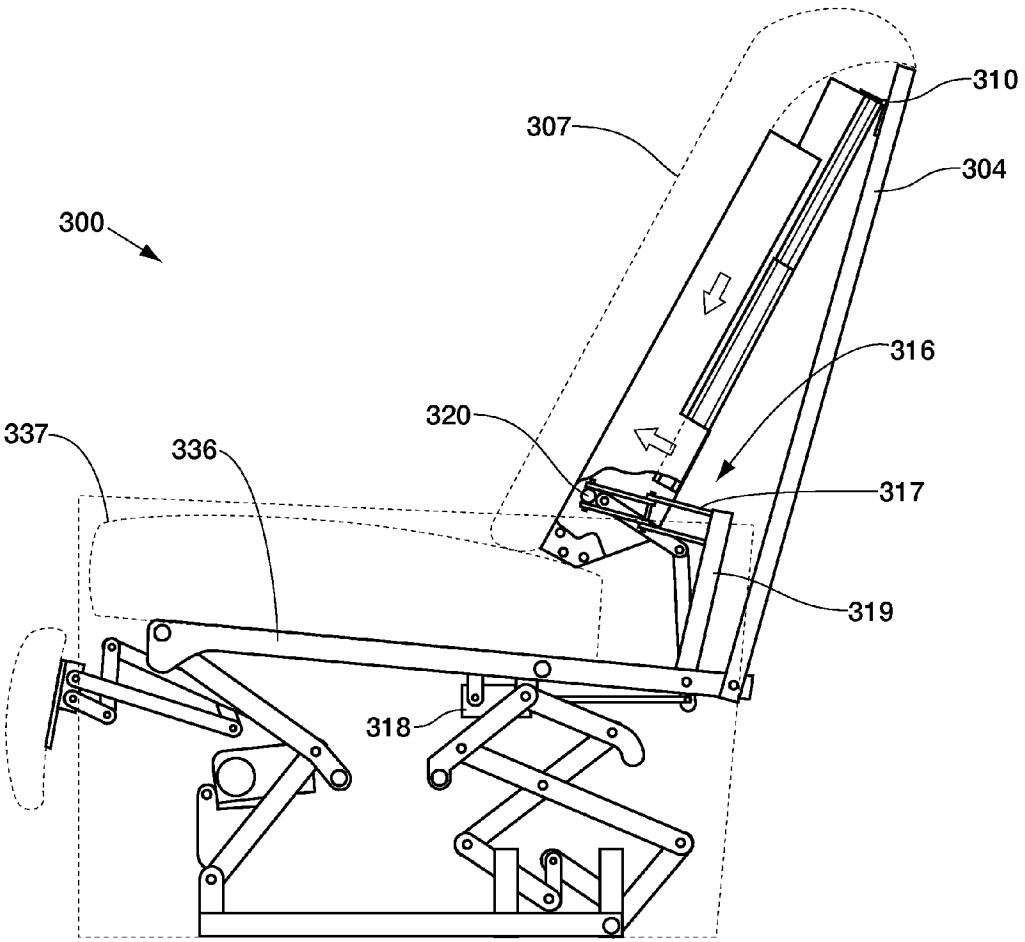

A backrest actuator 316 is provided between the rearward backrest frame 304 and the lower backrest frame 308. In the illustrated embodiment the backrest actuator 316 includes a scissor linkage 317 and a powered driver 318, as shown in FIG. 39. The scissor linkage 317 can be mounted between a tower 319, and the lower backrest frame 308. At least of one end of the scissor linkage 317 has a pivot connection to allow angular adjustment as the forward backrest changes inclination. The tower 319 extends upward relative to, and is fixed relative to, the seat platform 336. Other known types of actuators capable of expanding and contracting the distance between the rearward backrest frame 304 and the lower backrest frame 308 could also be used. The backrest actuator 316 should be able to stop and lock at nearly any length of expansion and be of sufficient strength to support the back of a user without collapsing the distance between the rearward backrest frame 304 and the lower backrest frame 308.

As shown in FIG. 39, in the illustrated embodiment the lower backrest frame 308 connects to the backrest actuator 316 by a pivot joint 320. The pivot joint 320 could also be positioned between the backrest actuator 316 and the tower 319. The goal is to allow the backrest actuator 316 to expand and contract in a generally linear direction while allowing for angular adjustment between the rearward backrest frame 304 and the forward backrest frame about hinge 310.

It should be understood that, in this embodiment, the lower backrest frame 308 is able to slide relative to the upper backrest frame 306. The lower backrest frame 306 may be biased downwardly by gravity and supported at its lower end by the seat platform 336. It should be further recognized that support of the lower backrest frame 306 by the seat platform 336 includes any seat cushion 337, padding, springs or upholstery added to the frames to finish the completed chair 300. While the upper and lower backrest frames 306, 308 are shown as free sliding, it is possible to include further powered actuators to facilitate the motion therebetween.

Similar to the seat platforms of the couch 10 and the second embodiment's chair 100, the seat platform 336 is supported relative the frame 302 to allow adjustment therebetween.

Movement of seat platform 336, in this embodiment, is accomplished by using seat actuators. A pair of seat actuators 354, 355 is coupled between the frame 302 and the seat platform 336. The pair of seat actuators 354, 355 is generally considered spaced apart in the front to back direction. In other words, one of the seat actuators 354 is associated with adjustably supporting the front the seat platform 336 and one of the seat actuators 355 is associated with adjustably supporting the rear of the seat platform 336. Therefore extension and retraction of the front seat actuator 354 lifts and lowers the front of the seat platform 336 respectively and extension and retraction of the rear seat actuator 355 lifts and lowers the rear of the seat platform 336 respectively. Use of the pair of seat actuators 354, 355 moving together in the same direction will raise or lower the seat platform 336 without change of horizontal orientation. Use of the pair of seat actuators 354, 355 in opposite directions or use of only one of the seat actuators 354, 355 will adjust the inclination of the seat platform about an axis generally perpendicular to the front-to-rear direction of the chair 300. The seat actuators 354, 355 are shown in the illustrated example as each including at least one scissor linkage. Any known linkage configuration capable of providing substantially similar up and down motion to the seat platform 336 could be used. The two seat actuators 354, 355 need not be identical. Any known drive motor capable of operating the known linkage could also be used. For example, the unique aspects of the rearward backrest frame 304 and the forward backrest frame could be combined with the seat subframe 134 and its respective actuators of second embodiment chair 100.

Figure 38:
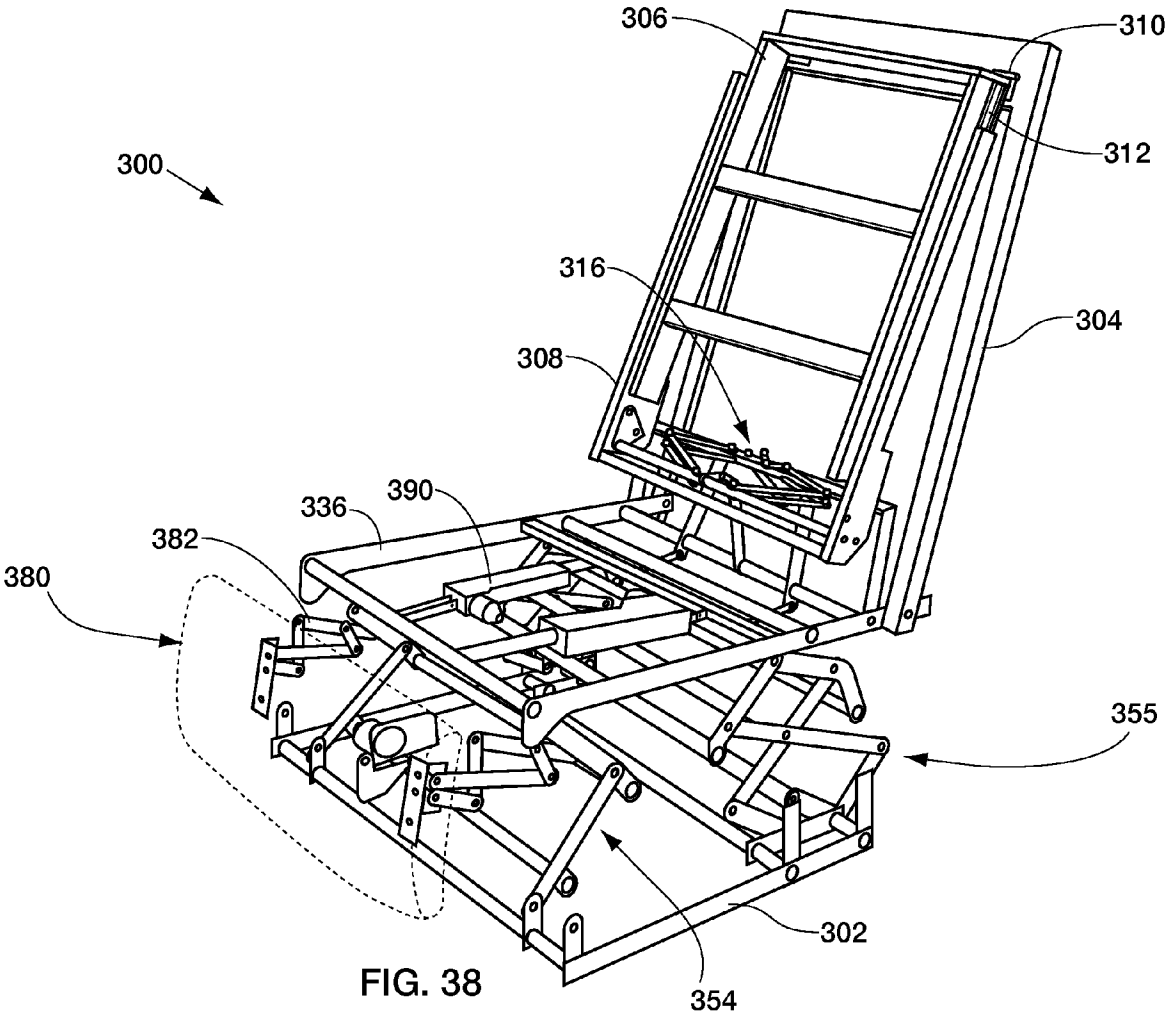
FIGS. 38-44 illustrate a third embodiment of this disclosure. Arrows therein that are not associated with reference numerals are schematically illustrative of movement of respective features of a chair of the third embodiment.

The chair 300 can also include an adjustable footrest 380 (see FIG. 42) capable of extending and retracting (or folding and unfolding) with respect to the frame 302 and arms 303 mounted thereto. The footrest 380 can be manually operated as is known in the art, but is preferably driven by a powered footrest actuator 390 as shown in FIG. 38. Use of a powered footrest actuator 390 allows the footrest 380 to be selectively positioned relative to the frame 302 in nearly an infinite number of intermediate positions between a fully folded position and a fully extended position. The footrest 380 is supported by a linkage 382, as seen in FIG. 38, that is driven by the footrest actuator 390. Any suitable linkage 382 capable of being packaged beneath the seat platform 336 in a folded position and extending to support the footrest 380 in an extended position could be used. In other words, the arrangement of links illustrated should not be considered limiting.

Having described the primary components of the chair 300, it should be understood that this disclosure contemplates the independent use of each of the at least five actuators (backrest 316, recline 356, footrest 390, and seat 354, 355), and that such independent use provides the chair 300 of this third embodiment with a significant ability to be reconfigured to meet the comfort or support needs of the user. In each case, the user is able to make the desired adjustments while seated so that the chair can be repeatedly adjusted for the user's comfort as their desires change during an extended period of sitting, whether watching a motion picture or receiving dialysis treatment.

The backrest actuator 316 combines with the unique features of the forward backrest frame to provide a seat depth adjustment, allowing for seating comfort for users covering a wide range of heights. This seat depth adjustment capability, as described with the first two embodiments, is the result of moving the lower backrest frame 308 back and forth along the surface of the seat cushion 337 or seat platform 336. The slides 312 provided between the lower backrest frame 308 and the upper backrest frame 306 can eliminate or at least minimize the gap between the seat cushion 337 and the back cushion 307 that would ordinarily widen when adjusting the seat relative to the back in a conventional chair.

The several example modes of the chair 300 as shown in FIGS. 38-44 will now be described in more detail. FIG. 38 shows a neutral upright position of the chair 300 configured to represent a conventional seat. The footrest 380 is retracted, and the seat platform 336 is generally level (horizontal), though some front to rear tilt is also possible. The rearward backrest frame 304 is generally upright relative to the frame 302, and the backrest actuator 316 is contracted to place the forward backrest frame near the rearward backrest frame 304. In the configuration shown the backrest cushion would be adjacent the rear edge of the seat cushion, to provide a relatively deep effective seat depth.

Transitioning to a first relatively short seat depth position, shown in FIG. 39, this configuration comprises the expansion of the backrest actuator 316. Expansion of the backrest actuator 316 pushes the forward backrest frame along the top surface of the seat platform 336, shortening the effective seat depth. The forward backrest frame (comprised of the upper backrest frame 306 and the lower backrest frame 308) will provide an increasing angle of inclination with respect to the seat platform 336. The rearward backrest frame 304, the forward backrest frame and the seat platform 336 can be considered as three sides of a triangle. The rearward backrest frame 304 provides a side with a fixed length. As the amount of the seat platform 336 that is covered by the backrest increases, this leg of the triangle also increases in length. Therefore, in order to maintain substantial contact between the seat cushion 337 and the back cushion 307, the forward backrest frame should provide a side of the triangle that is also increasing in length. This is made possible by the lower backrest frame 308 sliding down relative to the upper backrest frame 306. See the arrows in FIG. 39.

Figure 40:
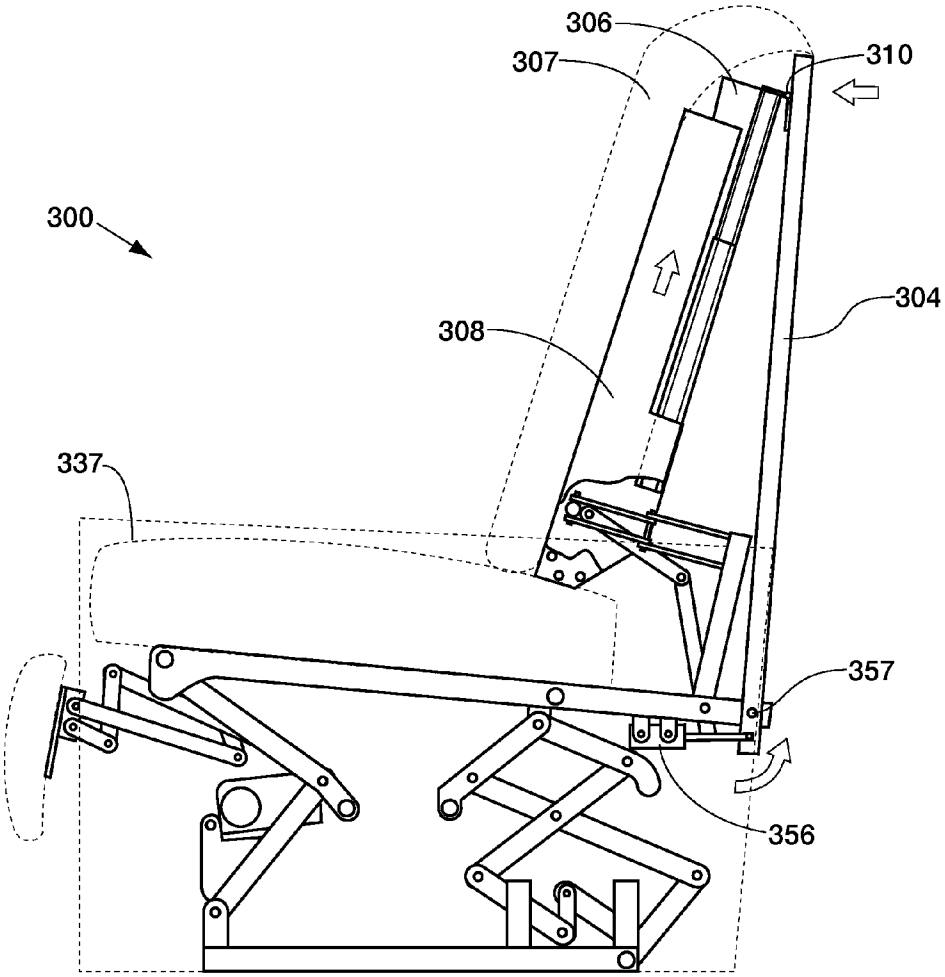

FIG. 40 shows a second relatively short seat depth position that maintains a more upright back cushion 307. To achieve the configuration of FIG. 40 as opposed to that shown in FIG. 39, the recline actuator 356 is used to rotate the rearward backrest frame 304 to a more vertical or even forward leaning position. Rotation of the rearward backrest frame in a forward direction moves the location of hinge 310 forward relative to the seat cushion 337 and rotating the forward backrest frame to a more upright position. To maintain the closed triangle discussed above, the forward backrest frame can shorten in length by compressing the lower backrest frame 308 relative to the upper backrest frame 306. See the arrows in FIG. 40.

Figure 41:
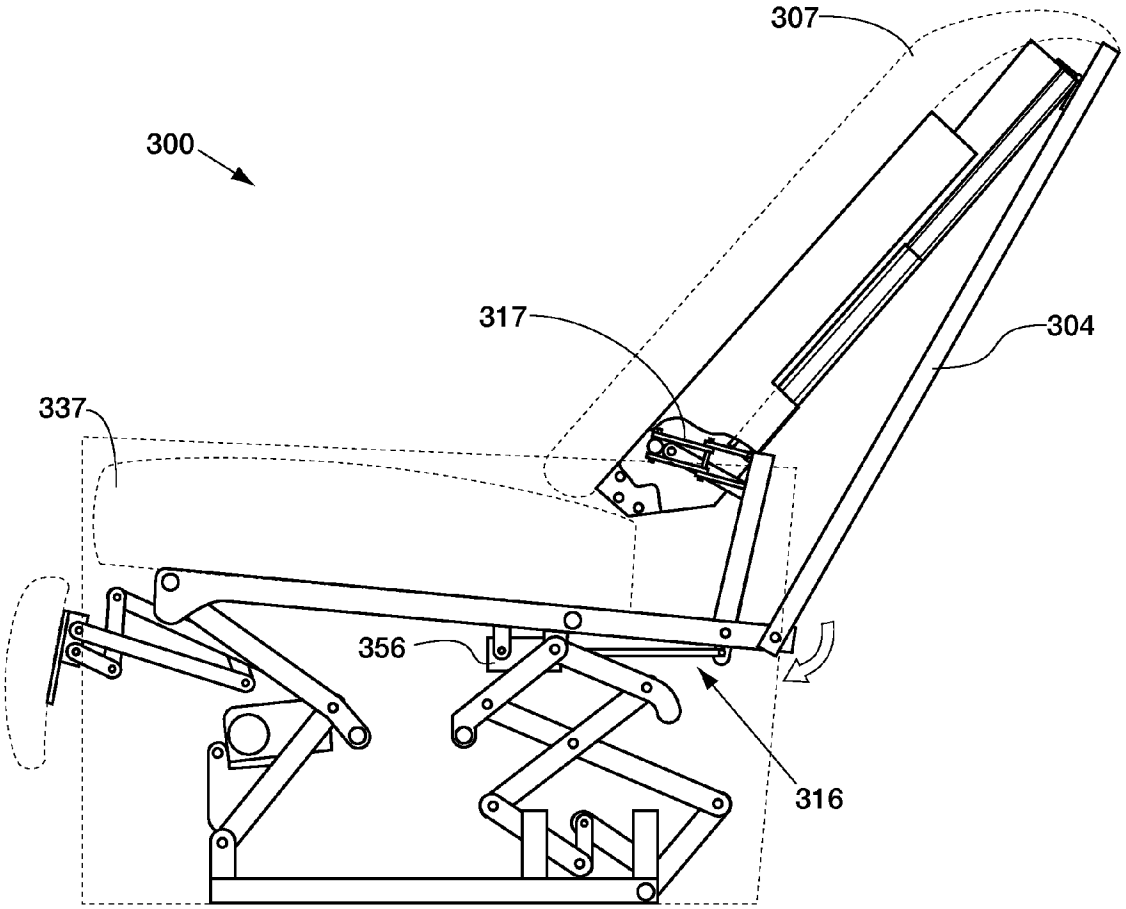

FIG. 41 shows the chair 300 in a reclined position. As should be understood in view of the forgoing, the reclined position shown in FIG. 41 is the result of reclining the rearward backrest frame 304 in the rearward direction using the recline actuator 356. The backrest actuator 316 can be operated independently to be in the compact/closed position (as shown in FIG. 38) or the extended/open position as shown in FIG. 41. The position of the backrest actuator 316 and the corresponding extension of scissor linkage 317, will be as necessary in order to maintain the closed gap between the seat cushion 337 and the back cushion 307. In addition, the preferred seat depth for the seated individual will impact the position of the backrest actuator 316.

Figure 42:
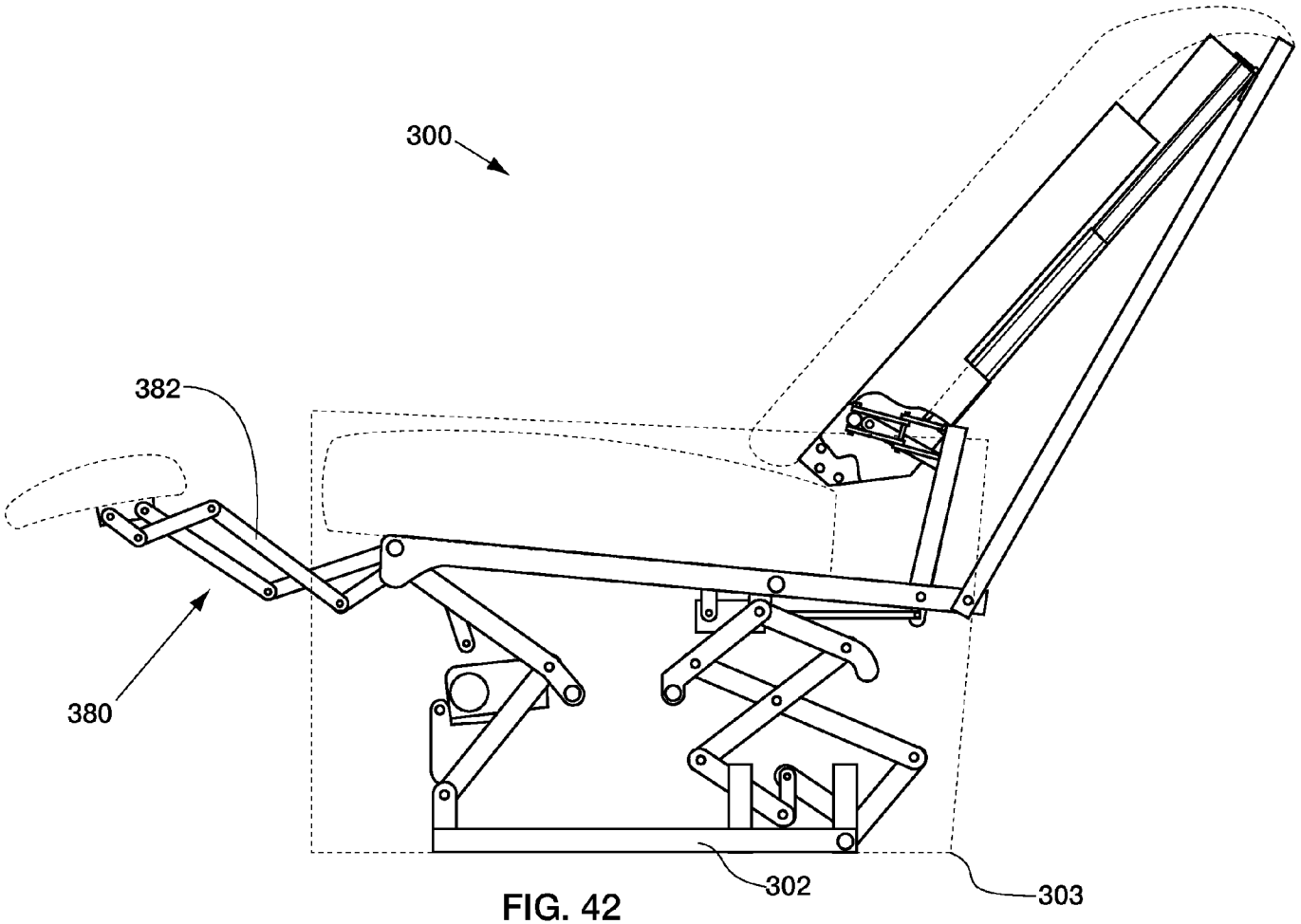

FIG. 42 shows a reclined position of the chair 300, substantially similar to the view in FIG. 41, with the addition of the footrest 380 in the extended position as a result of extending the footrest actuator 390 (see FIG. 38).

Figure 43:
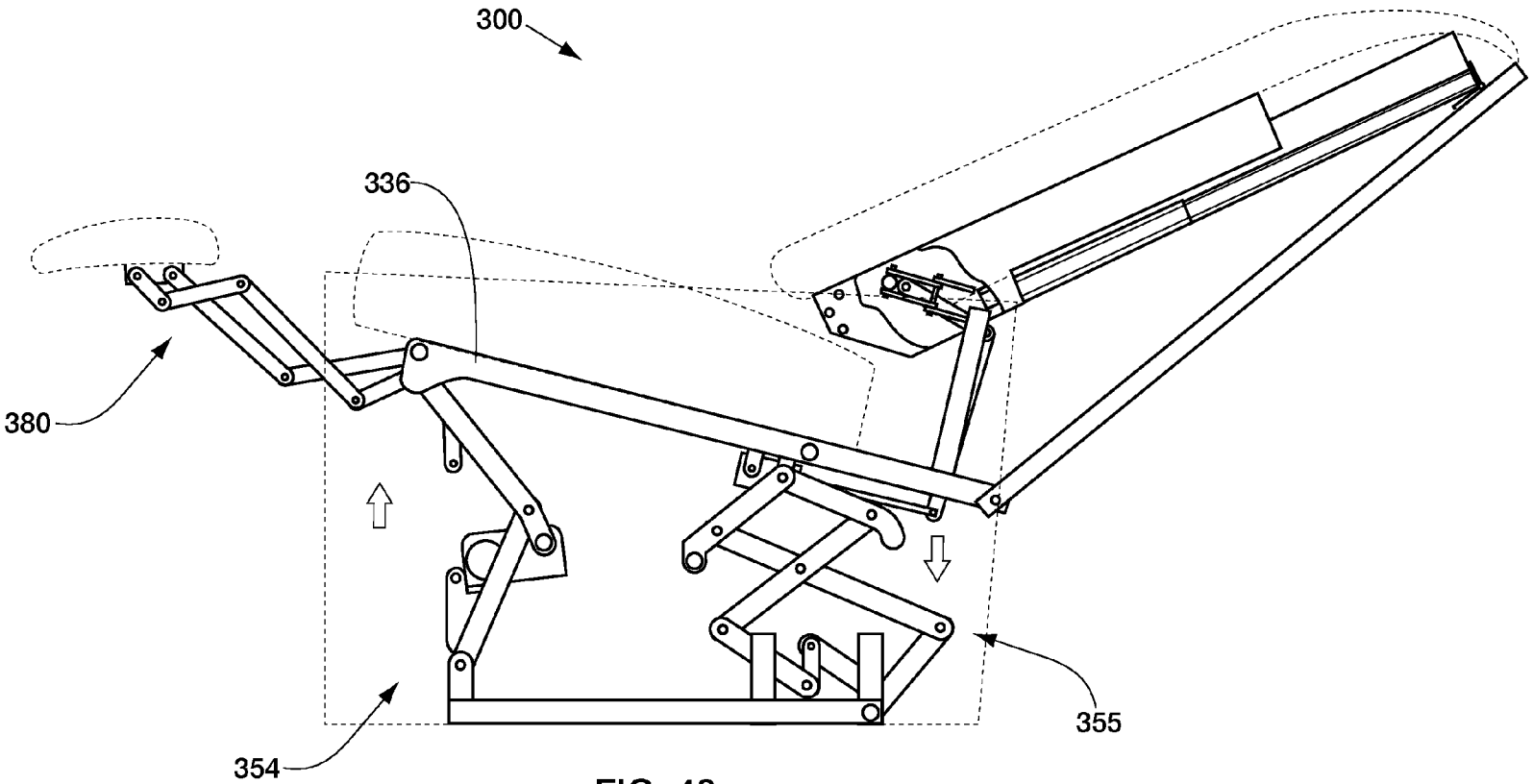

FIG. 43 shows the chair 300 approaching a near horizontal recline position, sometimes referred to in the art as a zero gravity position. The forward seat actuator 354 can be extended to raise the front end of the seat platform 336, and likewise the footrest 380. The rear seat actuator 355 can be contracted, lowering the rear of the seat platform 336 and the backrest thereby causing an even greater degree of recline.

Figure 44:
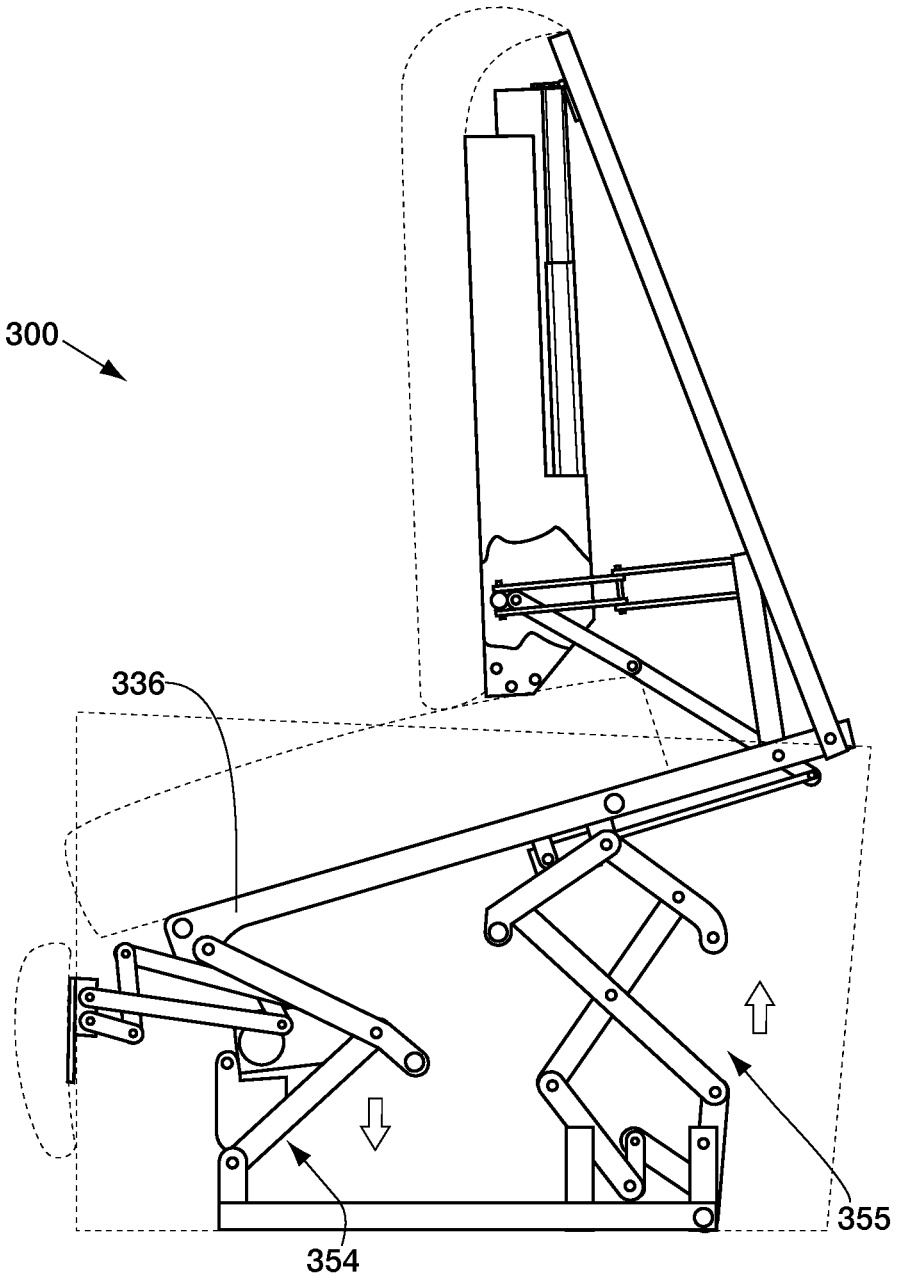

FIG. 44 shows the chair 300 in a position common to lift chairs, assisting the user with standing from their position within the chair. The lift position includes a compact front seat actuator 354 and an expanded rear seat actuator 355, causing a generally front to back incline of the seat platform 336. To further assist the user in standing up from the chair 300, the forward backrest (306 and 308) is moved forward along the seat platform 336, reducing the effective seat depth.

It should be understood that the preceding description of the positions shown in FIGS. 38-44 are not limited to a cycle or progression of positions, but that each actuator may be individually operated from any first position to any second position. In some embodiments, the actuators may be programmed to function simultaneously or in a predetermined order to achieve a preferred position. As a non-limiting example, the footrest actuator 390 could be programmed to operate as the rearward backrest frame 304 reclines.

The couch 10 of the first embodiment and the chairs 100, 300 of the second and third embodiments may be alike, except for variations noted and variations that will be apparent to one of ordinary skill in the art. Accordingly, one of ordinary skill should understand, among other things, that the chairs 100, 300 may include one or more remote controllers 202 and power sources 204 that may be at least similar to those discussed above for the first embodiment, for supplying power to and controlling operation of the chair's actuators. For example, the controller 202 may be tethered to the chair 100, 300, or may be in any other suitable configuration. As discussed above, in one example the controller 202 may be in the form of a user-interface for receiving instructions from a user, with the user-interface being in wired or wireless communication with one or more computers (which may include appropriate input and output devices, a processor, memory, software modules, etc.) or any other suitable device(s) that are located with the power source 204, or in any other suitable location, for controlling operations of chair's actuators/powered adjustment mechanisms.

The controller 202 and/or processors, software, firmware and/or hardware modules associated therewith may be configured to harmonize operation of the powered adjustment mechanisms of the chair 100, 300. For example, operations of the powered adjustment mechanisms of the chair 100 may be automatically coordinated to keep any gap 206 (FIG. 13) defined between the upper surface of seat cushion 102, 337 and the and the lower surface of the lowest backrest cushion 102 to a minimum. Other automatic coordination of the powered adjustment mechanisms of the chair 100, 300 to keep other gaps to a minimum or avoid undesirable adjustments are also within the scope of this disclosure.

By way of the controller 202 and/or processors, software, firmware and/or hardware modules associated therewith, one or more of the chair's actuators/powered adjustment mechanisms may be operated simultaneously or substantially simultaneously. For example, the chair 100 may be operated in a manner that seeks to assist an occupant of the chair in getting up from the chair into a standing position. An example of a method in which the chair 100 may be operated in a manner that seeks to assist an occupant of the chair in getting up from the chair into a standing position is described in the following, in accordance with the second embodiment. The lower seat adjustment mechanism (e.g., at least the rearward armed shaft 138 (FIGS. 10-12) and the seat actuator 354) may be operated to move the rear of the chair's seat platform upwardly relative to the front of the chair's seat platform. More specifically, the rear of the chair's seat platform may be pivoted upwardly and forwardly, such as at least partially schematically shown in FIG. 22 and FIG. 44, although the rear of the chair's seat platform may be raised higher than shown in FIG. 22. At the same time, the backrest is carried upwardly by the seat platform, and the backrest may be pivoted rearwardly by way of the recline adjustment mechanism (e.g., at least the screw drive motor 156 (FIGS. 10-12) relative to the seat platform, to at least further increase an angle defined between a forward-facing, exterior surface of the backrest and an upwardly-facing, exterior surface of the seat platform. Pivoting the backrest rearwardly at this time seeks to at least reduce, and preferably eliminate, the risk of the backrest pushing the occupant too far forwardly, and off balance. More specifically, the pivoting of the seat platform and the pivoting of the backrest may occur substantially simultaneously in a coordinated manner that seeks to prevent the backrest from pushing the occupant, who is standing up from the chair, too far forwardly, and off balance.

In accordance with the foregoing example of the method in which the chair 100 is operated in a manner that seeks to assist an occupant of the chair in getting up from the chair into a standing position, the pivoting of the seat platform is about a first axis, and the pivoting of the backrest is about a second axis that is substantially parallel to, and spaced apart from the first axis; and the pivoting of the backrest relative to the seat platform comprises pivoting the backrest rearwardly relative to the seat platform so that the backrest remains substantially upright throughout the method. In addition, if desired or helpful, the armrests 162 may be raised and/or pivoted at any time during the method for further aiding the occupant in standing up from the chair. The above-discussed method of operating the chair 100 for helping someone stand up could be carried out in reverse in an effort to help someone sit down. Similarly, the chair's actuators/powered adjustment mechanisms may be selectively operated in accordance with other methods having steps that may, optionally, also be implemented in reverse, if desired. More generally, one or more of the chair's actuators/powered adjustment mechanisms may be operated simultaneously and/or sequentially in various combinations and subcombinations tailored to a variety of different needs of a variety of different individuals.

In view of the foregoing, one of ordinary skill in the art will understand that there are numerous features and aspects of this disclosure. The various features and aspects of this disclosure may be in a variety of different combinations and subcombinations. For example and not for the purpose of limiting the scope of this disclosure, some features and aspects of this disclosure are discussed in the following, and other features and aspects of this disclosure will be apparent to those of ordinary skill in the art.

In accordance with one aspect of this disclosure, the seat platform can be made to be fully adjustable so that the occupant can, for example, raise and lower the seat platform in relation to the floor, and tilt the seat platform angularly. This allows the occupant to sit with their legs and feet at the desired position in relation to the floor. This also allows the occupant to sit in a manner which allows pressure points along their legs upwards to their lower back to be adjusted so that more pressure can be applied or taken off of these portions of their body as desired.

In one aspect of this disclosure, the backrest can be adjusted to move forward or backwards in part or in its entirety. The backrest could also be tilted to adjust the angle of the backrest. This adjustment of the backrest allows the occupant to sit more or less upright, thereby adjusting their posture to the desired angle. This adjustment of the backrest allows the entire backrest to move forward or backwards which allows the occupant to rest the desired portions of their back directly against the backrest, particularly the lower back. This adjustment allows the occupant to align their back as desired against the backrest for either taller or shorter individuals. This adjustment allows the occupant(s) to move the backrest backwards, effectively making the seat platform deeper, thereby allowing multiple individuals to lay together in a fashion that they could both watch television together comfortably.

In accordance with one aspect of this disclosure, the armrests can be adjusted to move forward or backwards, at least in part or in their entirety. This adjustment of the armrests allows the occupant to rest body parts such as arms, feet, or head at the desired angle. This feature is particularly useful for individuals with an injured arm or leg. In addition, the armrests could be manipulated in a manner to allow the occupant to rest their head in a more desirable position or angle so they can use the armrests more comfortable as a pillow whether they are lying on their side or back.

According to one aspect, the armrests can be adjusted to move up or down. This adjustment of the armrests allows the occupant to rest body parts such as arms, feet, or head at the desired height. This adjustment would also allow for a user to slide sideways from one object, such as a wheelchair, to the seating device. This feature is particularly useful for individuals with an injured arm or leg. In addition, provisions of this disclosure would allow a user to let their legs extend straight off the end of a sofa while the individual is lying down; this is particularly valuable to a taller individual.

In accordance with one aspect, the seating devices of this disclosure may be covered completely with fabric and cushions, which may be desirable for comfort, safety, and aesthetic purposes.

Regarding sofas and love seats, they are designed for multiple occupants, and one aspect of this disclosure is the provision of independent manipulation of each section of each seating device to suit each occupant.

Aspects of this disclosure can be incorporated into stationary seating devices where the user does not need to be able to get to the back or sides of the seating device for manipulation of the adjustment controls.

In accordance with one aspect of this disclosure, by manipulating the backrest forward, or by moving the seat platform up or down, the user can arrange the backrest and seat platform so that it is easier to sit down on, or get up from the seat platform. This is useful for users with decreased muscle use or decreased flexibility.

Those of ordinary skill will understand that numerous variations to the foregoing are within the scope of this disclosure. For example, whereas rectangular frames have been mentioned on numerous occasions in the foregoing, the frames and any other features that may have been described as being rectangular may be any other suitable shape and are not limited to rectangular shapes. As another example, in some instances, two or more of (e.g., a pair of) a particular feature have been disclosed. Notwithstanding, in many situations, there may be a greater number of, or lesser number of, each feature, as would be understood by those of ordinary skill in the art.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

What is claimed is:

1. A seating device comprising:

a frame;

a seat platform supported by the frame, the seat platform including opposite front and rear ends and configured to support a seat cushion;

a backrest having:

a first backrest portion extending upwardly from proximate the rear end of the seat platform, the first backrest portion comprising an upper backrest frame adjustably mounted to a lower backrest frame, the lower backrest frame configured to slidably vertically adjust relative to the upper backrest frame such that a lower end of the first backrest portion may be positioned proximate an upper surface of the seat platform or seat cushion, and a second backrest portion rearward of the first backrest portion and to which the first backrest portion is movably mounted, wherein the backrest is mounted to the seat platform and the first backrest portion is capable of being moved forwardly and rearwardly along the upper surface of the seat platform while the lower end remains proximate the upper surface of the seat platform or the seat cushion;

a first backrest-adjustment powered actuator operatively associated with the backrest for moving at least the first backrest portion forwardly and rearwardly relative to the second backrest portion and partially along the upper surface of the seat platform to adjust an effective depth of the seat platform; and a recline-adjustment powered actuator, the recline-adjustment powered actuator operably connected to the second backrest portion to adjust the angle of the second backrest portion relative to the seat platform.

2. The seating device according to claim 1, wherein the seat platform is adjustably mounted to the frame, and the seating device includes a pair of seat-adjustment powered actuators, wherein the pair of seat-adjustment actuators are configured to adjust an inclination of the seat platform relative to the frame, and are configured to move the seat platform, as a whole, upwardly and downwardly relative to the frame.

3. The seating device according to claim 2, wherein raising the rear end of the seat platform with the respective seat-adjustment actuator pushes the lower end of the first backrest portion upwardly.

4. The seating device according to claim 1, further comprising:

an extendable footrest; and a footrest-adjustment powered actuator for extending and retracting the footrest relative to the frame.

5. An upholstered seating device comprising:

an upholstered frame;

an upholstered seat platform supported by the frame, the seat platform including opposite front and rear ends;

an upholstered backrest having:

a first backrest portion extending upwardly from proximate the rear end of the seat platform, the first backrest portion comprising an upper backrest frame adjustably mounted to a lower backrest frame, the lower backrest frame configured to freely vertically adjust relative to the upper backrest frame such that a lower end of the first backrest portion may be positioned proximate an upper surface of the seat platform, and a second backrest portion rearward of the first backrest portion and to which the first backrest portion is movably mounted, wherein the backrest is mounted to the seat platform and the first backrest portion is capable of being moved forwardly and rearwardly relative to the second backrest portion and along the upper surface of the seat platform while the lower end remains proximate the upper surface of the seat platform;

a first backrest-adjustment actuator operatively associated with the backrest configured for moving at least the first backrest portion forwardly and rearwardly partially along the upper surface of the seat platform to adjust an effective depth of the seat platform while a user is sitting in the seating device; and a recline-adjustment powered actuator, the recline-adjustment powered actuator operably connected to the second backrest portion to adjust the angle of the second backrest portion relative to the seat platform.

6. The upholstered seating device according to claim 5, wherein the seat platform is adjustably mounted to the frame, and the seating device includes a pair of seat-adjustment powered actuators, one actuator of the pair is positioned adjacent to the front end and the other actuator of the pair is positioned adjacent to the rear end, wherein the pair of seat-adjustment actuators can work independently to adjust an inclination of the seat platform relative to the frame, and can work together to move the seat platform, as a whole, upwardly and downwardly relative to the frame.

7. The upholstered seating device according to claim 6, wherein raising the rear end of the seat platform with the respective seat-adjustment actuator pushes the lower end of the first backrest portion upwardly.

8. The upholstered seating device according to claim 5, further comprising:

an extendable footrest; and a footrest-adjustment powered actuator for extending and retracting the footrest relative to the frame.

9. Furniture comprising:

a frame;

a seat platform supported by the frame, the seat platform including opposite front and rear ends and an upper surface;

a backrest extending upwardly from proximate the rear end of the seat platform, the backrest including:

a first portion providing a forwardmost surface, the forwardmost surface configured for supporting at least a lower back of a user seated in the furniture, the forwardmost surface having a lower edge proximate the upper surface of the seat platform; and a second portion operably supporting the first portion; and a first powered actuator capable of adjusting an inclination of the forwardmost surface of the backrest relative to the upper surface of the seat platform, wherein the first portion of the backrest adjusts relative to the second portion to maintain an effective depth of the seat platform, and a second powered actuator capable of adjusting an inclination of the second portion of the backrest relative to the seat platform, wherein the first portion of the backrest comprises an upper frame movably mounted to a lower frame, the lower frame being adjustable relative to the upper frame such that a height of the lower frame of the first portion adjusts relative to the upper frame, as the inclination of the second portion changes.

10. The furniture according to claim 9, further comprising:

an adjustable footrest; and a footrest-adjustment powered actuator configured to extend and retract the footrest.

11. The furniture according to claim 10, wherein the seat platform is adjustably mounted to the frame, and the furniture includes a pair of seat-adjustment powered actuators, wherein the pair of seat-adjustment actuators are configured to adjust an inclination of the seat platform relative to the frame, and are configured to move the seat platform, as a whole, upwardly and downwardly relative to the frame.

12. A backrest attachable to a seating platform of a seating device, the backrest comprising:

a rearward backrest frame configured to be reclinably attached to the seating device; and a forward backrest frame pivotably attached to an upper end of the rearward backrest frame, the forward backrest frame comprising:

an upper backrest frame pivotably attached to the upper end of the rearward backrest frame, and a lower backrest frame slidably attached to the upper backrest frame such that the lower backrest frame is adjustable relative to the upper backrest frame to adjust a length of the forward backrest frame, wherein adjusting the length of the forward backrest frame is configured to allow a bottom of the lower backrest frame to remain in contact with the seating platform when the rearward backrest frame is reclined.

13. The backrest according to claim 12, wherein:

the lower backrest frame slides, substantially freely, relative to the upper backrest frame.

14. The backrest according to claim 13, wherein at least two slide joints slidably support the lower backrest frame at least partially within the upper backrest frame.

* * * * *